US008873344B2

(12) United States Patent
Shimizu et al.

(10) Patent No.: US 8,873,344 B2
(45) Date of Patent: Oct. 28, 2014

(54) POWER CONSUMPTION CONTROL DEVICE, TIMEPIECE DEVICE, ELECTRONIC DEVICE, POWER CONSUMPTION CONTROL METHOD, POWER CONSUMPTION CONTROL PROGRAM

(75) Inventors: Hiroshi Shimizu, Chiba (JP); Kazumi Sakumoto, Chiba (JP); Kenji Ogasawara, Chiba (JP); Kosuke Yamamoto, Chiba (JP); Keishi Honmura, Chiba (JP); Saburo Manaka, Chiba (JP); Akira Takakura, Chiba (JP)

(73) Assignee: Seiko Instruments Inc. (JP)

( * ) Notice: Subject to any disclaimer, the term of this patent is extended or adjusted under 35 U.S.C. 154(b) by 501 days.

(21) Appl. No.: 13/199,500

(22) Filed: Aug. 31, 2011

(65) Prior Publication Data

US 2012/0057438 A1 Mar. 8, 2012

(30) Foreign Application Priority Data

Sep. 3, 2010 (JP) ..... 2010-198081
Sep. 3, 2010 (JP) ..... 2010-198082
Feb. 7, 2011 (JP) ..... 2011-024233
Jul. 4, 2011 (JP) ..... 2011-148083

(51) Int. Cl.
*G04C 10/00* (2006.01)
*G04C 10/02* (2006.01)
*G04G 19/12* (2006.01)

(52) U.S. Cl.
CPC ..... *G04C 10/02* (2013.01); *G04C 10/00* (2013.01); *G04G 19/12* (2013.01)
USPC ..... 368/204; 368/64; 368/66; 368/206

(58) Field of Classification Search
CPC ..... G04C 10/00; G04C 10/02; G04C 19/00; G04C 19/10; G04C 19/12
USPC ..... 368/64, 66, 204, 205
See application file for complete search history.

(56) References Cited

U.S. PATENT DOCUMENTS 4,653,931 A * 3/1987 Takeda ..... 368/205
6,061,304 A * 5/2000 Nagata et al. ..... 368/66
6,301,198 B1 * 10/2001 Otaka et al. ..... 368/205
7,327,638 B2 * 2/2008 Nagata ..... 368/64
2005/0243657 A1 * 11/2005 Nagata ..... 368/204

FOREIGN PATENT DOCUMENTS

JP 60001587 1/1985

* cited by examiner

*Primary Examiner* — Vit W Miska
(74) *Attorney, Agent, or Firm* — Adams & Wilks

(57) ABSTRACT

A power consumption control device includes a power consumption control unit that receives the output potential of a photovoltaic cell generating an electromotive force, receives the output potential of a secondary battery charged by the electromotive force of the photovoltaic cell, causes a timepiece device to transition to a power saving state where a clock operation of measuring time is stopped when the output potential difference of the secondary battery is not greater than a predetermined threshold value, and the secondary battery is in a non-charging state indicating a state where the output potential difference of the photovoltaic cell is not greater than the output potential difference of the secondary battery.

28 Claims, 23 Drawing Sheets

| | |
|---|---|
| (BATTERY VOLTAGE) ≥ (GENERATED VOLTAGE) | NON-CHARGED STATE |
| (BATTERY VOLTAGE) < (GENERATED VOLTAGE) | CHARGED STATE |

POWER CONSUMPTION CONTROL DEVICE, TIMEPIECE DEVICE, ELECTRONIC DEVICE, POWER CONSUMPTION CONTROL METHOD, POWER CONSUMPTION CONTROL PROGRAM

BACKGROUND OF THE INVENTION

1. Field of the Invention

The present invention relates to a power consumption control device, a timepiece device, an electronic device, a power consumption control method, and a power consumption control program.

2. Background Art

A circuit configuration of a timepiece (timepiece device) including a photovoltaic cell, in which a photovoltaic cell is directly connected to a secondary battery and a timepiece circuit through a backflow prevention diode, and a constant voltage holding circuit regulates the maximum charge voltage of the secondary battery is disclosed (for example, see FIG. 1 of JP-A-60-1587).

However, in the timepiece (timepiece device) disclosed in JP-A-60-1587, even when the secondary battery (secondary power supply unit) is consumed up to an operation limit voltage or lower of a time motor that moves the hands, an operation (clock operation) of driving the time motor is continued. Thus, in this timepiece, the secondary battery enters into an over-discharged state. When the secondary battery enters into an over-discharged state, there is a problem in that the time motor is unable to start moving the hands quickly even if the photovoltaic cell (primary power supply unit) starts generating electricity. This is because it takes time to charge the secondary battery up to the operational voltage of the time motor. Thus, the user has to wait until the secondary battery is charged sufficiently to the operational voltage of the time motor, thus deteriorating convenience.

To obviate this inconvenience, a timepiece in which an operation of charging a secondary battery with a photovoltaic cell and an operation (clock operation of measuring time) of moving the hands by a time motor are controlled in a time-division multiplexed manner is known. However, this timepiece enables the motor to perform the hand movement operation immediately even when the secondary battery enters into an over-discharged state but does not solve the inconvenience caused by a charging standby state, which is to be solved by the present invention. Moreover, the time-division multiplexing of the charging of the secondary battery and the hand movement operation by the time motor results in a decrease in the charging efficiency. As a result, the time for a sufficient charging state is prolonged, thus deteriorating convenience.

SUMMARY OF THE INVENTION

It is an aspect of the present application to provide a power consumption control device, a timepiece device, an electronic device, a power consumption control method, and a power consumption control program enabling an operation to be performed immediately when a photovoltaic cell (primary power supply unit) starts generating electricity without performing time-division multiplexing control.

According to the aspect of the application, there is provided a power consumption control device including a power consumption control unit that causes a timepiece device to transition to a power saving state where a clock operation of measuring time is stopped when an output potential difference of a secondary power supply unit charged by an electromotive force of a primary power supply unit is not greater than a predetermined threshold value, and the secondary power supply unit is in a non-charging state indicating a state where an output potential difference of the primary power supply unit is not greater than the output potential difference of the secondary power supply unit.

In the power consumption control device of the above aspect, the power consumption control device may further include a charging detection unit that compares the output potential difference of the primary power supply unit with the output potential difference of the secondary power supply unit and generates a charging detection signal indicating that the secondary power supply unit is in the non-charging state when the output potential difference of the primary power supply unit is not greater than the output potential difference of the secondary power supply unit; and an oscillation prevention unit that prevents oscillation of the generated charging detection signal, and the transition to the power saving state by the power consumption control unit may be performed based on the generated charging detection signal.

In the power consumption control device of the above aspect, the oscillation prevention unit may include a predetermined load, and when the charging detection signal indicates the non-charging state, the power consumption control unit may cause the load to be connected to the primary power supply unit.

In the power consumption control device of the above aspect, the power consumption control unit may determine whether the secondary power supply unit is in the non-charging state when the timepiece device is in the power saving state, and the power consumption control unit may cause the timepiece device to transition from the power saving state to a clock operation state where the clock operation is performed when the secondary power supply unit is not in the non-charging state.

In the power consumption control device of the above aspect, the threshold value may be a value greater by a predetermined potential difference than a lower-limit potential difference in which the clock operation is possible.

In the power consumption control device of the above aspect, the timepiece device may include a timepiece control unit, and the power consumption control unit may cause the timepiece control unit to stop the clock operation when the timepiece device is caused to transition to the power saving state.

In the power consumption control device of the above aspect, the timepiece device may include an oscillation control unit that oscillates and generates a fundamental clock signal used for measuring time, and the power consumption control unit may cause the oscillation control unit to stop oscillating the fundamental clock signal when the timepiece device is caused to transition to the power saving state.

In the power consumption control device of the above aspect, the oscillation control unit may include a constant voltage circuit unit and will stop the operation of the constant voltage circuit unit when the timepiece device is in the power saving state.

In the power consumption control device of the above aspect, the power consumption control unit may cause the timepiece control unit to stop the clock operation and then causes the oscillation control unit to stop oscillating the fundamental clock signal when causing the timepiece device to transition to the power saving state, and the power consumption control unit may cause the oscillation control unit to start oscillating the fundamental clock signal and then causes the timepiece control unit to start the clock operation when causing the timepiece device to transition from the power saving state to the clock operation state.

In the power consumption control device of the above aspect, the clock operation may include an operation of driving a time motor that moves the hands of the timepiece device displaying time, the threshold value may be a value greater by a predetermined potential difference than a lower-limit potential difference in which the time motor can be driven, and the timepiece control unit may stop the driving of the time motor when transitioning to the power saving state.

In the power consumption control device of the above aspect, the power consumption control device may include: an output detection unit that detects a state where the output potential difference of the secondary power supply unit is not greater than the threshold value; and a charging detection unit that detects the non-charging state, and the power consumption control unit may determine whether the output potential difference of the secondary power supply unit is not greater than the threshold value based on the detection result by the output detection unit, and the power consumption control unit may determine whether the secondary power supply unit is in the non-charging state based on the detection result by the charging detection unit.

In the power consumption control device of the above aspect, the power consumption control device may include a detection unit that detects whether the output potential difference of the secondary power supply unit is not greater than a predetermined threshold value, and the power consumption control unit may cause the timepiece device to transition to the power saving state when the secondary power supply unit is in the non-charging state, and the detection result by the detection unit is not greater than the predetermined threshold value and releases the power saving state when the secondary power supply unit is not in the non-charging state.

In the power consumption control device of the above aspect, the power consumption control device may further include a switching unit that prevents current from backflowing from the secondary power supply unit to the primary power supply unit when the output of the charging detection unit indicates the non-charging state, and the oscillation prevention unit may include a diode element that is disposed in series to the switching unit so that when the secondary power supply unit is not in the non-charging state, a forward bias is applied between a positive terminal of the secondary power supply unit and a positive terminal of the primary power supply unit, or between a negative terminal of the secondary power supply unit and a negative terminal of the primary power supply unit, and generates a predetermined prescribed potential difference between the two input terminals subjected to the comparison in the charging detection unit.

In the power consumption control device of the above aspect, the oscillation prevention unit may include a resistor element that is disposed in series to the switching unit between a positive terminal of the secondary power supply unit and a positive terminal of the primary power supply unit, or between a negative terminal of the secondary power supply unit and a negative terminal of the primary power supply unit, and generates a predetermined prescribed potential difference between the two input terminals subjected to the comparison in the charging detection unit.

In the power consumption control device of the above aspect, the oscillation prevention unit may include a low-pass filter that removes a pulse signal of a predetermined prescribed frequency or higher from the output of the charging detection unit.

In the power consumption control device of the above aspect, the oscillation prevention unit may include a logic circuit that operates based on a clock signal of a predetermined prescribed cycle and removes a pulse signal of a prescribed pulse width or shorter based on the cycle from the output of the charging detection unit.

In the power consumption control device of the above aspect, the logic circuit may include a shift register which maintains a reset state when the output of the charging detection unit indicates the non-charging state, and of which the clock terminal is supplied with the clock signal and of which the input terminal is fixed at a logic high state, and the output of the shift register may be the output of the oscillation prevention unit.

In the power consumption control device of the above aspect, the clock signal may be generated by the electricity supplied from the primary power supply unit.

In the power consumption control device of the above aspect, the power consumption control unit may disconnect the load from the primary power supply unit when it is determined that the timepiece device being in the power saving state is to be caused to transition to the power saving state.

In the power consumption control device of the above aspect, the oscillation prevention unit may include a switching unit that connects a predetermined load to the primary power supply unit.

In the power consumption control device of the above aspect, the power consumption control device may further include: a secondary power supply unit that is charged by the electromotive force; and a detection unit that detects whether the output potential difference of the secondary power supply unit is not greater than a predetermined threshold value, the power consumption control unit may cause the timepiece device to transition to the power saving state when the detection result by the detection unit is not greater than the predetermined threshold value, and the predetermined load may be a load of which the power consumption is larger than the power consumption of the second load unit when the output voltage of the secondary power supply unit is the same as the predetermined threshold value, and the power saving state is released.

In the power consumption control device of the above aspect, the primary power supply unit may be a photovoltaic cell, and the predetermined load may be determined based on the relationship between the electromotive force and the intensity of light exposed to a panel of the photovoltaic cells that generates the electromotive force.

In the power consumption control device of the above aspect, the power consumption control device may further include a timepiece control unit that controls the clock operation, the timepiece control unit may include a load, and the power consumption control unit may cause the load of the timepiece control unit to be connected to the primary power supply unit when the charging detection signal indicates the non-charging state.

In the power consumption control device of the above aspect, the primary power supply unit may be a photovoltaic cell that generates an electromotive force upon exposure to light.

According to another aspect of the application, there is provided a timepiece device including the power consumption control device according to the above aspect.

According to another aspect of the application, there is provided an electronic device including the power consumption control device according to the above aspect.

According to another aspect of the application, there is provided a power consumption control method including a power consumption control procedure of causing a timepiece device to transition to a power saving state where a clock operation of measuring time is stopped when an output potential difference of a secondary power supply unit charged by an electromotive force of a primary power supply unit is not greater than a predetermined threshold value, and the secondary power supply unit is in a non-charging state indicating a state where an output potential difference of the primary power supply unit is not greater than the output potential difference of the secondary power supply unit.

According to another aspect of the application, there is provided a power consumption control program for causing a computer to execute: a power consumption control step of causing a timepiece device to transition to a power saving state where a clock operation of measuring time is stopped when an output potential difference of a secondary power supply unit charged by an electromotive force of a primary power supply unit is not greater than a predetermined threshold value, and the secondary power supply unit is in a non-charging state indicating a state where an output potential difference of the primary power supply unit is not greater than the output potential difference of the secondary power supply unit.

According to the aspects of the present application, when the output potential difference of the secondary power supply unit is not greater than the predetermined threshold value, and the secondary power supply unit is in the non-charging state indicating a state where the output potential difference of the primary power supply unit is not greater than the output potential difference of the secondary power supply unit, the power consumption control unit causes the timepiece to transition to the power saving state where the clock operation of measuring time is stopped. With this configuration, it is possible to reduce the power consumption of the timepiece device in the power saving state and to reduce the power consumption of the secondary power supply unit. Moreover, in the timepiece device of the present application, it is not necessary to control the operation of charging the secondary power supply unit with the primary power supply unit and the clock operation of measuring time in a time-division multiplexed manner.

Thus, in the timepiece device of the present application, it is possible to perform the clock operation immediately when the primary power supply unit starts generating electricity without performing time-division multiplexing control.

DETAILED DESCRIPTION OF THE INVENTION

First Embodiment

Hereinafter, an electronic device (for example, a timepiece device) according to a first embodiment of the present invention will be described with reference to the drawings.

Figure 1:
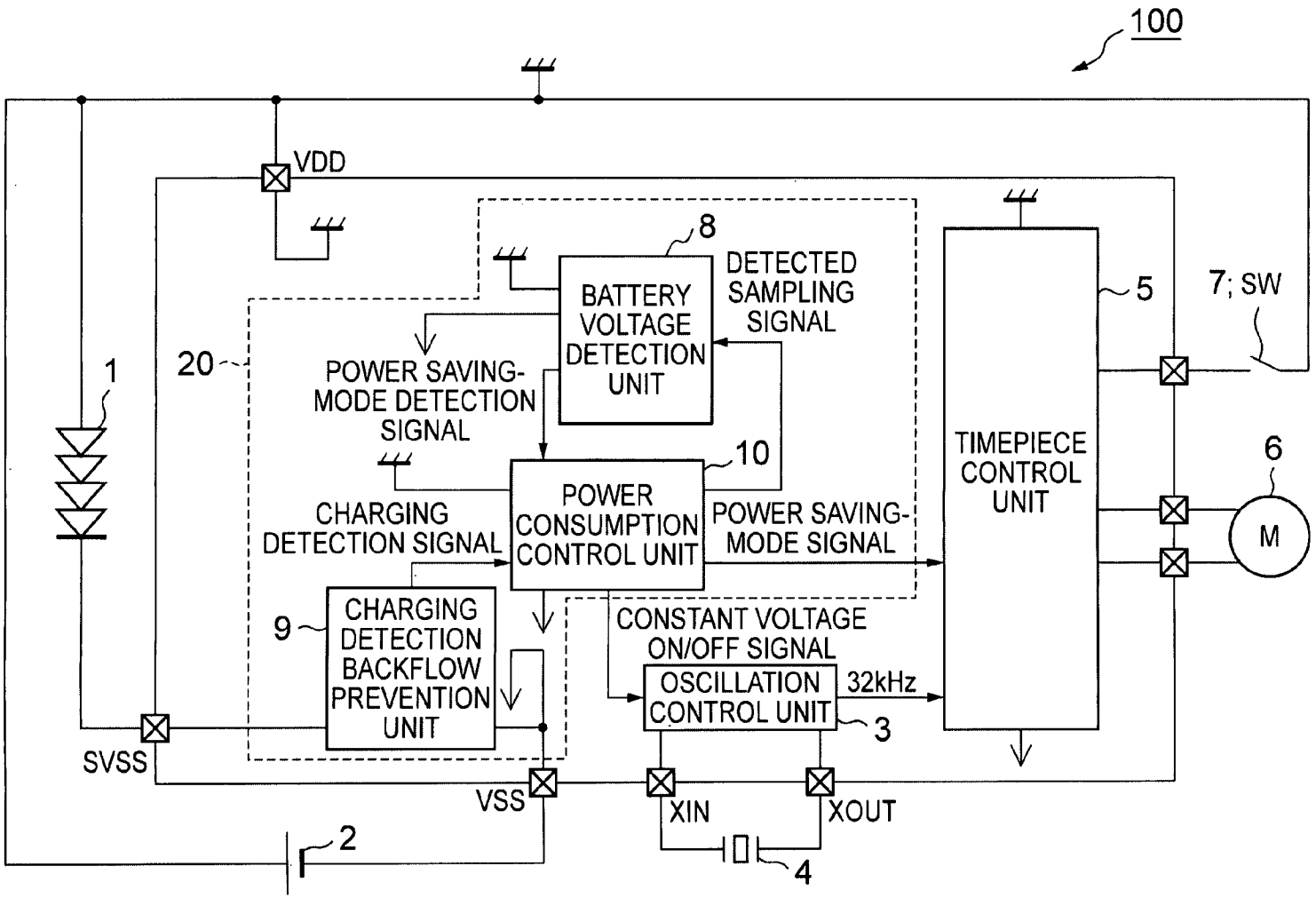
FIG. 1 is a simplified block diagram showing a timepiece device according to a first embodiment.

FIG. 1 is a simplified block diagram showing a timepiece device 100 according to the first embodiment.

In FIG. 1, the timepiece device (hereinafter referred to as a timepiece) 100 includes a photovoltaic cell 1, a secondary battery 2, an oscillation control unit 3, a quartz oscillator 4, a timepiece control unit (time motor driving control unit) 5, a time motor 6, a switch 7, and a power consumption control device 20. The timepiece 100 is an analog display timepiece, for example. Moreover, the power consumption control device 20 includes a battery voltage detection unit 8, a charging detection and backflow prevention unit (charging detection unit) 9, and a power consumption control unit 10.

The photovoltaic cell (primary power supply unit) 1 has a positive terminal connected to a power supply line VDD and a negative terminal connected to a power supply line SVSS. Moreover, the negative terminal of the photovoltaic cell 1 is connected to the charging detection and backflow prevention unit 9. The photovoltaic cell 1 generates an electromotive force upon exposure to light. The photovoltaic cell 1 charges the secondary battery 2 through the charging detection and backflow prevention unit 9. Moreover, the photovoltaic cell 1 supplies electricity to respective units of the timepiece 100 through the power supply line VDD. Here, the power supply line VDD is the VDD-earth line, which represents the reference potential of the timepiece 100.

The secondary battery (secondary power supply unit) 2 has a positive terminal connected to the power supply line VDD and a negative terminal connected to the power supply line VSS. Moreover, the negative terminal of the secondary battery 2 is connected to the charging detection and backflow prevention unit 9. The secondary battery 2 is charged by the electromotive force of the photovoltaic cell 1 through the charging detection and backflow prevention unit 9. Moreover, the secondary battery 2 supplies electricity to the respective units of the timepiece 100 through the power supply line VDD.

The oscillation control unit 3 is connected to the quartz oscillator 4 so as to oscillate and generate a fundamental clock signal used for measuring time. The oscillation control unit 3 controls an operation of oscillating the fundamental clock signal based on a constant voltage ON/OFF signal supplied from the power consumption control unit 10. Here, for example, the oscillation control unit 3 stops oscillating the fundamental clock signal when the constant voltage ON/OFF signal is in the H (high) state. Moreover, for example, the oscillation control unit 3 oscillates the fundamental clock signal when the constant voltage ON/OFF signal is in the L (low) state.

The oscillation control unit 3 supplies the generated fundamental clock signal to the timepiece control unit 5. The frequency of the fundamental clock signal generated by the oscillation control unit 3 is 32.768 kHz (kilohertz), for example.

The quartz oscillator 4 is connected to the oscillation control unit 3 and is used for oscillating the fundamental clock signal.

The timepiece control unit 5 controls a clock operation of measuring time based on the fundamental clock signal supplied from the oscillation control unit 3. The clock operation includes an operation of driving a time motor 6 that moves the hands of the timepiece 100 that displays time. That is, the timepiece control unit 5 is connected to the time motor 6 so as to control the driving of the time motor 6. The timepiece control unit 5 stops or starts the driving of the time motor 6 based on a power saving-mode signal supplied from the power consumption control unit 10. Here, for example, the timepiece control unit 5 stops driving the time motor 6 when the power saving-mode signal is in the H state. Moreover, for example, the timepiece control unit 5 drives the time motor 6 when the power saving-mode signal is in the L (low) state.

Moreover, the timepiece control unit 5 is connected to one end of a switch 7 and stops or starts the driving of the time motor 6 in accordance with the state of the switch 7.

The time motor 6 moves the hands of the timepiece 100 based on a driving signal supplied from the timepiece control unit 5.

The switch 7 has one terminal connected to the timepiece control unit 5 and the other terminal connected to the power supply line VDD. The switch 7 is a crown switch of the timepiece 100. The switch 7 is in the conduction state, for example, when the crown is pulled out of the timepiece 100, and the switch 7 is in the non-conduction state, for example, when the crown is pushed into the timepiece 100. When the crown is pulled out, the timepiece 100 stops the movement of the hands and enters into a state where time setting can be performed. That is, when the switch 7 is in the conduction state, the timepiece control unit 5 stops the driving of the time motor 6.

The battery voltage detection unit (output detection unit) 8 detects an output voltage (output potential difference) of the secondary battery 2 in response to a detection sampling signal supplied from the power consumption control unit 10. The battery voltage detection unit 8 outputs a power saving-mode detection signal to the power consumption control unit 10 as the detection result when the output voltage (output potential difference) of the secondary battery 2 is less than a predetermined threshold value. Here, the power saving-mode detection signal is in the H state, for example, when the output voltage of the secondary battery 2 is less than the predetermined threshold value, and is in the L state, for example, when the output voltage of the secondary battery 2 is not less than the predetermined threshold value.

Moreover, the predetermined threshold value is a value greater by a predetermined voltage than a lower-limit voltage (lower-limit potential difference) in which the time motor 6 can be driven. For example, the lower-limit voltage in which the time motor 6 can be driven is 1.0 V (volt). In this case, the predetermined threshold value may be 1.1 V which is 10% greater than the lower-limit voltage in which the time motor 6 can be driven.

The charging detection and backflow prevention unit (charging detection unit) 9 detects a non-charging state indicating a state where the output voltage (output potential difference) of the photovoltaic cell 1 is not greater than the output voltage (output potential difference) of the secondary battery 2. The charging detection and backflow prevention unit 9 outputs a charging detection signal to the power consumption control unit 10 as the detection result when the non-charging state is detected. Here, the charging detection signal is in the L state, for example, when the secondary battery 2 is in the non-charging state. Moreover, the charging detection signal is in the H state, for example, when the secondary battery 2 is in a charging state indicating a state where the output voltage of the photovoltaic cell 1 is greater than the output voltage of the secondary battery 2.

Moreover, when the secondary battery 2 is in the non-charging state, the charging detection and backflow prevention unit 9 cuts the connection between a power supply line SVSS connected to the negative terminal of the photovoltaic cell 1 and the power supply line VSS connected to the negative terminal of the secondary battery 2. With this configuration, the charging detection and backflow prevention unit 9 prevents current from back-flowing from the secondary battery 2 to the photovoltaic cell 1.

The power consumption control unit 10 determines whether the output voltage (output potential difference) of the secondary battery 2 is less than the predetermined threshold value described above based on the detection result (power saving-mode detection signal) by the battery voltage detection unit 8. Moreover, the power consumption control unit 10 determines whether the secondary battery 2 is in the non-charging state indicating a state where the output voltage (output potential difference) of the photovoltaic cell 1 is not greater than the output voltage (output potential difference) of the secondary battery 2 based on the detection result (charging detection signal) by the charging detection and backflow prevention unit 9. When the output voltage of the secondary battery 2 is less than the predetermined threshold value, and the secondary battery 2 is in the non-charging state, the power consumption control unit 10 causes the timepiece 100 to transition to a power saving state where the clock operation of measuring time is stopped.

Here, the power saving state means a state where the timepiece control unit 5 stops the driving of the time motor 6, and the oscillation control unit 3 stops outputting the fundamental clock signal. Thus, when the timepiece 100 is caused to transition to the power saving state, the power consumption control unit 10 causes the timepiece control unit 5 to stop the clock operation (the operation of moving hands by the time motor 6). Moreover, when the timepiece 100 is caused to transition to the power saving state, the power consumption control unit 10 causes the oscillation control unit 3 to stop oscillating the fundamental clock signal.

Moreover, when the secondary battery 2 is in the power saving state, the power consumption control unit 10 determines whether the secondary battery 2 is in the non-charging state based on the detection result (charging detection signal) by the charging detection and backflow prevention unit 9. When the secondary battery 2 is not in the non-charging state, the power consumption control unit 10 causes the timepiece 100 to transition from the power saving state to a normal operation state (the clock operation state) where the clock operation is performed. Here, the normal operation state (the clock operation state) means a state where the oscillation control unit 3 outputs the fundamental clock signal, and the timepiece control unit 5 drives the time motor 6.

The power consumption control unit 10 supplies the detection sampling signal to the battery voltage detection unit 8 as a trigger signal for detecting the output voltage of the secondary battery 2. Moreover, the power consumption control unit 10 supplies the constant voltage ON/OFF signal to the oscillation control unit 3 and the power saving-mode signal to the timepiece control unit 5. The power consumption control unit 10 performs control of causing the timepiece 100 to transition from the normal operation state to the power saving state or control of causing the timepiece 100 to transition from the power saving state to the normal operation state in accordance with the constant voltage ON/OFF signal and the power saving-mode signal.

Figure 2:
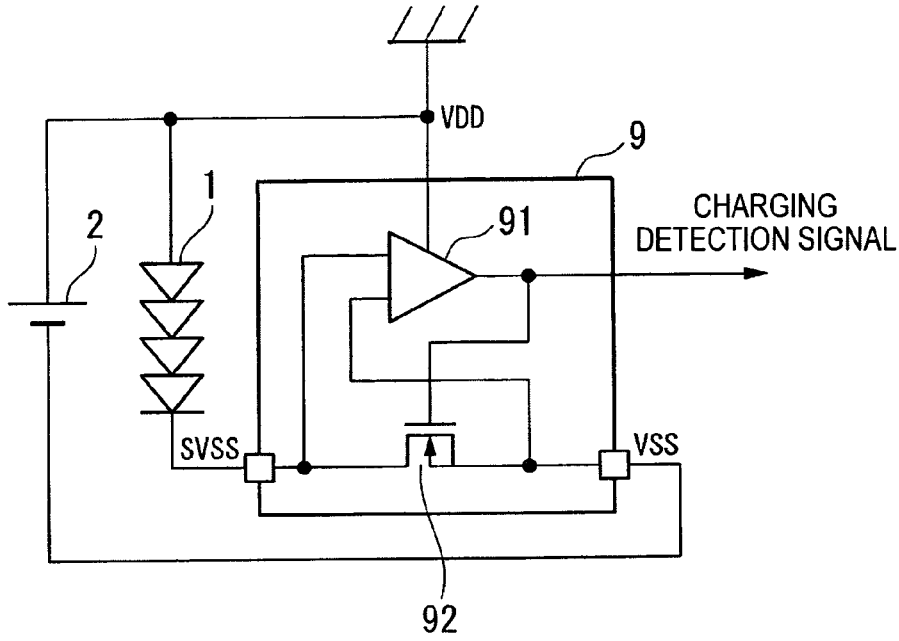
FIG. 2 is a simplified block diagram showing an example of a charging detection and backflow prevention unit in the first embodiment.

FIG. 2 is a simplified block diagram showing an example of the charging detection and backflow prevention unit 9 in the first embodiment.

In FIG. 2, the charging detection and backflow prevention unit 9 includes a comparator 91 and an NMOS switch 92.

The comparator 91 has an input terminal of which one end is connected to the power supply line SVSS connected to the negative terminal of the photovoltaic cell 1 and of which the other end is connected to the power supply line VSS connected to the negative terminal of the secondary battery 2. Moreover, the output of the comparator 91 is the charging detection signal. When the output voltage of the photovoltaic cell 1 is not greater than the output voltage of the secondary battery 2 (the secondary battery 2 is in the non-charging state), the comparator 91 outputs the L state to the power consumption control unit 10 as the charging detection signal. Moreover, when the output voltage of the photovoltaic cell 1 is greater than the output voltage of the secondary battery 2, the comparator 91 outputs the H state to the power consumption control unit 10 as the charging detection signal.

The NMOS switch 92 is a switch such as an NMOS transistor (N-channel Metal Oxide Silicon Field-Effect Transistor), for example. The NMOS switch 92 has a source terminal connected to the power supply line VSS, a drain terminal connected to the power supply line SVSS, and a gate electrode connected to the output terminal of the comparator 91. The NMOS switch 92 cuts the connection between the power supply line VSS and the power supply line SVSS when the output of the comparator 91 is in the L state (non-charging state). In this way, the NMOS switch 92 prevents current from back-flowing from the secondary battery 2 to the photovoltaic cell 1. Moreover, the NMOS switch 92 connects the power supply line VSS and the power supply line SVSS when the output of the comparator 91 is in the H state (charging state). In this way, the electromotive force of the photovoltaic cell 1 is charged to the secondary battery 2.

Figure 3:
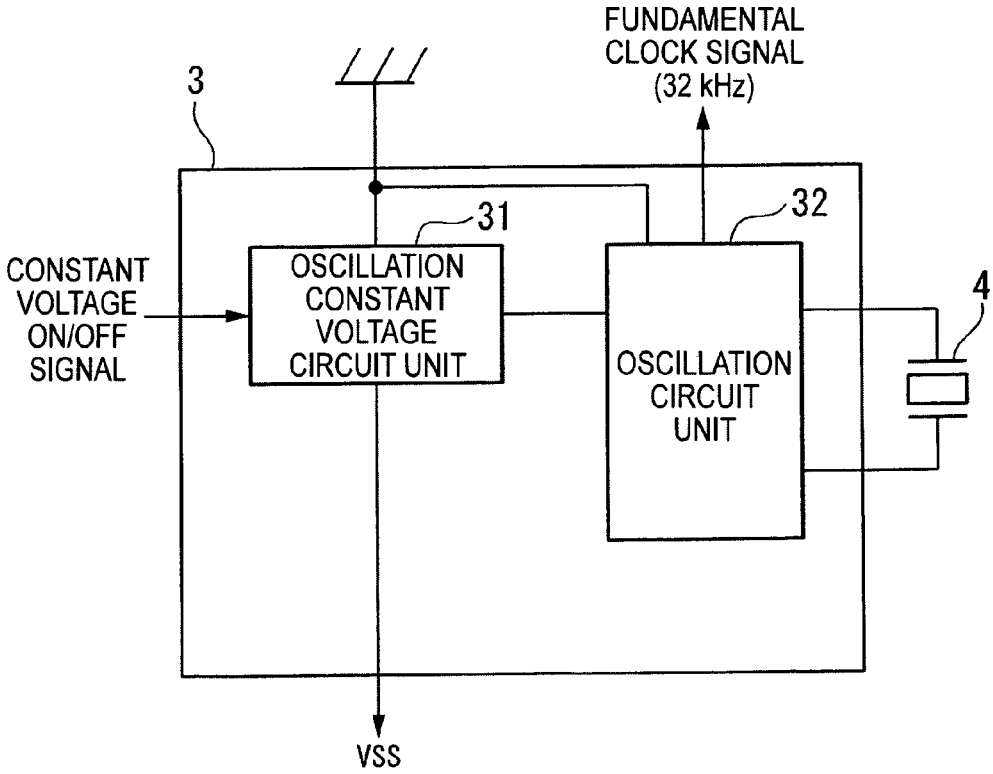
FIG. 3 is a simplified block diagram showing an example of an oscillation control unit in the first embodiment.

FIG. 3 is a simplified block diagram showing an example of the oscillation control unit 3 in the first embodiment.

In FIG. 3, the oscillation control unit 3 includes an oscillation constant voltage circuit unit 31 and an oscillation circuit unit 32.

The oscillation constant voltage circuit unit (constant voltage circuit unit) 31 generates a constant voltage used for oscillating the fundamental clock signal from a power supply voltage (potential difference) between the power supply line VDD and the power supply line VSS. The oscillation constant voltage circuit unit 31 is a regulator circuit that generates a constant voltage that is lower than the output voltage of the secondary battery 2, for example. The oscillation constant voltage circuit unit 31 supplies the generated constant voltage to the oscillation circuit unit 32.

Moreover, the oscillation constant voltage circuit unit 31 stops the operation of generating a constant voltage and stops supplying the constant voltage to the oscillation circuit unit 32 based on the constant voltage ON/OFF signal supplied from the power consumption control unit 10. That is, the oscillation constant voltage circuit unit 31 stops its operation when the constant voltage ON/OFF signal is in the H state (power saving state). Moreover, the oscillation constant voltage circuit unit 31 performs the operation of generating a constant voltage when the constant voltage ON/OFF signal is in the L state (normal operation state).

The oscillation circuit unit 32 is connected to the quartz oscillator 4 so as to oscillate the quartz oscillator 4 to thereby generate a fundamental clock signal (for example, a signal of 32.768 kHz). The oscillation circuit unit 32 supplies the generated fundamental clock signal to the timepiece control unit 5. In addition, the oscillation circuit unit 32 is operated by the constant voltage supplied from the oscillation constant voltage circuit unit 31. Thus, when the oscillation constant voltage circuit unit 31 stops its operation, the oscillation circuit unit 32 also stops its operation.

Next, the operation of the first embodiment will be described.

Figure 4:
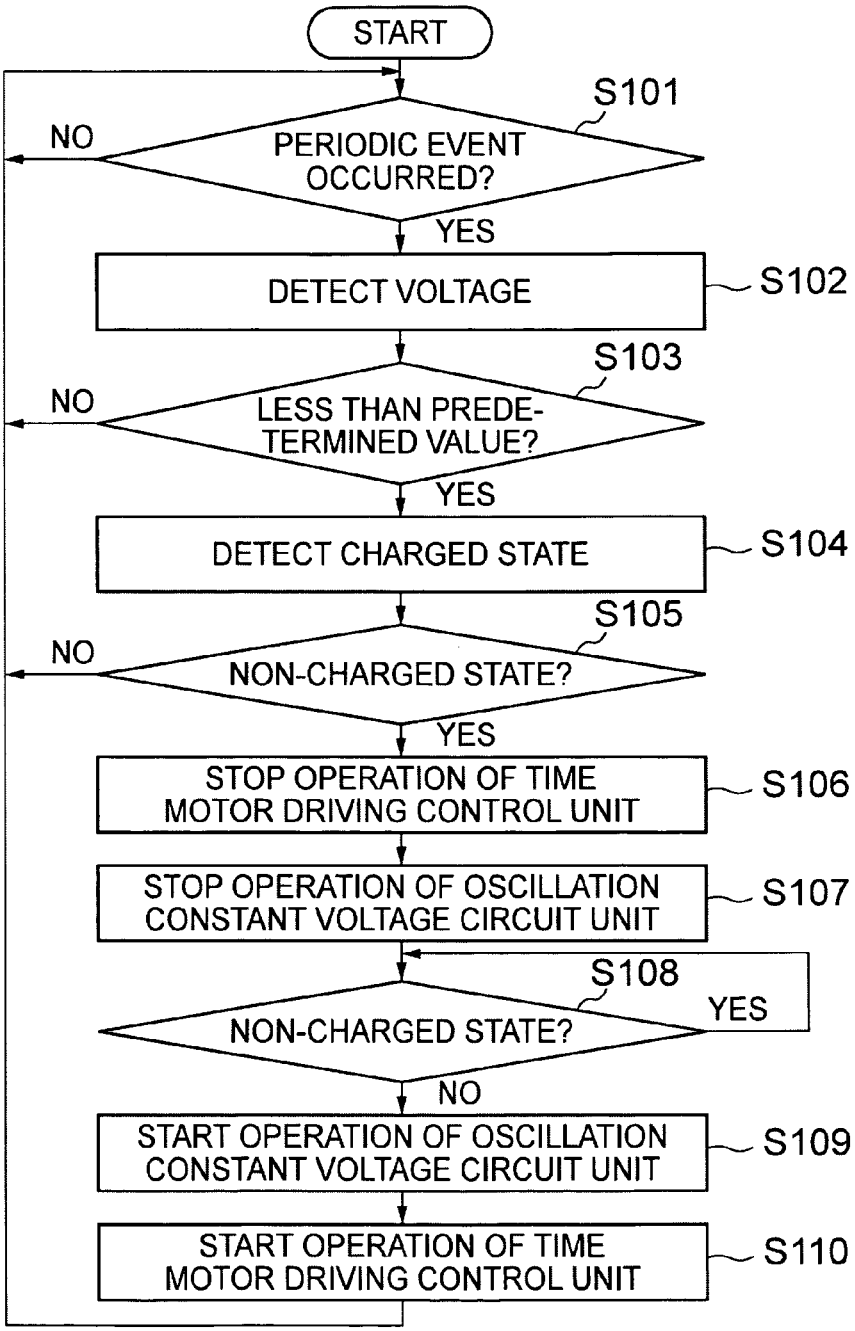
FIG. 4 is a flowchart showing a power consumption control process in the first embodiment.

FIG. 4 is a flowchart showing a power consumption control operation in the first embodiment.

Hereinafter, a process of controlling power consumption of the timepiece 100 will be described with reference to the flowchart shown in FIG. 4.

In the process of controlling power consumption of the timepiece 100, first, the power consumption control unit 10 determines whether a periodic event has occurred (step S101). Here, periodic event means an event that occurs every predetermined time interval (for example, 1 second). In step S101, when the periodic event has occurred, the flow proceeds to step S102. When the periodic event has not occurred, the process of step S101 is repeated.

Subsequently, in step S102, the power consumption control unit 10 causes the battery voltage detection unit 8 to detect the output voltage of the secondary battery 2. That is, the power consumption control unit 10 outputs the detection sampling signal to the battery voltage detection unit 8 every predetermined time interval (period). The battery voltage detection unit 8 detects the output voltage of the secondary battery 2 in response to the detection sampling signal supplied from the power consumption control unit 10. When a state where the output voltage of the secondary battery 2 is less than the predetermined threshold value is detected, the battery voltage detection unit 8 outputs the power saving-mode detection signal to the power consumption control unit 10 as the detection result.

Subsequently, the power consumption control unit 10 determines whether the output voltage of the secondary battery 2 is less than a prescribed value (predetermined threshold value) (step S103). In step S103, the power consumption control unit 10 determines whether the output voltage of the secondary battery 2 is less than the prescribed value (predetermined threshold value) based on the power saving-mode detection signal which is the detection result by the battery voltage detection unit 8. Here, the power saving-mode detection signal is in the H state, for example, when the output voltage of the secondary battery 2 is less than the predetermined threshold value, and is in the L state, for example, when the output voltage of the secondary battery 2 is not less than the predetermined threshold value. Thus, when the power saving-mode detection signal is in the H state (the output voltage of the secondary battery 2 is less than the predetermined threshold value), the flow proceeds to step S104. Moreover, when the power saving-mode detection signal is in the L state (the output voltage of the secondary battery 2 is not less than the predetermined threshold value), the flow proceeds to step S101.

Subsequently, in step S104, the power consumption control unit 10 detects the charging state of the secondary battery 2. That is, the power consumption control unit 10 detects the charging state of the secondary battery 2 detected by the charging detection and backflow prevention unit 9 based on the charging detection signal. Here, the charging detection and backflow prevention unit 9 detects the non-charging state indicating a state where the output voltage of the photovoltaic cell 1 is not greater than the output voltage of the secondary battery 2 and outputs the charging detection signal to the power consumption control unit 10 as the detection result. The charging detection signal is in the L state, for example, when the secondary battery 2 is in the non-charging state. Moreover, the charging detection signal is in the H state, for example, when the secondary battery 2 is in a charging state indicating a state where the output voltage of the photovoltaic cell 1 is greater than the output voltage of the secondary battery 2.

Subsequently, the power consumption control unit 10 determines whether the secondary battery 2 is in the non-charging state (step S105). That is, the power consumption control unit 10 determines whether the secondary battery 2 is in the non-charging state indicating a state where the output voltage of the photovoltaic cell 1 is not greater than the output voltage (output potential difference) of the secondary battery 2 based on the detection result (charging detection signal) supplied from the charging detection and backflow prevention unit 9. In step S105, when the secondary battery 2 is determined to be in the non-charging state, the flow proceeds to step S106. Moreover, when the secondary battery 2 is determined not to be in the non-charging state (to be in the charging state), the flow proceeds to step S101.

Subsequently, in step S106, the power consumption control unit 10 causes the timepiece control unit 5 to stop driving the time motor 6. That is, the power consumption control unit 10 supplies a power saving-mode signal (H state) to the timepiece control unit 5. The timepiece control unit 5 stops the driving of the time motor 6 based on the power saving-mode signal (H state) supplied from the power consumption control unit 10. In this way, the power consumed to drive the time motor 6 is reduced.

Subsequently, the power consumption control unit 10 causes the oscillation control unit 3 to stop oscillating the fundamental clock signal (step S107). That is, the power consumption control unit 10 supplies the constant voltage ON/OFF signal (H state) to the oscillation control unit 3. The oscillation constant voltage circuit unit 31 of the oscillation control unit 3 stops the operation of generating a constant voltage based on the constant voltage ON/OFF signal (H state) supplied from the power consumption control unit 10. In this way, the operation of oscillating the fundamental clock signal in the oscillation circuit unit 32 stops, and the power consumed to oscillate the fundamental clock signal is reduced.

Through the above processes, the power consumption control unit 10 causes the timepiece 100 to transition from the normal operation state to the power saving state. When the timepiece 100 is caused to transition to the power saving state, the power consumption control unit 10 causes the timepiece control unit 5 to stop the clock operation (for example, the hand movement operation by the time motor 6) and then causes the oscillation control unit 3 to stop oscillating the fundamental clock signal.

Subsequently, the power consumption control unit 10 determines whether the secondary battery 2 is in the non-charging state (step S108). That is, the power consumption control unit 10 determines whether the secondary battery 2 is in the non-charging state indicating that the output voltage of the photovoltaic cell 1 is not greater than the output voltage of the secondary battery 2 based on the detection result (charging detection signal) supplied from the charging detection and backflow prevention unit 9. In step S108, when the secondary battery 2 is determined not to be in the non-charging state (to be in the charging state), the flow proceeds to step S109. Moreover, when the secondary battery 2 is determined to be in the non-charging state, the flow proceeds to step S108. That is, the power consumption control unit 10 maintains the power saving state until it is determined that the secondary battery 2 is not in the non-charging state (to be in the charging state).

Subsequently, in step S109, the power consumption control unit 10 causes the oscillation control unit 3 to start oscillating the fundamental clock signal. That is, the power consumption control unit 10 supplies the constant voltage ON/OFF signal (L state) to the oscillation control unit 3. The oscillation constant voltage circuit unit 31 of the oscillation control unit 3 starts the operation of generating a constant voltage based on the constant voltage ON/OFF signal (L state) supplied from the power consumption control unit 10. In this way, the operation of oscillating the fundamental clock signal in the oscillation circuit unit 32 starts.

Subsequently, the power consumption control unit 10 causes the timepiece control unit 5 to start driving the time motor 6 (step S110). That is, in step S110, the power consumption control unit 10 supplies the power saving-mode signal (L state) to the timepiece control unit 5. The timepiece control unit 5 starts driving the time motor 6 based on the power saving-mode signal (L state) supplied from the power consumption control unit 10.

Through the above processes, the power consumption control unit 10 causes the timepiece 100 to transition from the power saving state to the normal operation state. In addition, when the timepiece 100 is caused to transition from the power saving state to the normal operation state (the clock operation state), the power consumption control unit 10 causes the oscillation control unit 3 to start oscillating the fundamental clock signal and then causes the timepiece control unit 5 to start the clock operation (for example, the hand movement operation by the time motor 6).

Subsequently, the flow returns to step S101, and the processes of steps S101 to S110 are repeated.

Figure 5:
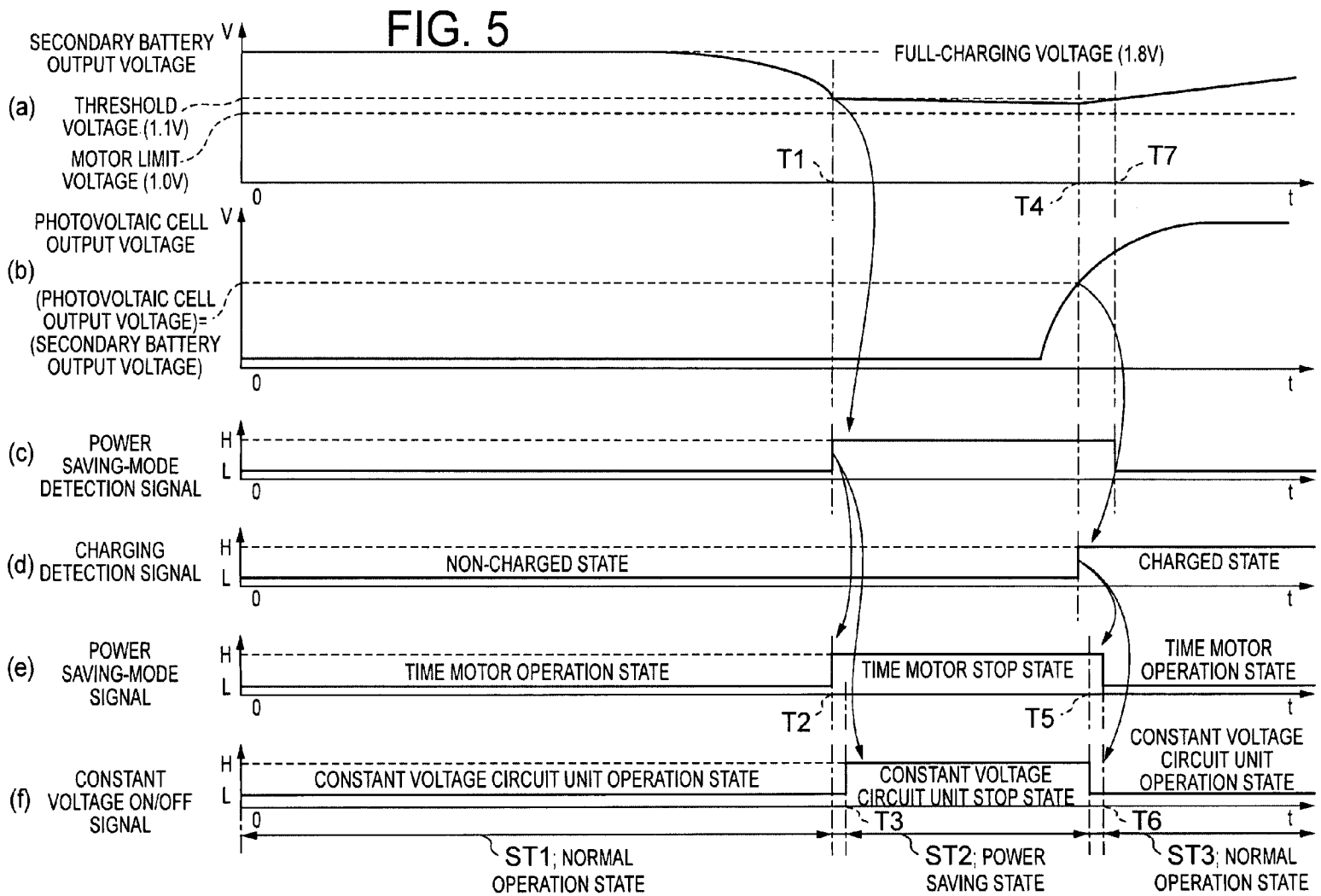
FIG. 5 ((*a*) to (*f*)) is a timing chart showing an example of a power consumption control operation in the first embodiment.

FIG. 5 ((*a*) to (*f*)) is a timing chart showing an example of a power consumption control operation in the first embodiment.

Subsequently, the state transition between the power saving state and the normal operation state of the timepiece 100 will be described with reference to the timing chart shown in FIG. 5 ((*a*) to (*f*)).

Portion (a) of FIG. 5 shows the output voltage of the secondary battery 2. Portion (b) of FIG. 5 shows the output voltage of the photovoltaic cell 1. In portions (a) and (b) of FIG. 5, the horizontal axis represents time, and the vertical axis represents a voltage.

Portion (c) of FIG. 5 shows the state of the power saving-mode detection signal output by the battery voltage detection unit 8. Portion (d) of FIG. 5 shows the state of the charging detection signal output by the charging detection and back-flow prevention unit 9. Portions (e) and (f) of FIG. 5 show the states of the power saving-mode signal and constant voltage ON/OFF signal output by the power consumption control unit 10, respectively. In portions (c) to (f) of FIG. 5, the horizontal axis represents time, and the vertical axis represents a logic state (L or H state).

In FIG. 5 ((*a*) to (*f*)), the time on the horizontal axis is of the same time scale. Moreover, in this example, the full charge voltage of the secondary battery 2 is 1.8 V, for example, and the operation limit voltage of the time motor 6 is 1.0 V, for example.

In FIG. 5 ((*a*) to (*f*)), a period ST1 represents the normal operation state, a period ST2 represents the power saving state, and a period ST3 represents the normal operation state.

In the period from 0 to T1, the output voltage of the secondary battery 2 in portion (a) of FIG. 5 is sufficiently high, and the output voltage of the photovoltaic cell 1 in portion (b) of FIG. 5 is low. Thus, the power saving-mode detection signal in portion (c) of FIG. 5 is in the L state (the output voltage of the secondary battery 2 is not less than the predetermined threshold value), and the charging detection signal in portion (d) of FIG. 5 is in the L state (non-charging state). Moreover, the power saving-mode signal in portion (e) of FIG. 5 is in the L state (the time motor 6 is in the operating state), and the constant voltage ON/OFF signal in portion (f) of FIG. 5 is in the L state (the oscillation constant voltage circuit unit 31 is in the operating state). In this state, the output voltage of the secondary battery 2 in portion (a) of FIG. 5 decreases gradually.

At time T1, when the output voltage of the secondary battery 2 in portion (a) of FIG. 5 is less than the predetermined threshold value, the power saving-mode detection signal in portion (c) of FIG. 5 transitions to the H state. Moreover, at time T1, since the charging detection signal in portion (d) of FIG. 5 is in the L state (non-charging state), the power consumption control unit 10 performs a process of causing the timepiece 100 to transition to the power saving state. That is, the power consumption control unit 10 puts the power saving-mode signal in portion (e) of FIG. 5 into the H state (the time motor 6 is in the stopped state) and causes the timepiece control unit 5 to stop driving the time motor 6 (time T2). Subsequently, the power consumption control unit 10 puts the constant voltage ON/OFF signal in portion (f) of FIG. 5 into the H state (the oscillation constant voltage circuit unit 31 is in the stopped state) and causes the oscillation control unit 3 to stop oscillating the fundamental clock signal (time T3). In this way, the timepiece 100 transitions to the power saving state.

In the power saving state, when the photovoltaic cell 1 is exposed to light or the like to start generating electricity, the output voltage of the photovoltaic cell 1 in portion (b) of FIG. 5 increases gradually. At time T4, when the output voltage of the photovoltaic cell 1 in portion (b) of FIG. 5 exceeds the output voltage of the secondary battery 2 in portion (a) of FIG. 5, the charging detection signal in portion (d) of FIG. 5 transitions to the H state (charging state). In this way, the power consumption control unit 10 performs the process of causing the timepiece 100 to transition from the power saving state to the normal operation state. That is, first, the power consumption control unit 10 puts the constant voltage ON/OFF signal in portion (f) of FIG. 5 into the L state (the oscillation constant voltage circuit unit 31 is in the operating state) and causes the oscillation control unit 3 to start oscillating the fundamental clock signal (time T5). Subsequently, the power consumption control unit 10 puts the power saving-mode signal in portion (e) of FIG. 5 into the L state (the time motor 6 is in the operating state) and causes the timepiece control unit 5 to start driving the time motor 6 (time T6). In this way, the timepiece 100 transitions to the normal operation state.

Moreover, the output voltage of the secondary battery 2 in portion (a) of FIG. 5 increases gradually by being charged by the output voltage of the photovoltaic cell 1. When the output voltage of the secondary battery 2 in portion (a) of FIG. 5 is not less than the predetermined threshold value, the power saving-mode detection signal in portion (c) of FIG. 5 transitions to the L state (time T7).

Although an example in which at time T1, the battery voltage detection unit 8 detects the state where the output voltage (output potential difference) of the secondary battery 2 is less than the threshold value has been described, the battery voltage detection unit 8 may detect a state where the output voltage is not greater than the threshold value. In this case, in step S103 of FIG. 4, the power consumption control unit 10 determines whether the output voltage of the secondary battery 2 is not greater than a prescribed value (predetermined threshold value) based on the power saving-mode detection signal which is the detection result by the battery voltage detection unit 8. Moreover, at time T7, when the output voltage of the secondary battery 2 in portion (a) of FIG. 5 exceeds the predetermined threshold value, the power saving-mode detection signal in portion (c) of FIG. 5 transitions to the L state.

As described above, in the timepiece 100, when the output voltage of the secondary battery 2 is less than the predetermined threshold value, and the secondary battery 2 is in the non-charging state indicating a state where the output voltage of the photovoltaic cell 1 is not greater than the output voltage of the secondary battery 2, the power consumption control unit 10 causes the timepiece 100 to transition to the power saving state in which the clock operation of measuring time (the hand movement operation by the time motor 6) is stopped. In this way, it is possible to reduce the power consumption of the timepiece 100 in the power saving state and to reduce the power consumption of the secondary battery 2. That is, it is possible to prevent the secondary battery 2 from entering into the over-discharged state.

Moreover, in the timepiece 100, it is not necessary to control the operation of charging the secondary battery 2 with the photovoltaic cell 1 and the clock operation of measuring time (the hand movement operation by the time motor 6) in a time-division multiplexed manner.

Thus, in the timepiece 100, it is possible to perform the clock operation (the hand movement operation by the time motor 6) immediately when the photovoltaic cell 1 starts generating electricity without performing time-division multiplexing control.

According to the embodiment of the present invention, the timepiece (timepiece device) 100 includes: the photovoltaic cell (primary power supply unit) 1 that generates an electromotive force; the secondary battery (secondary power supply unit) 2 that is charged by the electromotive force of the photovoltaic cell 1; and the power consumption control unit 10 that causes the timepiece 100 to transition to the power saving state in which the clock operation of measuring time (the hand movement operation by the time motor 6) is stopped when the output potential difference of the secondary battery 2 is not greater than the predetermined threshold value, and the secondary battery 2 is in the non-charging state indicating a state where the output potential difference of the photovoltaic cell 1 is not greater than the output potential difference of the secondary battery 2.

With this configuration, in the timepiece 100, it is possible to perform the clock operation (the hand movement operation by the time motor 6) immediately when the photovoltaic cell 1 starts generating electricity without performing time-division multiplexing control.

Moreover, when the timepiece 100 is in the power saving state, the power consumption control unit 10 determines whether the secondary battery 2 is in the non-charging state, and causes the timepiece 100 to transition from the power saving state to the normal operation state (the clock operation state) where the temperature measuring portion is performed when the secondary battery 2 is not in the non-charging state.

That is, when the output potential difference of the photovoltaic cell 1 is greater than the output potential difference of the secondary battery 2 (the secondary battery 2 is charged), the timepiece 100 transitions from the power saving state to the normal operation state (the clock operation state). With this configuration, the timepiece 100 can perform the clock operation (the hand movement operation by the time motor 6) immediately when the photovoltaic cell 1 starts generating electricity.

Moreover, the predetermined threshold value is a value greater by a predetermined potential difference (10%) than a lower-limit potential difference in which the clock operation is possible.

In this way, the timepiece 100 transitions to the power saving state before the output potential difference of the secondary battery 2 reaches the lower-limit potential difference in which the clock operation is possible. Thus, it is possible to prevent the secondary battery 2 from entering into the over-discharged state.

Moreover, the timepiece (timepiece device) 100 includes the timepiece control unit 5 that controls the clock operation. When the timepiece 100 is caused to transition to the power saving state, the power consumption control unit 10 causes the timepiece control unit 5 to stop the clock operation (the hand movement operation by the time motor 6).

With this configuration, since the clock operation (the hand movement operation by the time motor 6) which is a heavy load operation is stopped, it is possible to further reduce the power consumption of the timepiece 100 in the power saving state. Thus, it is possible to prevent the secondary battery 2 from entering into the over-discharged state.

Moreover, the timepiece (timepiece device) 100 includes the oscillation control unit 3 that oscillates and generates the fundamental clock signal used for measuring time. When the timepiece 100 is caused to transition to the power saving state, the power consumption control unit 10 causes the oscillation control unit 3 to stop oscillating the fundamental clock signal.

With this configuration, it is possible to further reduce the power consumption of the timepiece 100 in the power saving state. Thus, the effect of preventing the secondary battery 2 from entering into the over-discharged state is improved.

Moreover, the oscillation control unit 3 includes the oscillation constant voltage circuit unit (constant voltage circuit unit) 31 and stops the operation of the oscillation constant voltage circuit unit 31 when the timepiece 100 is in the power saving state.

With this configuration, it is possible to stop a circuit that constantly consumes power, such as a reference voltage generation unit (not shown) in the oscillation constant voltage circuit unit 31. Thus, it is possible to further reduce the power consumption of the timepiece 100 in the power saving state. Thus, it is possible to prevent the secondary battery 2 from entering into the over-discharged state.

Moreover, when the timepiece 100 is caused to transition to the power saving state, the power consumption control unit 10 causes the timepiece control unit 5 to stop the clock operation (the hand movement operation by the time motor 6) and then causes the oscillation control unit 3 to stop oscillating the fundamental clock signal. Moreover, when the timepiece 100 is caused to transition from the power saving state to the normal operation state (the clock operation state), the power consumption control unit 10 causes the oscillation control unit 3 to start oscillating the fundamental clock signal and then causes the timepiece control unit 5 to start the clock operation (the hand movement operation by the time motor 6).

With this configuration, since the power consumption control unit 10 stops the hand movement operation by the time motor 6 and then stops the oscillating of the fundamental clock signal, it is possible to prevent a malfunction which can occur when the oscillating of the fundamental clock signal is stopped. Moreover, since the power consumption control unit 10 stops the oscillating of the fundamental clock signal and starts the hand movement operation by the time motor 6 after the oscillating is stabilized, it is possible to prevent a malfunction which can occur when the hand movement operation by the time motor 6 is started. Thus, the timepiece 100 can stably transition from the normal operation state to the power saving state, or from the power saving state to the normal operation state.

Moreover, the clock operation includes an operation of driving the time motor 6 that moves the hands of the timepiece (timepiece device) 100 that displays time. The predetermined threshold value is a value greater by a predetermined potential difference than the lower-limit potential difference in which the time motor 6 can be driven, and the timepiece control unit 5 stops driving the time motor 6 when the timepiece 100 transitions to the power saving state.

With this configuration, since the hand movement operation by the time motor 6, which is a heavy load operation, is stopped before the output potential difference of the secondary battery 2 reaches the lower-limit potential difference in which the time motor 6 can be driven, it is possible to further reduce the power consumption of the timepiece 100 in the power saving state. Thus, it is possible to prevent the secondary battery 2 from entering into the over-discharged state.

Moreover, the timepiece (timepiece device) 100 includes the battery voltage detection unit (output detection unit) 8 that detects a state where the output potential difference of the secondary battery (secondary power supply unit) 2 is not greater than a predetermined threshold value, and the charging detection and backflow prevention unit (charging detection unit) 9 that detects a non-charging state. The power consumption control unit 10 determines whether the output potential difference of the secondary battery 2 is less than a predetermined threshold value based on the detection result by the battery voltage detection unit 8 and determines whether the secondary battery 2 is in the non-charging state based on the detection result by the charging detection and backflow prevention unit 9.

With this configuration, the power consumption control unit 10 can effectively determine whether the output potential difference of the secondary battery (the secondary power supply unit) 2 is not greater than the predetermined threshold value and whether the secondary battery 2 is in the non-charging state.

The present invention is not limited to the embodiment described above, but can be modified within a range not departing from the spirit of the present invention. In the above embodiment, although an example where the photovoltaic cell 1 is used as the primary power supply unit has been described, another primary power supply unit may be used. For example, an electricity generating device that converts kinetic energy into electric energy through electromagnetic induction may be used as the primary power supply unit.

Moreover, in the above embodiment, although an example where the secondary battery 2 is used as the secondary power supply unit has been described, a capacitor may be used.

Moreover, in the above embodiment, although the power saving state has been described to be a state where the timepiece control unit 5 stops the clock operation (the hand movement operation by the time motor 6), and the oscillation control unit 3 stops outputting the fundamental clock signal, any one of the two operations may be stopped.

Moreover, in the above embodiment, although the timepiece 100 has been described to be an analog display timepiece, the timepiece 100 may be applied to a digital display timepiece and may be applied to a timepiece that has both analog and digital displays. When a digital display is present, the clock operation to be stopped is not limited to the hand movement operation by the time motor 6 but may be an operation of displaying a digital time presentation on a liquid crystal display or the like.

Moreover, in the above embodiment, although the power supply line VDD is described to be at the potential of VDD-earth, which represents the reference potential of the timepiece 100, the power supply line VSS may be at the potential of VSS-earth, which represents the reference potential of the timepiece 100.

Moreover, in the above embodiment, the predetermined threshold value has been described to be 10% greater than the lower-limit voltage in which the time motor 6 can be driven, the predetermined threshold value is not limited to this. The predetermined threshold value may be another value if it is defined between the output voltage of the secondary battery 2 in the fully charging state and the lower-limit voltage in which the clock operation is possible. For example, the predetermined threshold value may be the output voltage of the secondary battery 2, attained when the timepiece 100 continuously operates for a predetermined time (period) from the fully charging state of the secondary battery 2. Moreover, the predetermined threshold value may be determined based on the time (period) to attain the lower-limit voltage in which the time motor 6 can be driven after the timepiece 100 transitions to the power saving state.

Second Embodiment

Next, an electronic device (for example, a timepiece device) of a second embodiment will be described with reference to the drawings.

Figure 6:
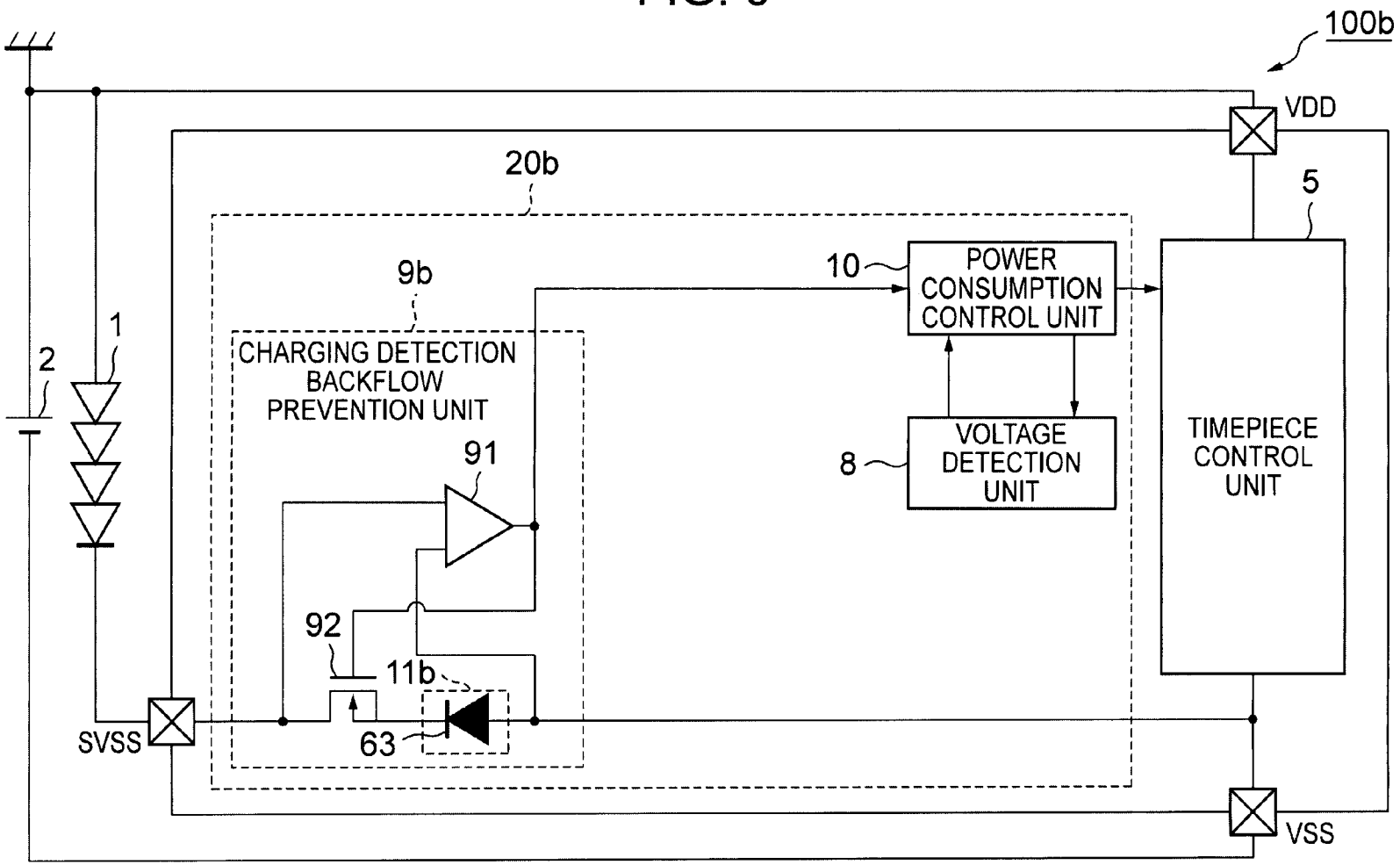
FIG. 6 is a simplified block diagram showing a timepiece device according to a second embodiment.

FIG. 6 is a simplified block diagram showing a timepiece device 100*b* according to the second embodiment.

The timepiece device (hereinafter referred to as a timepiece) 100*b* is an analog display timepiece, for example. In FIG. 6, the timepiece 100*b* includes a photovoltaic cell 1, a secondary battery 2, a timepiece control unit 5, and a power consumption control device 20*b*.

The power consumption control device 20*b* controls the power of the timepiece 100*b*. The power consumption control device 20*b* outputs a power saving-mode signal to the timepiece control unit 5 based on the state of the photovoltaic cell 1 and the state of the secondary battery 2. Moreover, the power consumption control device 20*b* includes a power consumption control unit 10, a voltage detection unit 8, and a charging detection and backflow prevention unit (charging detection unit) 9*b*.

The photovoltaic cell (primary power supply unit) 1 has a positive terminal connected to a power supply line VDD and a negative terminal connected to a power supply line SVSS. Moreover, the negative terminal of the photovoltaic cell 1 is connected to the charging detection and backflow prevention unit 9*b*. The photovoltaic cell 1 generates an electromotive force upon exposure to light. The photovoltaic cell 1 charges the secondary battery 2 through the charging detection and backflow prevention unit 9*b*. Moreover, the photovoltaic cell 1 supplies electricity to respective units of the timepiece 100*b* through the power supply line VDD. Here, the power supply line VDD is the VDD-earth line, which represents the reference potential of the timepiece 100*b*.

The secondary battery (secondary power supply unit) 2 has a positive terminal connected to the power supply line VDD and a negative terminal connected to the power supply line VSS. Moreover, the negative terminal of the secondary battery 2 is connected to the charging detection and backflow prevention unit 9*b*. The secondary battery 2 is charged by the electromotive force of the photovoltaic cell 1 through the charging detection and backflow prevention unit 9*b*. Moreover, the secondary battery 2 supplies electricity to the respective units of the timepiece 100*b* through the power supply line VDD.

The timepiece control unit 5 controls a clock operation of measuring time. The clock operation includes an operation of driving a time motor that moves the hands of the timepiece 100*b* that displays time. The timepiece control unit 5 stops or starts the driving of the time motor based on a power saving-mode signal supplied from the power consumption control unit 10. Here, for example, the timepiece control unit 5 stops driving the time motor when the power saving-mode signal is in the H state. Moreover, for example, the timepiece control unit 5 drives the time motor when the power saving-mode signal is in the L (low) state.

The power consumption control unit 10 determines whether the output voltage (output potential difference) of the secondary battery 2 is less than the predetermined threshold value described above based on the detection result by the battery voltage detection unit 8. Moreover, the power consumption control unit 10 determines whether the secondary battery 2 is in the non-charging state indicating a state where the output voltage (output potential difference) of the photovoltaic cell 1 is not greater than the output voltage (output potential difference) of the secondary battery 2 based on the detection result (charging detection signal) by the charging detection and backflow prevention unit 9*b*. When the secondary battery 2 is in the non-charging state, and the output voltage of the secondary battery 2 is less than the predetermined threshold value, the power consumption control unit 10 outputs the H state to the power saving-mode signal. In this way, the power consumption control unit 10 causes the timepiece control unit 5 to transition to a power saving state where the clock operation of measuring time is stopped. That is, when the secondary battery 2 is in the non-charging state, the power consumption control unit 10 decreases the power consumption by a load unit (in this example, the timepiece control unit 5 and the time motor).

Moreover, when the timepiece 100*b* is in the power saving state, the power consumption control unit 10 determines whether the secondary battery 2 is in the non-charging state based on the detection result (charging detection signal) by the charging detection and backflow prevention unit 9*b*. When the secondary battery 2 is not in the non-charging state, the power consumption control unit 10 outputs the L state to the power saving-mode signal. In this way, the power consumption control unit 10 causes the timepiece control unit 5 to transition from the power saving state to the normal operation state (clock operation state) where the clock operation is performed. Here, the normal operation state (the clock operation state) means a state where the timepiece control unit 5 drives the time motor. That is, when the secondary battery 2 is not in the non-charging state, the power consumption control unit 10 releases the power saving state of the timepiece control unit 5.

The power consumption control unit 10 supplies the detection sampling signal to the battery voltage detection unit 8 as a trigger signal for detecting the output voltage of the secondary battery 2.

The battery voltage detection unit (detection unit) 8 detects whether the output voltage of the secondary battery 2 is not greater than a predetermined threshold value in response to a detection sampling signal supplied from the power consumption control unit 10. The battery voltage detection unit 8 outputs a low-voltage detection signal to the power consumption control unit 10 as the detection result when the secondary battery 2 is detected to be in a state (low-voltage state) where the output voltage thereof is not greater than a predetermined threshold value. Specifically, the low-voltage detection signal is in the H state, for example, when the output voltage of the secondary battery 2 is not greater than the predetermined threshold value, and is in the L state, for example, when the output voltage of the secondary battery 2 is greater than the predetermined threshold value.

Moreover, the predetermined threshold value is a value greater by a predetermined voltage than a lower-limit voltage in which the time motor can be driven. Moreover, the predetermined threshold value is greater than the output voltage of the secondary battery 2 in the over-discharged state. Here, for example, the over-discharged state means a state where the secondary battery 2 is consumed up to an operation limit voltage or less of the time motor so that the secondary battery 2 does not restore the operational voltage of the time motor immediately even when the secondary battery 2 is charged by the electromotive force of the photovoltaic cell 1.

The charging detection and backflow prevention unit 9*b* detects a non-charging state indicating a state where the output voltage of the photovoltaic cell 1 is not greater than the output voltage of the secondary battery 2. The charging detection and backflow prevention unit 9*b* outputs a charging detection signal to the power consumption control unit 10 as the detection result when the non-charging state is detected. Specifically, the charging detection signal is in the L state when the secondary battery 2 is in the non-charging state. Moreover, the charging detection signal is in the H state when the secondary battery 2 is in a charging state indicating a state where the output voltage of the photovoltaic cell 1 is greater than the output voltage of the secondary battery 2.

Moreover, when the secondary battery 2 is in the non-charging state, the charging detection and backflow prevention unit 9*b* cuts the connection between a power supply line SVSS connected to the negative terminal of the photovoltaic cell 1 and the power supply line VSS connected to the negative terminal of the secondary battery 2. With this configuration, the charging detection and backflow prevention unit 9*b* prevents current from back-flowing from the secondary battery 2 to the photovoltaic cell 1.

Moreover, the charging detection and backflow prevention unit 9*b* includes a comparator 91, an NMOS switch 92, and a chattering prevention unit 11*b*. Moreover, an oscillation prevention unit (not shown) includes the chattering prevention unit 11*b*.

The comparator 91 has an input terminal of which one end is connected to the power supply line SVSS connected to the negative terminal of the photovoltaic cell 1 and of which the other end is connected to the power supply line VSS connected to the negative terminal of the secondary battery 2. Moreover, the output of the comparator 91 is the charging detection signal. The comparator 91 compares the output voltage of the photovoltaic cell 1 with the output voltage of the secondary battery 2 and outputs a signal (charging detection signal) indicating the non-charging state when the secondary battery 2 is in the non-charging state where the output voltage of the photovoltaic cell 1 is not greater than the output voltage of the secondary battery 2. When the output voltage of the photovoltaic cell 1 is not greater than the output voltage of the secondary battery 2 (the secondary battery 2 is in the non-charging state), the comparator 91 outputs the L state to the power consumption control unit 10 as the charging detection signal. Moreover, when the output voltage of the photovoltaic cell 1 is greater than the output voltage of the secondary battery 2 (the secondary battery 2 is in the charging state), the comparator 91 outputs the H state to the power consumption control unit 10 as the charging detection signal.

The NMOS switch (switching unit) 92 is a switch such as an NMOS transistor (N-channel Metal Oxide Silicon Field-Effect Transistor), for example. The NMOS switch 92 has a source terminal connected to the cathode terminal of a diode element 63, a drain terminal connected to the power supply line SVSS, and a gate terminal connected to the output terminal of the comparator 91. The cathode terminal of the diode element 63 is connected to the power supply line VSS. The NMOS switch 92 cuts the connection between the power supply line VSS and the power supply line SVSS when the output of the comparator 91 is in the L state (non-charging state). In this way, the NMOS switch 92 prevents current from back-flowing from the secondary battery 2 to the photovoltaic cell 1. Moreover, the NMOS switch 92 connects the power supply line VSS and the power supply line SVSS when the output of the comparator 91 is in the H state (charging state). In this way, the electromotive force of the photovoltaic cell 1 is charged to the secondary battery 2.

The chattering prevention unit 11*b* prevents chattering occurring in the output of the comparator 91 during the comparison by the comparator 91. The chattering is a phenomenon in which when the output voltage of the photovoltaic cell 1 is near the output voltage of the secondary battery 2, since the two input potentials being compared have values close to each other, the output of the comparator 91 oscillates. In the present embodiment, the chattering prevention unit 11*b* is the diode element 63.

The diode element 63 has an anode terminal connected to the power supply line VSS and the cathode terminal connected to the source terminal of the NMOS switch 92. That is, the diode element 63 is disposed in series to the NMOS switch 92 so that when the secondary battery 2 is not in the non-charging state (the NMOS switch 92 is in the conduction state), a forward bias is applied between the negative terminal of the secondary battery 2 and the negative terminal of the photovoltaic cell 1. Moreover, the diode element 63 generates a predetermined prescribed potential difference between the two input terminals (the negative terminal of the secondary battery 2 and the negative terminal of the photovoltaic cell 1) subjected to the comparison in the comparator 91. Here, the predetermined prescribed potential difference is a forward voltage drop (VF) of the diode element 63. Moreover, the predetermined prescribed potential difference is appropriately set in accordance with a potential difference in which the output of the comparator 91 chatters. Here, the predetermined prescribed potential difference is 0.3 V (volt), for example.

Next, the operation of the present embodiment will be described.

First, an operation of the chattering prevention unit (the diode element 63) 11*b* to prevent chattering will be described.

In FIG. 6, when the secondary battery 2 is in the charging state where the output voltage of the photovoltaic cell 1 is greater than the output voltage of the secondary battery 2, the comparator 91 outputs the H state to the charging detection signal. In this way, the NMOS switch 92 enters into the conduction state, and current flows from the negative terminal (the power supply line VSS) of the secondary battery 2 to the negative terminal (the power supply line SVSS) of the photovoltaic cell 1 through the diode element 63 and the NMOS switch 92. When current flows through the diode element 63, a potential difference due to the forward voltage drop (VF) is generated across both ends thereof. Thus, a potential difference corresponding to the forward voltage drop (VF) of the diode element 63 is generated between the two input potentials (the potential of the power supply line VSS and the potential of the power supply line SVSS) compared by the comparator 91.

Although chattering occurs in the output of the comparator 91 when the two input potentials to be compared have values close to each other, since a potential difference corresponding to the forward voltage drop (VF) of the diode element 63 is generated between the two input potentials being compared, the occurrence of chattering can be prevented.

That is, the chattering prevention unit (the diode element 63) 11*b* can eliminate chattering occurring in the output signal (the charging detection signal) of the charging detection and backflow prevention unit 9*b* when the secondary battery 2 transitions from the charging state to the non-charging state.

Next, a power consumption control process in the timepiece 100*b* and the power consumption control device 20*b* will be described with reference to the flowchart shown in FIG. 7.

Figure 7:
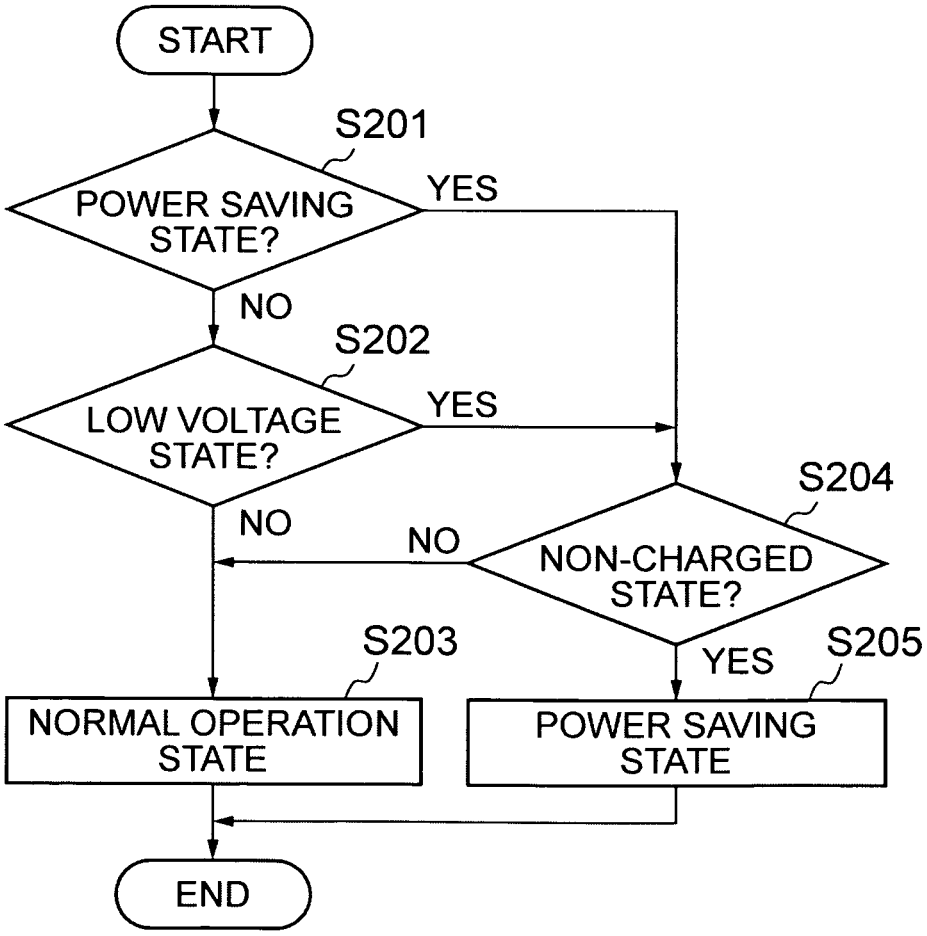
FIG. 7 is a flowchart showing an operation of the timepiece device in the second embodiment.

FIG. 7 is a flowchart showing the power consumption control process in the present embodiment.

In the power consumption control process of the timepiece 100*b* and the power consumption control device 20*b*, first, the power consumption control unit 10 determines whether the timepiece 100*b* is in the power saving state (step S201). In step S201, the power consumption control unit 10 proceeds to step S204 when the timepiece 100*b* is in the power saving state, and proceeds to step S202 when the timepiece 100*b* is not in the power saving state (be in the normal operation state).

Subsequently, in step S202, the power consumption control unit 10 determines whether the output voltage of the secondary battery 2 is not greater than the predetermined threshold value based on the detection result by the voltage detection unit 8. Moreover, in step S202, the power consumption control unit 10 proceeds to step S204 when the output voltage of the secondary battery 2 is not greater than the predetermined threshold value (the secondary battery 2 is in the low-voltage state) and proceeds to step S203 when the output voltage of the secondary battery 2 is greater than the predetermined threshold value.

Subsequently, in step S203, the power consumption control unit 10 causes the timepiece control unit 5 to be kept in the normal operation state (alternatively, the power saving-mode signal is put into the L state, and the timepiece control unit 5 is caused to be released from the power saving state and transition to the normal operation state). After the process of step S203 is finished, the power consumption control process ends.

On the other hand, in step S204, the power consumption control unit 10 determines whether the secondary battery 2 is in the non-charging state based on the detection result (the charging detection signal) by the charging detection and backflow prevention unit 9*b*. Moreover, in step S204, the power consumption control unit 10 proceeds to step S205 when the secondary battery 2 is in the non-charging state and proceeds to step S203 when the secondary battery 2 is not in the non-charging state (to be in the charging state).

Subsequently, in step S205, the power consumption control unit 10 puts the power saving-mode signal to the H state and causes the timepiece control unit 5 to transition from the normal operation state to the power saving state (alternatively, the power saving state is maintained). After the process of step S205 is finished, the power consumption control process ends.

The power consumption control process of steps S201 to S205 is repeatedly performed on the power consumption control device 20*b*.

In step S204, the charging detection and backflow prevention unit 9*b* outputs the charging detection signal of which the chattering is eliminated by the chattering prevention unit (the diode element 63) 11*b* to the power consumption control unit 10.

As described above, in the timepiece 100*b* and the power consumption control device 20*b*, the comparator 91 compares the output voltage of the photovoltaic cell 1 with the output voltage of the secondary battery 2 and outputs the comparison result as to whether the secondary battery 2 is in the non-charging state indicating that the output voltage of the photovoltaic cell 1 is not greater than the output voltage of the secondary battery 2 as the charging detection signal. The NMOS switch 92 prevents current from back-flowing from the secondary battery 2 to the photovoltaic cell 1 when the output (the charging detection signal) of the comparator 91 indicates the non-charging state. The chattering prevention unit (the diode element 63) 11*b* prevents chattering occurring in the output (the charging detection signal) of the comparator 91 during the comparison by the comparator 91. The power consumption control unit 10 causes the timepiece 100*b* to transition to the power saving state where the power consumption by the timepiece control unit 5 and the time motor is reduced when the output (the charging detection signal) of the comparator 91 indicates the non-charging state.

In this way, the power consumption control unit 10 causes the timepiece 100*b* to transition to the power saving state when the output of the comparator 91 indicates the non-charging state based on the output (charging detection signal) of the comparator 91. That is, the power consumption control unit 10 causes the timepiece 100*b* to transition to the power saving state before the secondary battery 2 enters into the over-discharged state. Thus, the timepiece 100*b* and the power consumption control device 20*b* can prevent the secondary battery 2 from entering into the over-discharged state.

Moreover, the timepiece 100*b* and the power consumption control device 20*b* include the voltage detection unit (detection unit) 8 that detects whether the output voltage of the secondary battery 2 is not greater than the predetermined threshold value. When the detection result by the voltage detection unit 8 indicates the low-voltage state, and the secondary battery 2 is in the low-voltage state, the power consumption control unit 10 causes the timepiece 100*b* to transition from the normal operation state to the power saving state. With this configuration, the timepiece 100*b* and the power consumption control device 20*b* can prevent the secondary battery 2 from entering into the over-discharged state while maintaining the normal operation state for a period in which the output voltage of the secondary battery 2 decreases up to the predetermined threshold value when the secondary battery 2 is in the non-charging state.

Moreover, when the secondary battery 2 is not in the non-charging state, the power consumption control unit 10 causes the timepiece 100*b* to be released from the power saving state to transition to the normal operation state. With this configuration, the timepiece 100*b* and the power consumption control device 20*b* can perform the hand movement operation (the clock operation of measuring time) by the time motor immediately when the photovoltaic cell 1 starts generating electricity (the secondary battery 2 is in the charging state).

Moreover, the chattering prevention unit 11*b* includes the diode element 63 that is disposed in series to the NMOS switch 92 so that when the secondary battery 2 is in the charging state, a forward bias is applied between the negative terminal (the power supply line VSS) of the secondary battery 2 and the negative terminal (the power supply line SVSS) of the photovoltaic cell 1. The diode element 63 generates a predetermined prescribed potential difference (VF) between the two input terminals subjected to the comparison in the comparator 91. With this configuration, since the chattering occurring during the comparison by the comparator 91 is removed from the output (charging detection signal) of the charging detection and backflow prevention unit 9*b*, a detection error of the charging detection and backflow prevention unit 9*b* decreases. Thus, it is possible to prevent the timepiece 100*b* unnecessarily transitioning to the power saving state due to the chattering and stopping operating. Therefore, the timepiece 100*b* and the power consumption control device 20*b* can prevent the secondary battery 2 from entering into the over-discharged state while preventing the transitioning to the power saving state due to a detection error.

Third Embodiment

Next, an electronic device (for example, a timepiece device) of a third embodiment of the present invention will be described with reference to the drawing.

Figure 8:
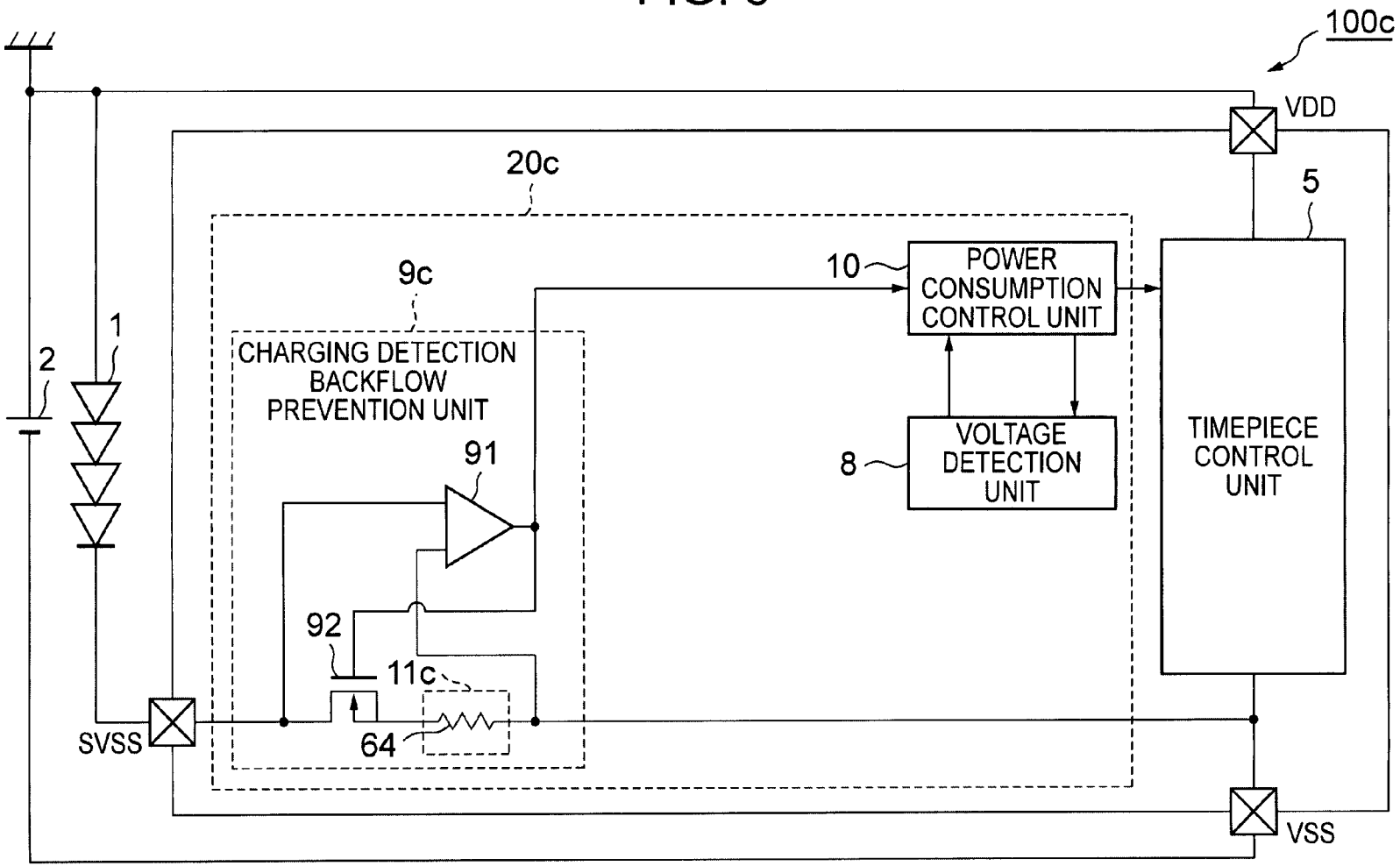
FIG. 8 is a simplified block diagram showing a timepiece device according to a third embodiment.

FIG. 8 is a simplified block diagram showing a timepiece device 100*c* according to the third embodiment.

The timepiece device (hereinafter referred to as a timepiece) 100*c* is an analog display timepiece, for example. In FIG. 8, the timepiece 100*c* includes a photovoltaic cell 1, a secondary battery 2, a timepiece control unit 5, and a power consumption control device 20*c*. In FIG. 8, the same configurations as those of FIG. 6 will be denoted by the same reference numerals.

The power consumption control device 20*c* controls the power of the timepiece 100*c*. The power consumption control device 20*c* outputs a power saving-mode signal to the timepiece control unit 5 based on the state of the photovoltaic cell 1 and the state of the secondary battery 2. Moreover, the power consumption control device 20*c* includes a power consumption control unit 10, a voltage detection unit 8, and a charging detection and backflow prevention unit (charging detection unit) 9*c*.

The charging detection and backflow prevention unit 9*c* includes a comparator 91, an NMOS switch 92, and a chattering prevention unit 11*c*. Moreover, an oscillation prevention unit (not shown) includes the chattering prevention unit 11*c*. The charging detection and backflow prevention unit 9*c* has the same configuration as the charging detection and backflow prevention unit 9*b* shown in FIG. 6 except that the chattering prevention unit 11 of the charging detection and backflow prevention unit 9*b* is replaced with the chattering prevention unit 11*c*.

The chattering prevention unit 11*c* prevents chattering occurring in the output of the comparator 91 during the comparison by the comparator 91. In the present embodiment, the chattering prevention unit 11*c* is a resistor element 64. Thus, the NMOS switch 92 has a source terminal connected to one terminal of the resistor element 64, a drain electrode connected to the power supply line SVSS, and a gate electrode connected to the output terminal of the comparator 91.

The resistor element 64 has one terminal connected to the power supply line VSS and the other terminal connected to the source terminal of the NMOS switch 92. That is, the resistor element 64 is connected in series to the NMOS switch 92 between the negative terminal of the secondary battery 2 and the negative terminal of the photovoltaic cell 1. Moreover, the resistor element 64 generates a predetermined prescribed potential difference between the two input terminals (the negative terminal of the secondary battery 2 and the negative terminal of the photovoltaic cell 1) subjected to the comparison in the comparator 91. Here, the predetermined prescribed potential difference is a potential difference generated due to a voltage drop when current flows through the resistor element 64. Moreover, the predetermined prescribed potential difference is appropriately set in accordance with a potential difference in which the output of the comparator 91 chatters. Here, the resistance value of the resistor element 64 is set in accordance with the predetermined prescribed potential difference.

Next, the operation of the present embodiment will be described.

First, an operation of the chattering prevention unit (the resistor element 64) 11*c* to prevent chattering will be described.

In FIG. 8, when the secondary battery 2 is in the charging state where the output voltage of the photovoltaic cell 1 is greater than the output voltage of the secondary battery 2, the comparator 91 outputs the H state to the charging detection signal. In this way, the NMOS switch 92 enters into the conduction state, and current flows from the negative terminal (the power supply line VSS) of the secondary battery 2 to the negative terminal (the power supply line SVSS) of the photovoltaic cell 1 through the resistor element 64 and the NMOS switch 92. When current flows through the resistor element 64, a potential difference due to the voltage drop is generated across both ends thereof. Thus, a potential difference corresponding to the voltage drop of the resistor element 64 is generated between the two input potentials (the potential of the power supply line VSS and the potential of the power supply line SVSS) compared by the comparator 91.

Although chattering occurs in the output of the comparator 91 when the two input potentials to be compared have values close to each other, since a potential difference corresponding to the voltage drop of the resistor element 64 is generated between the two input potentials being compared, the occurrence of chattering can be prevented.

That is, the chattering prevention unit (the resistor element 64) 11*c* can eliminate chattering occurring in the output signal (the charging detection signal) of the charging detection and backflow prevention unit 9*c* when the secondary battery 2 transitions from the charging state to the non-charging state.

Next, a power consumption control process in the timepiece 100*c* and the power consumption control device 20*c* will be described.

The power consumption control process of the timepiece 100*c* and the power consumption control device 20*c* is the same as the power consumption control process of the timepiece 100*b* and the power consumption control device 20*b* in the second embodiment shown in FIG. 6.

As described above, in the timepiece 100*c* and the power consumption control device 20*c*, the comparator 91 compares the output voltage of the photovoltaic cell 1 with the output voltage of the secondary battery 2 and outputs the comparison result as to whether the secondary battery 2 is in the non-charging state indicating that the output voltage of the photovoltaic cell 1 is not greater than the output voltage of the secondary battery 2 as the charging detection signal. The NMOS switch 92 prevents current from back-flowing from the secondary battery 2 to the photovoltaic cell 1 when the output (the charging detection signal) of the comparator 91 indicates the non-charging state. The chattering prevention unit (the resistor element 64) 11*c* prevents chattering occurring in the output (the charging detection signal) of the comparator 91 during the comparison by the comparator 91. The power consumption control unit 10 causes the timepiece 100*b* to transition to the power saving state where the power consumption by the timepiece control unit 5 and the time motor is reduced when the output (the charging detection signal) of the comparator 91 indicates the non-charging state.

With this configuration, the timepiece 100*c* and the power consumption control device 20*c* can prevent the secondary battery 2 from entering into the over-discharged state similarly to the second embodiment.

Moreover, the chattering prevention unit 11*c* includes the resistor element 64 that is disposed in series to the NMOS switch 92 between the negative terminal (the power supply line VSS) of the secondary battery 2 and the negative terminal (the power supply line SVSS) of the photovoltaic cell 1. The resistor element 64 generates a predetermined prescribed potential difference (a potential difference corresponding to a voltage drop) between the two input terminals subjected to the comparison in the comparator 91. With this configuration, since the chattering occurring during the comparison by the comparator 91 is removed from the output (charging detection signal) of the charging detection and backflow prevention unit 9*c*, a detection error of the charging detection and backflow prevention unit 9*c* decreases. Thus, it is possible to prevent the timepiece 100*b* from unnecessarily transitioning to the power saving state due to the chattering and stopping operating. Therefore, the timepiece 100*c* and the power consumption control device 20*c* can prevent the secondary battery 2 from entering into the over-discharged state while preventing the transitioning to the power saving state due to a detection error similarly to the second embodiment.

Fourth Embodiment

Next, an electronic device (for example, a timepiece device) of a fourth embodiment of the present invention will be described with reference to the drawing.

Figure 9:
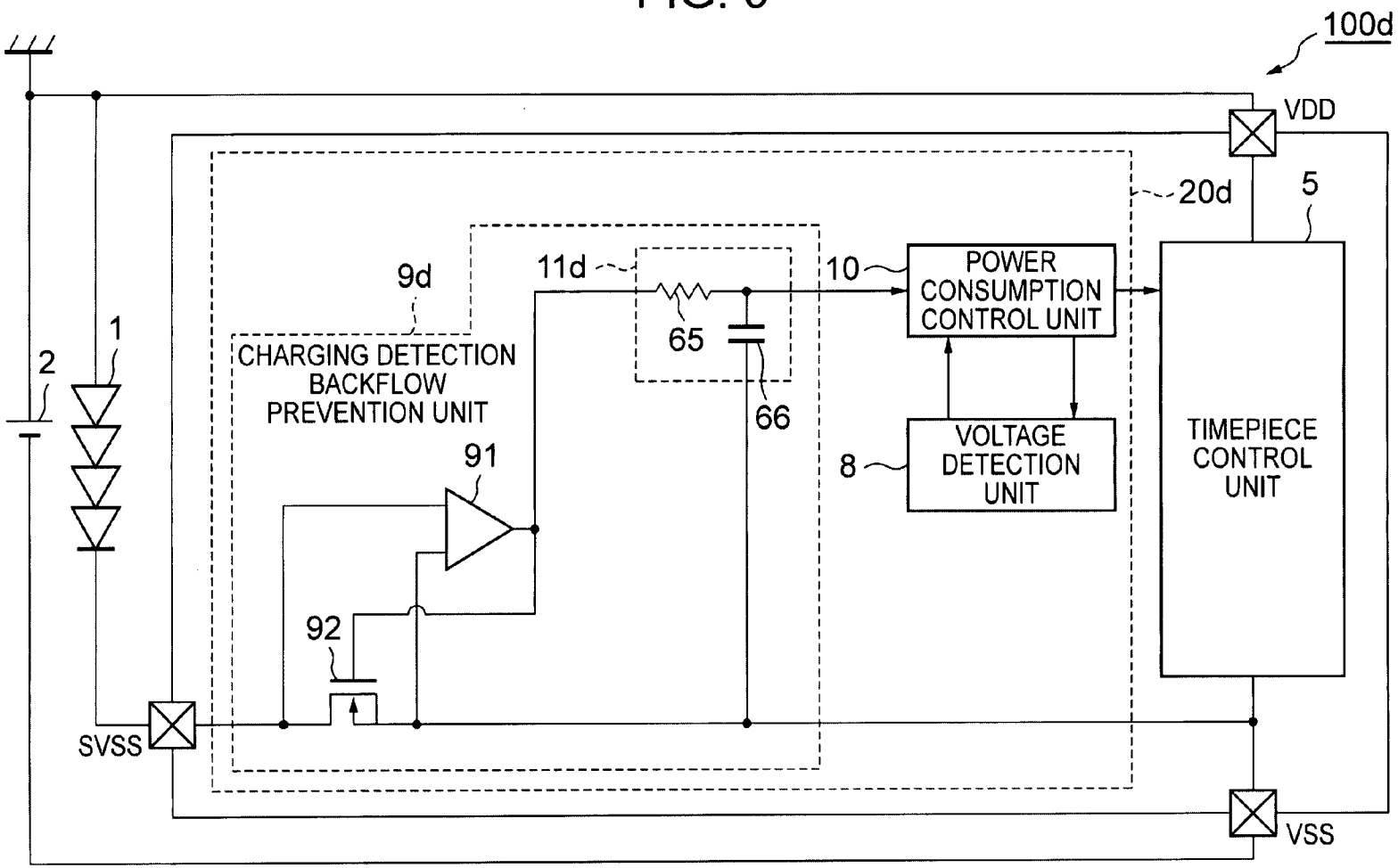
FIG. 9 is a simplified block diagram showing a timepiece device according to a fourth embodiment.

FIG. 9 is a simplified block diagram showing a timepiece device 100*d* according to the fourth embodiment.

The timepiece device (hereinafter referred to as a timepiece) 100*d* is an analog display timepiece, for example. In FIG. 9, the timepiece 100*d* includes a photovoltaic cell 1, a secondary battery 2, a timepiece control unit 5, and a power consumption control device 20*d*. In FIG. 9, the same configurations as those of FIG. 6 will be denoted by the same reference numerals.

The power consumption control device 20*d* controls the power of the timepiece 100*d*. The power consumption control device 20*d* outputs a power saving-mode signal to the timepiece control unit 5 based on the state of the photovoltaic cell 1 and the state of the secondary battery 2. Moreover, the power consumption control device 20*d* includes a power consumption control unit 10, a voltage detection unit 8, and a charging detection and backflow prevention unit (charging detection unit) 9*d*.

The charging detection and backflow prevention unit 9*d* includes a comparator 91, an NMOS switch 92, and a chattering prevention unit 11*d*. Moreover, an oscillation prevention unit (not shown) includes the chattering prevention unit 11*d*. The charging detection and backflow prevention unit 9*d* has the same configuration as the charging detection and backflow prevention unit 9*b* shown in FIG. 6 except that the chattering prevention unit 11 of the charging detection and backflow prevention unit 9*b* is replaced with the chattering prevention unit 11*d*. In addition, in the present embodiment, the NMOS switch 92 has a source terminal connected to the power supply line VSS, a drain terminal connected to the power supply line SVSS, and a gate electrode connected to the output terminal of the comparator 91.

The chattering prevention unit 11*d* is disposed between the comparator 91 and the power consumption control unit 10 so as to prevent chattering occurring in the output of the comparator 91 during the comparison by the comparator 91. The chattering prevention unit 11*d* includes a low-pass filter that removes a pulse signal of a predetermined prescribed frequency or higher from the output of the comparator 91. The chattering prevention unit 11*d* is an RC filter circuit, for example. The chattering prevention unit 11*d* removes a pulse signal of the predetermined prescribed frequency or higher from the output of the comparator 91 and output the filtered output to the power consumption control unit 10 as the charging detection signal.

Here, the predetermined prescribed frequency is a frequency higher than the frequency of chattering occurring in the output of the comparator 91.

Moreover, the chattering prevention unit 11*d* includes a resistor element 65 and a capacitor element 66.

The resistor element 65 has one terminal connected to the output line of the comparator 91 and the other terminal connected to the output line of the chattering prevention unit 11*d*. That is, the resistor element 65 is connected in series between the output line of the comparator 91 and the output line of the chattering prevention unit 11*d*.

The capacitor element 66 has one terminal connected to the output line of the chattering prevention unit 11*d* and the other terminal connected to the power supply line VSS.

Next, the operation of the present embodiment will be described.

First, an operation of the chattering prevention unit 11*d* to prevent chattering will be described.

In FIG. 9, the chattering prevention unit 11*d* cuts a pulse signal of the predetermined prescribed frequency or higher from the output of the comparator 91 using an RC filter circuit and passes a pulse signal of a frequency lower than the predetermined prescribed frequency. In this way, the chattering prevention unit 11*d* eliminates the chattering occurring in the output of the comparator 91 and outputs the filtered output to the power consumption control unit 10 as the charging detection signal. The power consumption control unit 10 performs a power consumption control process based on the detection result (the charging detection signal) by the charging detection and backflow prevention unit 9*d*.

In addition, since the chattering prevention unit 11*d* eliminates the chattering from the output of the comparator 91, it is possible to deal with any of a case where the secondary battery 2 transitions from the charging state to the non-charging state and a case where the secondary battery 2 transitions from the non-charging state to the charging state.

Next, a power consumption control process in the timepiece 100*d* and the power consumption control device 20*d* will be described.

The power consumption control process of the timepiece 100*d* and the power consumption control device 20*d* is the same as the power consumption control process of the timepiece 100*b* and the power consumption control device 20*b* in the second embodiment shown in FIG. 6.

As described above, in the timepiece 100*d* and the power consumption control device 20*d*, the comparator 91 compares the output voltage of the photovoltaic cell 1 with the output voltage of the secondary battery 2 and outputs the comparison result as to whether the secondary battery 2 is in the non-charging state indicating that the output voltage of the photovoltaic cell 1 is not greater than the output voltage of the secondary battery 2 as the charging detection signal. The NMOS switch 92 prevents current from back-flowing from the secondary battery 2 to the photovoltaic cell 1 when the output (the charging detection signal) of the comparator 91 indicates the non-charging state. The chattering prevention unit (the RC filter circuit) 11*d* prevents chattering occurring in the output of the comparator 91 during the comparison by the comparator 91. The power consumption control unit 10 causes the timepiece 100*b* to transition to the power saving state where the power consumption by the timepiece control unit 5 and the time motor is reduced when the output (the charging detection signal) of the charging detection and backflow prevention unit 9*d* indicates the non-charging state.

With this configuration, the timepiece 100*d* and the power consumption control device 20*d* can prevent the secondary battery 2 from entering into the over-discharged state similarly to the second embodiment.

Moreover, the chattering prevention unit 11*d* includes the low-pass filter (the RC filter circuit) that removes a pulse signal of a predetermined prescribed frequency or higher from the output of the comparator 91. The chattering prevention unit 11*d* cuts a pulse signal of the predetermined prescribed frequency or higher from the output of the comparator 91 and passes a pulse signal of a frequency lower than the predetermined prescribed frequency. With this configuration, since the chattering occurring during the comparison by the comparator 91 is removed from the output (charging detection signal) of the charging detection and backflow prevention unit 9*d*, a detection error of the charging detection and backflow prevention unit 9*d* decreases. Thus, it is possible to prevent the timepiece 100*d* from unnecessarily transitioning to the power saving state due to the chattering and stopping operating. Therefore, the timepiece 100*d* and the power consumption control device 20*d* can prevent the secondary battery 2 from entering into the over-discharged state while preventing the transitioning to the power saving state due to a detection error similarly to the second embodiment.

Furthermore, the chattering prevention unit 11*d* removes the chattering from the output of the comparator 91. Thus, the timepiece 100*d* and the power consumption control device 20*d* can remove the chattering occurring in the output of the comparator 91 even when the secondary battery 2 transitions from the charging state to the non-charging state and from the non-charging state to the charging state.

Fifth Embodiment

Next, an electronic device (for example, a timepiece device) of a fifth embodiment of the present invention will be described with reference to the drawings.

Figure 10:
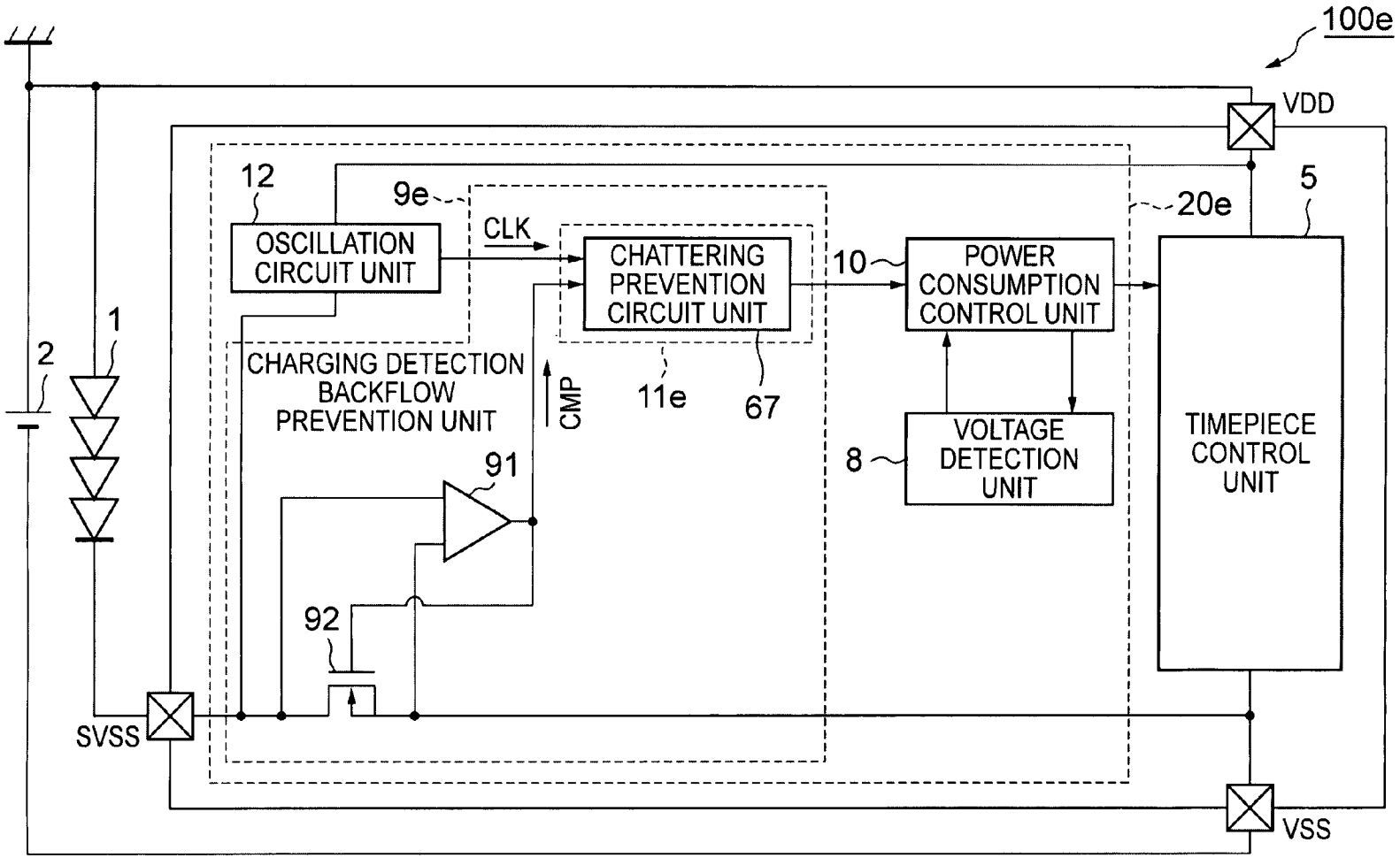
FIG. 10 is a simplified block diagram showing a timepiece according to a fifth embodiment.

FIG. 10 is a simplified block diagram showing a timepiece 100*e* according to the fifth embodiment.

The timepiece 100*e* is an analog display timepiece, for example. In FIG. 10, the timepiece 100*e* includes a photovoltaic cell 1, a secondary battery 2, a timepiece control unit 5, and a power consumption control device 20*e*. In FIG. 10, the same configurations as those of FIG. 6 will be denoted by the same reference numerals.

The power consumption control device 20*e* controls the power of the timepiece 100*e*. The power consumption control device 20*e* outputs a power saving-mode signal to the timepiece control unit 5 based on the state of the photovoltaic cell 1 and the state of the secondary battery 2. Moreover, the power consumption control device 20*e* includes a power consumption control unit 10, a voltage detection unit 8, a charging detection and backflow prevention unit (charging detection unit) 9*e*, and an oscillation circuit unit 12.

The charging detection and backflow prevention unit 9*e* includes a comparator 91, an NMOS switch 92, and a chattering prevention unit 11*e*. Moreover, an oscillation prevention unit (not shown) includes the chattering prevention unit 11*e*. The charging detection and backflow prevention unit 9*e* has the same configuration as the charging detection and backflow prevention unit 9*d* shown in FIG. 9 except that the chattering prevention unit 11*d* of the charging detection and backflow prevention unit 9*d* is replaced with the chattering prevention unit 11*e*.

The chattering prevention unit 11*e* is disposed between the comparator 91 and the power consumption control unit 10 so as to prevent chattering occurring in the output CMP of the comparator 91 during the comparison by the comparator 91. The chattering prevention unit 11*e* includes a chattering prevention circuit unit (logic circuit) 67 that operates based on a clock signal CLK of a predetermined prescribed cycle supplied from the oscillation circuit unit 12. The chattering prevention circuit unit 67 removes a pulse signal of a prescribed pulse width or shorter based on the cycle of the clock signal supplied from the oscillation circuit unit 12 from the output CMP of the comparator 91. The chattering prevention unit 11*e* removes a pulse signal of the above-described pulse width or smaller from the output of the comparator 91 and output the filtered output to the power consumption control unit 10 as the charging detection signal.

Here, the prescribed pulse width based on the cycle of the clock signal CLK means a pulse width wider than the cycle of the chattering occurring in the output CMP of the comparator 91.

The oscillation circuit unit 12 operates by the electricity supplied from the photovoltaic cell 1, generates the clock signal CLK of the predetermined prescribed cycle (frequency) and supplies the clock signal to the chattering prevention unit (chattering prevention circuit unit 67) 11*e*.

Figure 11:
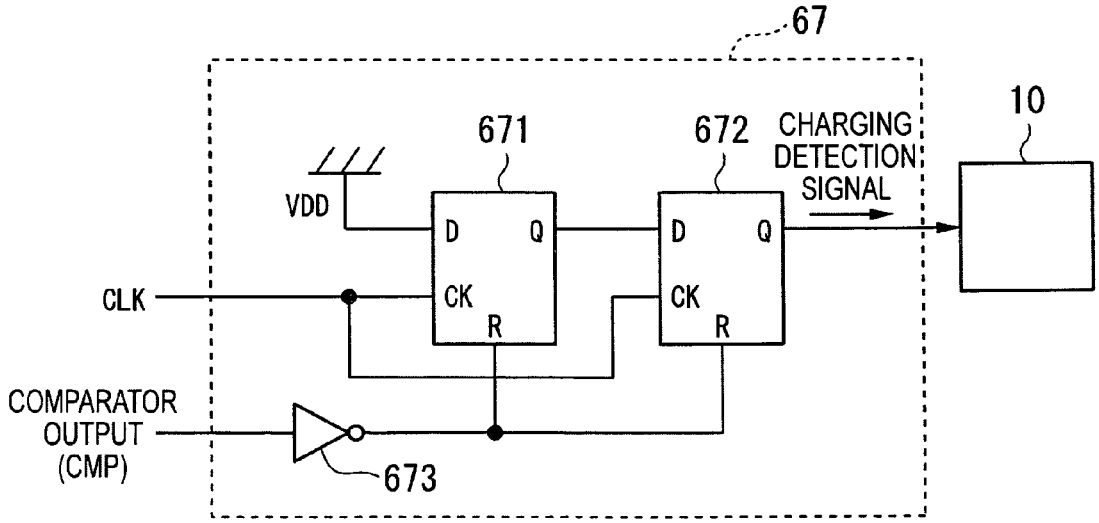
FIG. 11 is a simplified block diagram showing a chattering prevention unit in the fifth embodiment.

FIG. 11 is a simplified block diagram showing the chattering prevention unit (the chattering prevention circuit unit 67) 11*e* in the fifth embodiment.

In FIG. 11, the chattering prevention circuit unit 67 includes flip-flops 671 and 672 and an inverter 673.

The flip-flop 671 has a D (data) input terminal connected to the power supply line VDD, a CK (clock) input terminal connected to the signal line of the clock signal CLK, and an R (reset) input terminal connected to the output terminal of the inverter 673.

The flip-flop 672 has a D input terminal connected to the Q (queue) output terminal of the flip-flop 671, a CK input terminal connected to the signal line of the clock signal CLK, and an R input terminal connected to the output terminal of the inverter 673. The Q output of the flip-flop 672 is output to the power consumption control unit 10 as the charging detection signal.

The inverter 673 has an input terminal connected to the signal line of the output CMP of the comparator 91 and an output terminal connected to the R input terminals of the flip-flops 671 and 672. The inverter 673 logically inverts and outputs the output CMP of the comparator 91.

The flip-flops 671 and 672 function as a 2-bit shift register which maintains the reset state when the output CMP of the comparator 91 indicates the non-charging state (the L state), and of which the input terminal is fixed at the H state. That is, the chattering prevention circuit unit 67 includes a 2-bit shift register that maintains the reset state when the output CMP of the comparator 91 indicates the non-charging state (the L state). Moreover, the 2-bit shift register has the input terminal fixed at the H state and a clock terminal to which the clock signal CLK is supplied. The logic state of the 2-bit shift register changes from the state of the flip-flop 671 to the state of the flip-flop 672 in response to the rising edge of the clock signal CLK. The 2-bit shift register outputs the charging detection signal to the power consumption control unit 10.

Moreover, here, the prescribed pulse width based on the cycle of the clock signal CLK means a pulse width equal to a period in which two rising edges of the clock signal CLK occur, for example.

Next, the operation of the present embodiment will be described.

First, an operation of the chattering prevention unit (the chattering prevention circuit unit 67) 11*e* to prevent chattering will be described.

Figure 12:
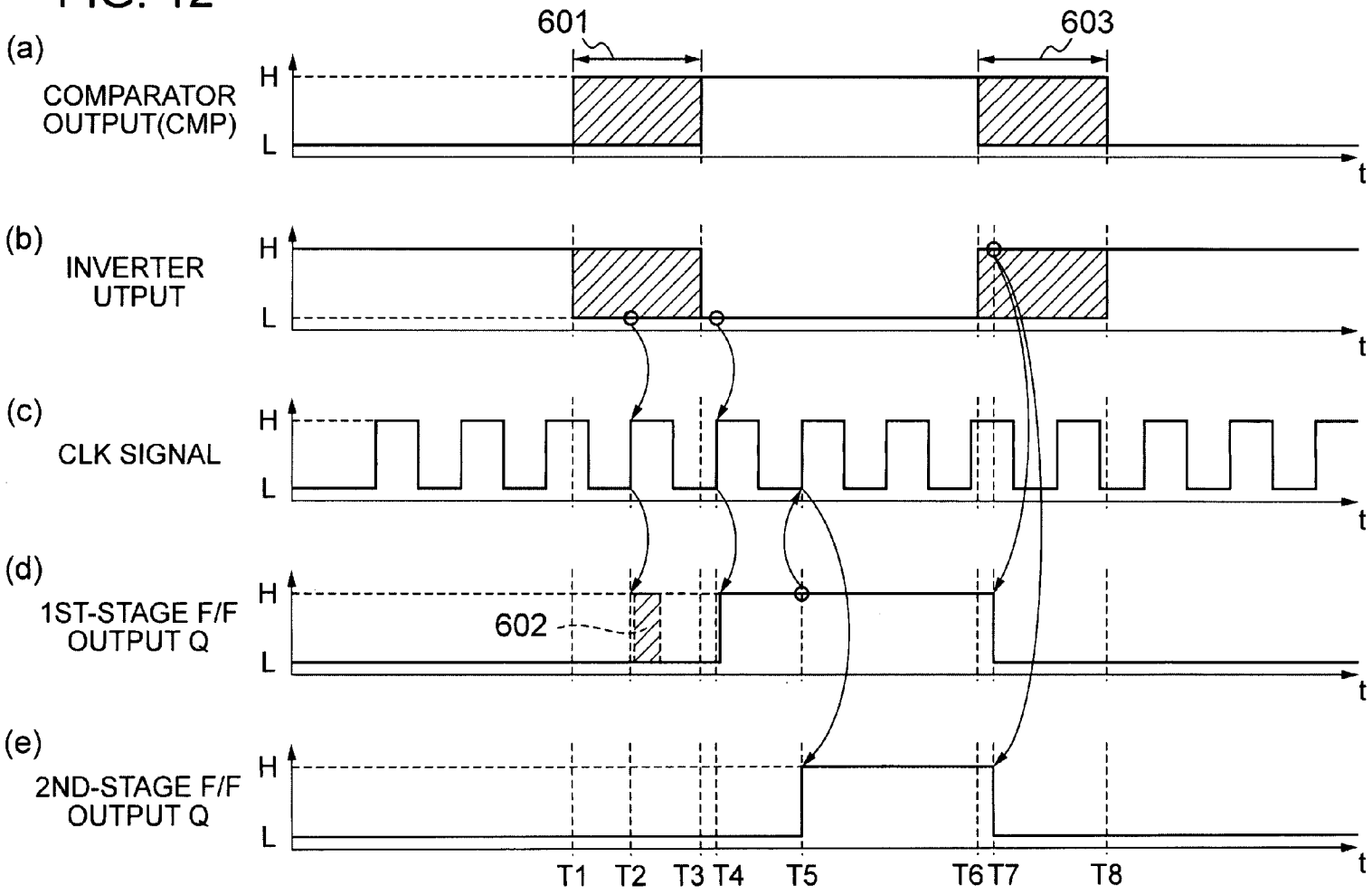
FIG. 12 ((*a*) to (*e*)) is a timing chart showing an operation of the chattering prevention unit in the fifth embodiment.

FIG. 12 ((*a*) to (*e*)) is a timing chart showing the operation of the chattering prevention unit (the chattering prevention circuit unit 67) 11*e* in the fifth embodiment.

In the graph of FIG. 12 ((*a*) to (*e*)), the vertical axis represents a logic state, and the horizontal axis represents time.

Portions (a) and (b) of FIG. 12 show the state of the output signal CMP of the comparator 91 and the state of the output signal (the inversion signal of the output signal CMP) of the inverter 673, respectively. Moreover, portion (c) of FIG. 12 shows the state of the clock signal CLK. Moreover, portions (d) and (e) of FIG. 12 show the state of the output signal of the flip-flop 672 and the state of the output signal (the charging detection signal) of the flip-flop 672, respectively.

In FIG. 12 ((*a*) to (*e*)), the time on the horizontal axis is of the same time scale.

Moreover, in FIG. 12 ((*a*) to (*e*)), the periods 601 and 603 represent a period where the output signal CMP of the comparator 91 chatters.

In FIG. 12 ((*a*) to (*e*)), the output signal CMP in portion (a) of FIG. 12 is in the L state (non-charging state) in the initial state. In this state, since the output signal (the inversion signal of the output signal CMP) of the inverter 673 in portion (b) of FIG. 12 is in the H state, the outputs of both flip-flops 671 and 672 in portions (d) and (e) of FIG. 12 are in the L state.

Subsequently, when the photovoltaic cell 1 starts generating electricity, and at time T1, the output voltage of the photovoltaic cell 1 approaches the output voltage of the secondary battery 2, the output signal CMP in portion (a) of FIG. 12 chatters. In this example, in the period 601 of from the time T1 to T3, the chattering occurs. In the period 601, the output signal CMP in portion (a) of FIG. 12 and the output signal of the inverter 673 in portion (b) of FIG. 12 frequently change between the H state and the L state.

Moreover, in the period 602, the output Q of the flip-flop 671 in portion (d) of FIG. 12 changes in response to the rising edge of the clock signal CLK in portion (c) of FIG. 12 at time T2. The output Q of the flip-flop 671 in portion (d) of FIG. 12 is reset again when the output signal CMP in portion (a) of FIG. 12 is in the L state due to the chattering.

Subsequently, the difference between the output voltage of the photovoltaic cell 1 and the output voltage of the secondary battery 2 reaches a level in which no chattering occurs (time T3). At time T3, the output signal CMP in portion (a) of FIG. 12 is in the H state, and the output signal of the inverter 673 in portion (b) of FIG. 12 is in the L state. In this way, the flip-flops 671 and 672 are released from the reset state because the reset input terminals thereof are in the L state.

Subsequently, the output Q of the flip-flop 671 in portion (d) of FIG. 12 changes to the H state in response to the rising edge of the clock signal CLK in portion (c) of FIG. 12 (time T4). Moreover, the output Q of the flip-flop 672 in portion (e) of FIG. 12 changes to the H state in response to the next rising edge of the clock signal CLK (time T5). That is, the chattering prevention circuit unit 67 outputs the H state to the charging detection signal when the output signal CMP in portion (a) of FIG. 12 is stably maintained to be in the H state in a period where two rising edges of the clock signal CLK in portion (c) of FIG. 12 occur. That is, chattering having a pulse width shorter than the period where two rising edges of the clock signal CLK in portion (c) of FIG. 12 occur is removed from the charging detection signal.

Subsequently, when the output voltage of the photovoltaic cell 1 decreases again, and at time T6, the output voltage of the photovoltaic cell 1 approaches the output voltage of the secondary battery 2, the output signal CMP in portion (a) of FIG. 12 chatters. In this example, in the period 603 of from the time T6 to T8, the chattering occurs. In the period 603, the output signal CMP in portion (a) of FIG. 12 and the output signal of the inverter 673 in portion (b) of FIG. 12 frequently change between the H state and the L state. The output signal of the inverter 673 in portion (b) of FIG. 12 is at the timing to become the H state, and the flip-flops 671 and 672 are reset (time T7). In this way, the outputs of both flip-flops 671 and 672 in portions (d) and (e) of FIG. 12 are in the L state. As a result, although the chattering prevention circuit unit 67 outputs the H state to the charging detection signal in the period where the output signal CMP in portion (a) of FIG. 12 chatters, the chattering does not appear in the charging detection signal. That is, the chattering prevention circuit unit 67 removes the chattering occurring in the output CMP of the comparator 91.

As described above, in the timepiece 100*e* and the power consumption control device 20*e*, the comparator 91 compares the output voltage of the photovoltaic cell 1 with the output voltage of the secondary battery 2 and outputs the comparison result as to whether the secondary battery 2 is in the non-charging state indicating that the output voltage of the photovoltaic cell 1 is not greater than the output voltage of the secondary battery 2 as the charging detection signal. The NMOS switch 92 prevents current from back-flowing from the secondary battery 2 to the photovoltaic cell 1 when the output of the comparator 91 indicates the non-charging state. The chattering prevention unit (the chattering prevention circuit unit 67) 11*e* prevents chattering occurring in the output (the charging detection signal) of the comparator 91 during the comparison by the comparator 91. The power consumption control unit 10 causes the timepiece 100*e* to transition to the power saving state where the power consumption by the timepiece control unit 5 and the time motor is reduced when the output (the charging detection signal) of the charging detection and backflow prevention unit 9*e* indicates the non-charging state.

With this configuration, the timepiece 100*e* and the power consumption control device 20*e* can prevent the secondary battery 2 from entering into the over-discharged state similarly to the second embodiment.

Moreover, the chattering prevention unit 11*e* includes the chattering prevention circuit unit (logic circuit) 67 that operates based on a clock signal CLK of a predetermined prescribed cycle and removes a pulse signal of a prescribed pulse width or shorter based on the cycle of the clock signal CLK from the output CMP of the comparator 91. Moreover, the chattering prevention circuit unit 67 includes a shift register which maintains the reset state when the output CMP of the comparator 91 indicates the non-charging state, and of which the input terminal is supplied with the clock signal CLK and is fixed at the logic H state.

With this configuration, since the chattering occurring during the comparison by the comparator 91 is removed from the output (charging detection signal) of the charging detection and backflow prevention unit 9*e*, a detection error of the charging detection and backflow prevention unit 9*e* decreases. Thus, it is possible to prevent the timepiece 100*e* unnecessarily transitioning to the power saving state due to the chattering and stopping operating. Therefore, the timepiece 100*e* and the power consumption control device 20*e* can prevent the secondary battery 2 from entering into the over-discharged state while preventing the transitioning to the power saving state due to a detection error similarly to the second embodiment.

Furthermore, the chattering prevention unit 11*e* removes the chattering from the output of the comparator 91. Thus, the timepiece 100*e* and the power consumption control device 20*e* can remove the chattering occurring in the output of the comparator 91 even when the secondary battery 2 transitions from the charging state to the non-charging state and from the non-charging state to the charging state similarly to the fourth embodiment.

According to the second embodiment of the present invention, the power consumption control device 20*b* includes: the comparator 91 that compares the output potential difference of the photovoltaic cell (primary power supply unit) 1 that generates an electromotive force and the output potential difference of the secondary battery (secondary power supply unit) 2 that is charged by the electromotive force and outputs a signal indicating the non-charging state when the secondary battery 2 is in the non-charging state where the output potential difference of the photovoltaic cell 1 is not greater than the output potential difference of the secondary battery 2; the NMOS switch (switching unit) 92 that prevents current from back-flowing from the secondary battery 2 to the photovoltaic cell 1 when the output of the comparator 91 indicates the non-charging state; the chattering prevention unit 11*b* that prevents chattering occurring in the output of the comparator 91 during the comparison by the comparator 91; and the power consumption control unit 10 that causes the timepiece 100*b* to transition to the power saving state where the power consumption by the timepiece control unit (load unit) 5 is reduced when the output of the comparator 91 indicates the non-charging state.

In this way, the power consumption control unit 10 causes the timepiece 100*b* to transition to the power saving state before the secondary battery 2 enters into the over-discharged state. Thus, the timepiece 100*b* and the power consumption control device 20*b* can prevent the secondary battery 2 from entering into the over-discharged state.

Moreover, the power consumption control device 20*b* of the second embodiment includes the voltage detection unit (detection unit) 8 that detects whether the output voltage of the secondary battery 2 is not greater than the predetermined threshold value. Moreover, when the secondary battery 2 is in the non-charging state, and the detection result by the voltage detection unit 8 is not greater than the predetermined threshold value, the power consumption control unit 10 causes the timepiece 100*b* to transition to the power saving state and releases the power saving state when the secondary battery 2 is not in the non-charging state.

With this configuration, the power consumption control device 20*b* can prevent the secondary battery 2 from entering into the over-discharged state while maintaining the normal operation state for a period in which the output voltage of the secondary battery 2 decreases up to the predetermined threshold value when the secondary battery 2 is in the non-charging state. Moreover, the power consumption control device 20*b* can perform the hand movement operation (the clock operation of measuring time) by the time motor immediately when the photovoltaic cell 1 starts generating electricity (the secondary battery 2 is in the charging state).

Moreover, the chattering prevention unit 11*b* of the second embodiment includes the diode element 63 that is disposed in series to the NMOS switch 92 so that when the secondary battery 2 is not in the non-charging state (to be in the charging state), a forward bias is applied between the positive terminal of the secondary battery 2 and the positive terminal of the photovoltaic cell 1, or between the negative terminal of the secondary battery 2 and the negative terminal of the photovoltaic cell 1 so as to generate a predetermined prescribed potential difference (VF) between the two input terminals subjected to the comparison in the comparator 91.

With this configuration, the chattering occurring during the comparison by the comparator 91 is removed from the output (charging detection signal) of the charging detection and backflow prevention unit 9*b*. Thus, a detection error of the charging detection and backflow prevention unit 9*b* can be decreased. Therefore, the power consumption control device 20*b* can prevent the secondary battery 2 from entering into the over-discharged state while preventing the transitioning to the power saving state due to a detection error.

Moreover, the chattering prevention unit 11*c* of the third embodiment includes the resistor element 64 that is disposed in series to the NMOS switch 92 between the positive terminal of the secondary battery 2 and the positive terminal of the photovoltaic cell 1, or between the negative terminal of the secondary battery 2 and the negative terminal of the photovoltaic cell 1 so as to generate a predetermined prescribed potential difference (a potential difference corresponding to a voltage drop) between the two input terminals subjected to the comparison in the comparator 91.

With this configuration, the chattering occurring during the comparison by the comparator 91 is removed from the output (charging detection signal) of the charging detection and backflow prevention unit 9*c*. Thus, a detection error of the charging detection and backflow prevention unit 9*c* can be decreased. Therefore, the power consumption control device 20*c* can prevent the secondary battery 2 from entering into the over-discharged state while preventing the transitioning to the power saving state due to a detection error.

Moreover, the chattering prevention unit 11*d* of the fourth embodiment includes the low-pass filter (RC filter circuit) that removes a pulse signal of a predetermined prescribed frequency or higher from the output of the comparator 91.

With this configuration, the chattering occurring during the comparison by the comparator 91 is removed from the output (charging detection signal) of the charging detection and backflow prevention unit 9*d*. Thus, a detection error of the charging detection and backflow prevention unit 9*d* can be decreased. Therefore, the power consumption control device 20*d* can prevent the secondary battery 2 from entering into the over-discharged state while preventing the transitioning to the power saving state due to a detection error. In addition, the power consumption control device 20*d* can remove the chattering occurring in the output of the comparator 91 even when the secondary battery 2 transitions from the charging state to the non-charging state and from the non-charging state to the charging state.

Moreover, the chattering prevention unit 11*e* of the fifth embodiment includes the chattering prevention circuit unit (logic circuit) 67 that operates based on a clock signal CLK of a predetermined prescribed cycle and removes a pulse signal of a prescribed pulse width or shorter based on the cycle of the clock signal CLK from the output CMP of the comparator 91. Moreover, the chattering prevention circuit unit 67 includes a shift register (a 2-bit shift register including the flip-flops 671 and 672) which maintains the reset state when the output CMP of the comparator 91 indicates the non-charging state, and of which the clock terminal is supplied with the clock signal CLK and of which the input terminal is fixed at the logic H state. Moreover, the output of the shift register is the output of the chattering prevention unit 11*e*.

With this configuration, the chattering occurring during the comparison by the comparator 91 is removed from the output (charging detection signal) of the charging detection and backflow prevention unit 9*e*. Thus, a detection error of the charging detection and backflow prevention unit 9*e* can be decreased. Therefore, the power consumption control device 20*e* can prevent the secondary battery 2 from entering into the over-discharged state while preventing the transitioning to the power saving state due to a detection error. In addition, the power consumption control device 20*e* can remove the chattering occurring in the output CMP of the comparator 91 even when the secondary battery 2 transitions from the charging state to the non-charging state and from the non-charging state to the charging state.

Moreover, the clock signal CLK of the fifth embodiment is generated by the electricity supplied from the photovoltaic cell 1.

With this configuration, the clock signal CLK necessary when transitioning from the non-charging state to the charging state can be supplied to the chattering prevention circuit unit 67.

The present invention is not limited to the respective embodiments described above, but can be modified within a range not departing from the spirit of the present invention. In the respective embodiments, although an example where the photovoltaic cell 1 is used as the primary power supply unit has been described, another primary power supply unit may be used. For example, an electricity generating device that converts kinetic energy into electric energy through electromagnetic induction may be used as the primary power supply unit.

Moreover, in the respective embodiments, although an example where the secondary battery 2 is used as the secondary power supply unit has been described, a capacitor element may be used.

Moreover, in the respective embodiments, although the power supply line VDD is described to be at the potential of VDD-earth, which represents the reference potential of the timepiece 100*b*, 100*c*, 100*d*, or 100*e*, the power supply line VSS may be at the potential of VSS-earth, which represents the reference potential of the timepiece 100*b*, 100*c*, 100*d*, or 100*e*.

Moreover, in the respective embodiments, although the electronic device has been described to be a timepiece device as an example, the present invention may be applied to other electronic devices. Moreover, although an example in which the power consumption control device 20*b*, 20*c*, 20*d*, or 20*e* is applied to a timepiece device has been described, the power consumption control device may be applied to other electronic devices. The other electronic devices may be an electronic desk calculator, an electronic dictionary, and the like, for example.

Moreover, in the respective embodiments, although the timepiece 100*b*, 100*c*, 100*d*, or 100*e* has been described to be an analog display timepiece, the timepiece may be applied to a digital display timepiece and may be applied to a timepiece that has both analog and digital displays. When a digital display is present, the clock operation to be stopped is not limited to the hand movement operation by the time motor but may be an operation of displaying a digital time presentation on a liquid crystal display or the like.

Moreover, in the respective embodiments, although the power saving state has been described to be a state where the clock operation is stopped, the power saving state may be another state if the power consumption by the load unit is reduced. For example, the power saving state may be a state where a part of the functions of the timepiece control unit 5 is stopped, or a state where the clock signal for operating the timepiece control unit 5 is changed to a lower frequency.

Moreover, in the respective embodiments, although an example in which the NMOS switch 92 is disposed between the negative terminal of the secondary battery 2 and the negative terminal of the photovoltaic cell 1 has been described, the NMOS switch 92 may be disposed between the positive terminal of the secondary battery 2 and the positive terminal of the photovoltaic cell 1.

Moreover, in the respective embodiments, although an example in which the chattering prevention unit 11*b*, 11*c*, 11*d*, or 11*e* is provided singly has been described, the respective chattering prevention units 11*b*, 11*c*, 11*d*, and 11*e* may be provided plurally in combination.

Moreover, in the second and third embodiment, although an example in which the chattering prevention unit 11*b* (or 11*c*) includes the diode element 63 (or the resistor element 64) has been described, the present invention is not limited to this. The chattering prevention unit may have another configuration as long as it generates a prescribed potential difference between the two input terminals subjected to the comparison in the comparator 91. Moreover, similarly to the NMOS switch 92, the chattering prevention unit may be disposed between the positive terminal of the secondary battery 2 and the positive terminal of the photovoltaic cell 1.

Moreover, in the fourth embodiment, although the low-pass filter has been described to be an RC filter circuit, an optional low-pass filter may be used if it removes a pulse signal of the predetermined prescribed frequency or higher from the output of the comparator 91.

Moreover, in the fifth embodiment, the chattering prevention circuit unit 67 is not limited to the logic circuit of FIG. 11. An optional logic circuit may be used if it removes a pulse signal of a predetermined prescribed pulse width or smaller based on the cycle of the clock signal CLK being used.

Moreover, although an example in which a 2-bit shift register is used as the chattering prevention circuit unit 67 has been described, a shift register of other bit numbers (n-bit) may be used. The bit number may be determined taking the pulse width of the chattering occurred and the cycle of the clock signal CLK being used into consideration.

Sixth Embodiment

Next, an electronic device (for example, a timepiece device) of a sixth embodiment will be described with reference to the drawings.

Figure 13:
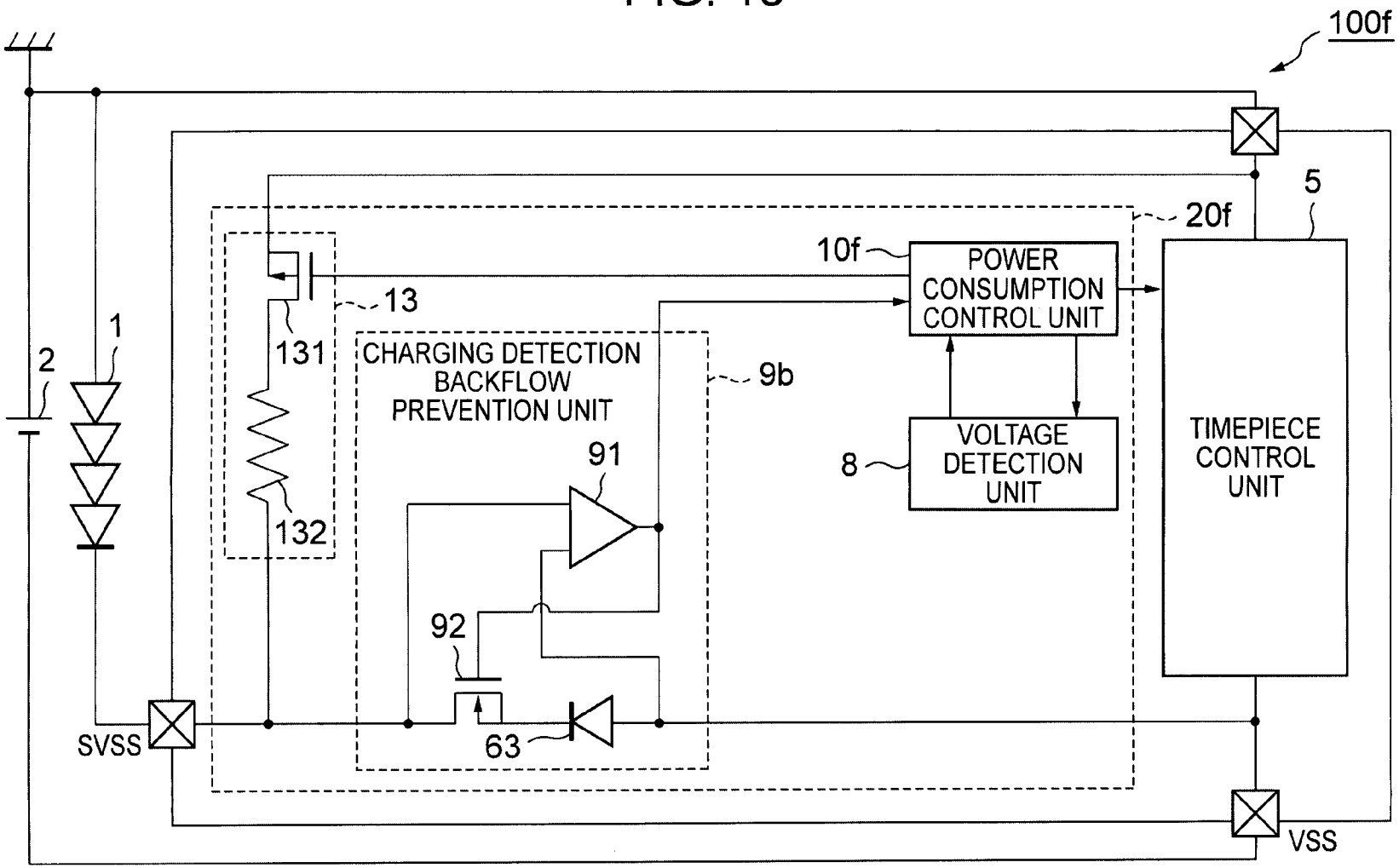
FIG. 13 is a simplified block diagram showing a timepiece device according to a sixth embodiment.

FIG. 13 is a simplified block diagram showing a timepiece device 100*f* according to the sixth embodiment.

The timepiece device (hereinafter referred to as a timepiece) 100*f* is an analog display timepiece, for example. In FIG. 13, the timepiece 100*f* includes a photovoltaic cell 1, a secondary battery 2, a timepiece control unit 5, and a power consumption control device 20*f*.

The power consumption control device 20*f* controls the power of the timepiece 100*f*. The power consumption control device 20*f* outputs a power saving-mode signal to the timepiece control unit 5 based on the state of the photovoltaic cell 1 and the state of the secondary battery 2. Moreover, the power consumption control device 20*f* includes a power consumption control unit 10*f*, a voltage detection unit 8, a charging detection and backflow prevention unit (charging detection unit) 9*b*, and a photovoltaic cell load unit 13. An oscillation prevention unit (not shown) includes the photovoltaic cell load unit 13.

The power consumption control device 20*f* (FIG. 13) of the sixth embodiment is different from the power consumption control device 20*b* (FIG. 6) of the second embodiment in that the power consumption control unit 10 is changed to the power consumption control unit 10*f*, and the photovoltaic cell load unit 13 is added.

The photovoltaic cell (primary power supply unit) 1 has a positive terminal connected to a power supply line VDD and a negative terminal connected to a power supply line SVSS. Moreover, the negative terminal of the photovoltaic cell 1 is connected to the charging detection and backflow prevention unit 9*b*. The photovoltaic cell 1 includes a panel generating an electromotive force and generates an electromotive force when the panel is exposed light. The photovoltaic cell 1 charges the secondary battery 2 through the charging detection and backflow prevention unit 9*b*. Moreover, the photovoltaic cell 1 supplies electricity to respective units of the timepiece 100*f* through the power supply line VDD. Here, the power supply line VDD is the VDD-earth line, which represents the reference potential of the timepiece 100*f*.

The secondary battery (secondary power supply unit) 2 has a positive terminal connected to the power supply line VDD and a negative terminal connected to the power supply line VSS. Moreover, the negative terminal of the secondary battery 2 is connected to the charging detection and backflow prevention unit 9*b*. The secondary battery 2 is charged by the electromotive force of the photovoltaic cell 1 through the charging detection and backflow prevention unit 9*b*. Moreover, the secondary battery 2 supplies electricity to the respective units of the timepiece 100*f* through the power supply line VDD.

The battery voltage detection unit (detection unit) 8 detects whether the output voltage of the secondary battery 2 is not greater than a predetermined threshold value in response to a detection sampling signal supplied from the power consumption control unit 10*f*. The battery voltage detection unit 8 outputs a low-voltage detection signal to the power consumption control unit 10*f* as the detection result when the secondary battery 2 is detected to be in a state (low-voltage state) where the output voltage thereof is not greater than a predetermined threshold value. Specifically, the low-voltage detection signal is in the H state, for example, when the output voltage of the secondary battery 2 is not greater than the predetermined threshold value, and is in the L state, for example, when the output voltage of the secondary battery 2 is greater than the predetermined threshold value.

Moreover, the predetermined threshold value is a value greater by a predetermined voltage than a lower-limit voltage in which the time motor can be driven. Moreover, the predetermined threshold value is greater than the output voltage of the secondary battery 2 in the over-discharged state. Here, for example, the over-discharged state means a state where the secondary battery 2 is consumed up to an operation limit voltage or less of the time motor so that the secondary battery 2 does not restore the operational voltage of the time motor immediately even when the secondary battery 2 is charged by the electromotive force of the photovoltaic cell 1.

The timepiece control unit 5 controls a clock operation of measuring time. The clock operation includes an operation of driving a time motor that moves the hands of the timepiece 100*f* that displays time. The timepiece control unit 5 stops or starts the driving of the time motor based on a power saving-mode signal supplied from the power consumption control unit 10*f*. Here, for example, the timepiece control unit 5 stops driving the time motor when the power saving-mode signal is in the H state. Moreover, for example, the timepiece control unit 5 drives the time motor when the power saving-mode signal is in the L (low) state.

The photovoltaic cell load unit (first load unit) 13 has a predetermined load and is connected to the positive terminal (the power supply line VDD) of the photovoltaic cell 1 and the negative terminal (the power supply line SVSS). Details of the predetermined load will be described later. The photovoltaic cell load unit (first load unit) 13 connected the predetermined load between the positive terminal and the negative terminal of the photovoltaic cell 1 based on a load control signal supplied from the power consumption control unit 10*f*. Specifically, when the load control signal is in the L state, the photovoltaic cell load unit 13 connects the predetermined load. Moreover, when the load control signal is in the H state, the photovoltaic cell load unit 13 disconnects the predetermined load.

Moreover, the photovoltaic cell load unit 13 includes a PMOS switch 131 and a load resistance 132.

The PMOS switch 131 is a switch such as a PMOS transistor (P-channel Metal Oxide Silicon Field-Effect Transistor), for example. The PMOS switch 131 has a source terminal connected to the power supply line VDD, a gate terminal connected to the signal line of the load control signal supplied from the power consumption control unit 10*f*, and a drain terminal connected to one end of the load resistance 132. The PMOS switch 131 connects the predetermined load to the photovoltaic cell 1 based on the load control signal supplied from the power consumption control unit 10*f*.

Specifically, when the load control signal is in the L state, the PMOS switch 131 creates a connected state between the power supply line VDD and one end of the load resistance 132 so as to connect the predetermined load to the photovoltaic cell 1. Moreover, when the load control signal is in the H state, the PMOS switch 131 creates a disconnected state between the power supply line VDD and one end of the load resistance 132 so as to disconnect the predetermined load from the photovoltaic cell 1.

The load resistance 132 is a well resistance formed in a semiconductor substrate or a resistance formed by a polysilicon resistance or the like, for example. The load resistance 132 has one end connected to the drain terminal of the PMOS switch 131 and the other end connected to the negative terminal (the power supply line SVSS) of the photovoltaic cell 1. The load resistance 132 has a predetermined resistance value, and a predetermined load is applied between the positive terminal and the negative terminal of the photovoltaic cell 1 by this resistance value.

Here, the predetermined resistance value is determined based on the relationship between the electromotive force and the intensity of light irradiated to the panel (solar panel) of the photovoltaic cell 1 that generates the electromotive force.

For example, it is assumed that an electromotive force sufficient for operating a normal operation state (clock operation state) described later is obtained when the photovoltaic cell 1 is exposed to light of intensity of 500 Lux or more. In this case, the predetermined resistance value is set so that the output voltage of the photovoltaic cell 1 under the intensity of 500 Lux exceeds the predetermined threshold value described above. The predetermined load is determined by the predetermined resistance value. Thus, in other words, the predetermined load is determined based on the relationship between the intensity of light and the electromotive force.

In addition, the output current of the photovoltaic cell 1 depends on the area of the panel. Thus, the predetermined resistance value is determined based on the relationship between the area of the panel and the electromotive force. That is, the predetermined load is determined based on the area of the panel and the electromotive force.

The power consumption control unit 10*f* determines whether the output voltage (output potential difference) of the secondary battery 2 is less than the predetermined threshold value described above based on the detection result by the battery voltage detection unit 8. Moreover, the power consumption control unit 10*f* determines whether the secondary battery 2 is in the non-charging state indicating a state where the output voltage (output potential difference) of the photovoltaic cell 1 is not greater than the output voltage (output potential difference) of the secondary battery 2 based on the detection result (charging detection signal) by the charging detection and backflow prevention unit 9*b*.

When the secondary battery 2 is in the non-charging state, and the output voltage of the secondary battery 2 is less than the predetermined threshold value, the power consumption control unit 10*f* outputs the H state to the power saving-mode signal. In this way, the power consumption control unit 10*f* causes the timepiece control unit 5 to transition to a power saving state where the clock operation of measuring time is stopped. That is, when the secondary battery 2 is in the non-charging state, the power consumption control unit 10*f* decreases the power consumption by a second load unit (in this example, the timepiece control unit 5 and the time motor).

Moreover, when the secondary battery 2 is in the non-charging state, and the output voltage of the secondary battery 2 is not greater than a predetermined threshold value, the power consumption control unit 10*f* outputs the L state to the load control signal. That is, when causing the timepiece 100*f* to transition to the power saving state, the power consumption control unit 10*f* outputs the L state to the load control signal. That is, when the timepiece 100*f* is in the power saving state, the power consumption control unit 10*f* causes the photovoltaic cell load unit 13 to connect the predetermined load described above to the photovoltaic cell 1.

Moreover, when the timepiece 100*f* is in the power saving state, the power consumption control unit 10*f* determines whether the secondary battery 2 is in the non-charging state based on the detection result (the charging detection signal) by the charging detection and backflow prevention unit 9*b*. The power consumption control unit 10*f* outputs the L state to the power saving-mode signal when the secondary battery 2 is not in the non-charging state. In this way, the power consumption control unit 10*f* causes the timepiece control unit 5 to transition from the power saving state to the normal operation state (clock operation state) where the clock operation is performed. Here, the normal operation state (the clock operation state) means a state where the timepiece control unit 5 drives the time motor. That is, when the secondary battery 2 is not in the non-charging state, the power consumption control unit 10*f* releases the power saving state of the timepiece control unit 5. That is, the power consumption control unit 10*f* releases the power saving state based on the output voltage of the photovoltaic cell 1 to which the predetermined load is connected.

Moreover, when the secondary battery 2 is not in the non-charging state, the power consumption control unit 10*f* outputs the L state to the load control signal. That is, when the power saving state is released, the power consumption control unit 10*f* outputs the L state to the load control signal. That is, when the power saving state is released, the power consumption control unit 10*f* causes the photovoltaic cell load unit 13 to disconnect the predetermined load described above from the photovoltaic cell 1.

The power consumption control unit 10*f* supplies the detection sampling signal to the battery voltage detection unit 8 as a trigger signal for detecting the output voltage of the secondary battery 2.

The predetermined load is, for example, a load of which the power consumption is larger than the power consumption (or the maximum power consumption) by the second load unit (the timepiece control unit 5 and the time motor) when the output voltage of the secondary battery 2 is the same as the predetermined threshold value described above, and the power saving state is released. That is, when the output voltage of the secondary battery 2 is the same as the predetermined threshold value, a larger amount of current flows through the predetermined load than the current consumed by the timepiece control unit 5 and the time motor. Thus, in order to release the power saving state, it is necessary for the photovoltaic cell 1 to generate an electromotive force so that the load consumes a larger amount of power than the power consumption by the inclination correction means 5 and the time motor in the normal operation state, and the output voltage of the photovoltaic cell 1 is greater than the predetermined threshold value.

The charging detection and backflow prevention unit 9*b* detects a non-charging state indicating a state where the output voltage of the photovoltaic cell 1 is not greater than the output voltage of the secondary battery 2. The charging detection and backflow prevention unit 9*b* outputs a charging detection signal to the power consumption control unit 10*f* as the detection result when the non-charging state is detected. Specifically, the charging detection signal is in the L state when the secondary battery 2 is in the non-charging state. Moreover, the charging detection signal is in the H state when the secondary battery 2 is in a charging state indicating a state where the output voltage of the photovoltaic cell 1 is greater than the output voltage of the secondary battery 2.

Moreover, when the secondary battery 2 is in the non-charging state, the charging detection and backflow prevention unit 9*b* cuts the connection between a power supply line SVSS connected to the negative terminal of the photovoltaic cell 1 and the power supply line VSS connected to the negative terminal of the secondary battery 2. With this configuration, the charging detection and backflow prevention unit 9*b* prevents current from back-flowing from the secondary battery 2 to the photovoltaic cell 1.

Moreover, the charging detection and backflow prevention unit 9*b* includes a comparator 91, an NMOS switch 92, and a diode element 63.

The comparator 91 has an input terminal of which one end is connected to the power supply line SVSS connected to the negative terminal of the photovoltaic cell 1 and of which the other end is connected to the power supply line VSS connected to the negative terminal of the secondary battery 2. Moreover, the output of the comparator 91 is the charging detection signal. The comparator 91 compares the output voltage of the photovoltaic cell 1 with the output voltage of the secondary battery 2 and outputs a signal (charging detection signal) indicating the non-charging state when the secondary battery 2 is in the non-charging state where the output voltage of the photovoltaic cell 1 is not greater than the output voltage of the secondary battery 2. When the output voltage of the photovoltaic cell 1 is not greater than the output voltage of the secondary battery 2 (the secondary battery 2 is in the non-charging state), the comparator 91 outputs the L state to the power consumption control unit 10*f* as the charging detection signal. Moreover, when the output voltage of the photovoltaic cell 1 is greater than the output voltage of the secondary battery 2 (the secondary battery 2 is in the charging state), the comparator 91 outputs the H state to the power consumption control unit 10*f* as the charging detection signal.

The NMOS switch (switching unit) 92 is a switch such as an NMOS transistor (N-channel Metal Oxide Silicon Field-Effect Transistor), for example. The NMOS switch 92 has a source terminal connected to the cathode terminal of a diode element 63, a drain terminal connected to the power supply line SVSS, and a gate electrode connected to the output terminal of the comparator 91. The anode terminal of the diode element 63 is connected to the power supply line VSS. The NMOS switch 92 cuts the connection between the power supply line VSS and the power supply line SVSS when the output of the comparator 91 is in the L state (non-charging state). In this way, the NMOS switch 92 prevents current from back-flowing from the secondary battery 2 to the photovoltaic cell 1. Moreover, the NMOS switch 92 connects the power supply line VSS and the power supply line SVSS when the output of the comparator 91 is in the H state (charging state). In this way, the electromotive force of the photovoltaic cell 1 is charged to the secondary battery 2.

The diode element 63 prevents chattering occurring in the output of the comparator 91 during the comparison by the comparator 91. The chattering is a phenomenon in which when the output voltage of the photovoltaic cell 1 is near the output voltage of the secondary battery 2, since the two input potentials being compared have values close to each other, the output of the comparator 91 oscillates.

The diode element 63 has an anode terminal connected to the power supply line VSS and the cathode terminal connected to the source terminal of the NMOS switch 92. That is, the diode element 63 is disposed in series to the NMOS switch 92 so that when the secondary battery 2 is not in the non-charging state (the NMOS switch 92 is in the conduction state), a forward bias is applied between the negative terminal of the secondary battery 2 and the negative terminal of the photovoltaic cell 1. Moreover, the diode element 63 generates a predetermined prescribed potential difference between the two input terminals (the negative terminal of the secondary battery 2 and the negative terminal of the photovoltaic cell 1) subjected to the comparison in the comparator 91. Here, the predetermined prescribed potential difference is a forward voltage drop (VF) of the diode element 63. Moreover, the predetermined prescribed potential difference is appropriately set in accordance with a potential difference in which the output of the comparator 91 chatters. Here, the predetermined prescribed potential difference is 0.3 V (volt), for example.

Next, the operation of the timepiece 100*f* of the sixth embodiment will be described.

First, an operation of the timepiece 100*f* and the power consumption control device 20*f* relating to the photovoltaic cell load unit 13 will be described.

When the timepiece 100*f* and the power consumption control device 20*f* are in the power saving state, the power consumption control unit 10*f* output the L state to the load control signal and puts the load resistance 132 of the photovoltaic cell load unit 13 into the ON state. That is, the power consumption control unit 10*f* outputs the L state to the load control signal and puts the PMOS switch 131 into the conduction state (ON state) so that a predetermined load (in this example, the load resistance 132) is connected to the photovoltaic cell 1. In this way, the electromotive force of the photovoltaic cell 1 is first consumed by the photovoltaic cell load unit 13. When the timepiece 100*f* is in the power saving state, the NMOS switch 63 of the charging detection and backflow prevention unit 9*b* is in the non-conduction state. Thus, the photovoltaic cell load unit 13 does not affect the power consumption of the secondary battery 2.

In the power saving state, when the photovoltaic cell 1 is exposed to light, and the photovoltaic cell 1 generates an electromotive force, power is consumed by the photovoltaic cell load unit 13. Thus, the output voltage of the photovoltaic cell 1 is not greater than the output voltage of the secondary battery 2 until the photovoltaic cell 1 generates an electromotive force sufficiently larger than the power consumption by the predetermined load of the photovoltaic cell load unit 13. Therefore, when the panel of the photovoltaic cell 1 is exposed to light of an intensity sufficiently large for the timepiece 100*f* to perform the clock operation, the output voltage of the photovoltaic cell 1 becomes greater than the output voltage of the secondary battery 2. In this way, the comparator 91 of the charging detection and backflow prevention unit 9*b* outputs the H state to the power consumption control unit 10*f* as the charging detection signal.

The power consumption control unit 10*f* causes the timepiece control unit 5 to transition from the power saving state to the normal operation state where the clock operation is performed based on the H state of the charging detection signal output from the charging detection and backflow prevention unit 9*b*. That is, the power consumption control unit 10*f* releases the power saving state based on the output voltage of the photovoltaic cell 1 to which the predetermined load is connected.

Moreover, when the power saving state is released, the power consumption control unit 10*f* outputs the H state to the load control signal and puts the load resistance 132 of the photovoltaic cell load unit 13 into the OFF state. In this way, the photovoltaic cell load unit 13 disconnects the predetermined load (in this example, the load resistance 132) from the photovoltaic cell 1.

In the normal operation state, since the load resistance 132 is not connected from the photovoltaic cell 1, the electromotive force generated by the photovoltaic cell 1 is consumed by the charging of the secondary battery 2 and the timepiece control unit 5 and the time motor. In this case, since the photovoltaic cell 1 generates an electromotive force sufficiently large for the timepiece 100*f* to perform the clock operation, the timepiece 100*f* may not immediately transition to the power saving state again.

Subsequently, a power consumption control process in the timepiece 100*f* and the power consumption control device 20*f* will be described with reference to the flowchart shown in FIG. 14.

Figure 14:
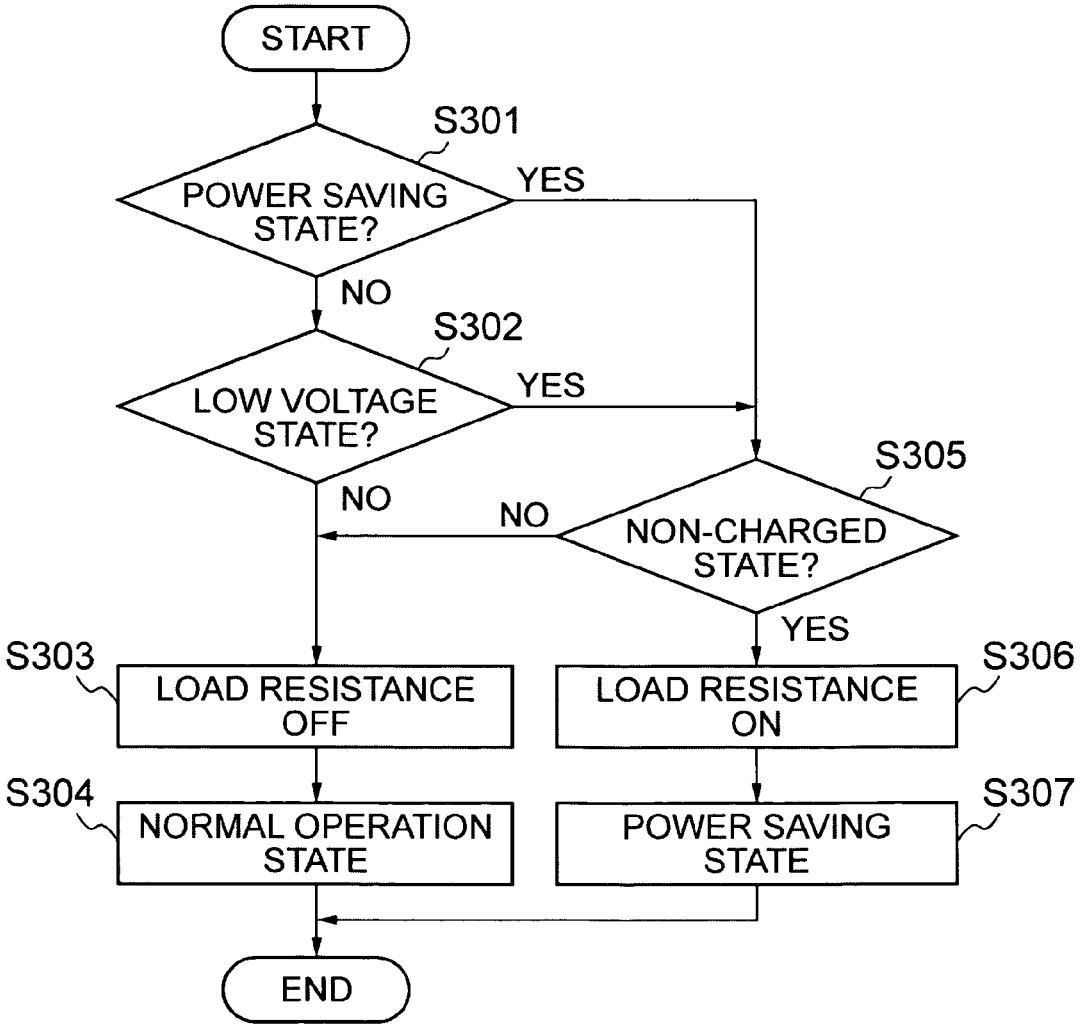
FIG. 14 is a flowchart showing a power supply control process in the sixth embodiment.

FIG. 14 is a flowchart showing the power consumption control process in the sixth embodiment.

In the power consumption control process of the timepiece 100*f* and the power consumption control device 20*f*, first, the power consumption control unit 10*f* determines whether the timepiece 100*f* is in the power saving state (step S301). In step S301, the power consumption control unit 10*f* proceeds to step S305 when the timepiece 100*f* is in the power saving state, and proceeds to step S302 when the timepiece 100*f* is not in the power saving state (be in the normal operation state).

Subsequently, in step S302, the power consumption control unit 10*f* determines whether the output voltage of the secondary battery 2 is not greater than the predetermined threshold value based on the detection result by the voltage detection unit 8. That is, the power consumption control unit 10*f* determines whether the output voltage of the secondary battery 2 is not greater than the predetermined threshold value based on the low-voltage detection signal output from the voltage detection unit 8. Here, the low-voltage detection signal is in the H state when the output voltage of the secondary battery 2 is not greater than the predetermined threshold value. Moreover, the low-voltage detection signal is in the L state when the output voltage of the secondary battery 2 is greater than the predetermined threshold value.

Moreover, in step S302, the power consumption control unit 10*f* proceeds to step S305 when the output voltage of the secondary battery 2 is not greater than the predetermined threshold value (the secondary battery 2 is in the low-voltage state) and proceeds to step S303 when the output voltage of the secondary battery 2 is greater than the predetermined threshold value.

Subsequently, in step S303, the power consumption control unit 10*f* puts the load resistance 132 of the photovoltaic cell load unit 13 in the OFF state. That is, the power consumption control unit 10*f* outputs the H state to the load control signal so as to put the PMOS switch 131 into the non-conduction state (OFF state). In this way, the load resistance 132 is disconnected from the positive terminal (the power supply line VDD) of the photovoltaic cell 1. That is, the power consumption control unit 10*f* disconnects the predetermined load (in this example, the load resistance 132) from the photovoltaic cell 1.

Subsequently, the power consumption control unit 10*f* puts the power saving-mode signal into the L state to cause the timepiece control unit 5 to be released from the power saving state and transition to the normal operation state (alternatively, the timepiece control unit 5 is caused to be kept in the normal operation state) (step S304). In addition, in step S303, since the photovoltaic cell load unit 13 is disconnected from the photovoltaic cell 1, the electromotive force generated by the photovoltaic cell 1 is not consumed by the photovoltaic cell load unit 13. That is, the electromotive force generated by the photovoltaic cell 1 is consumed by the charging of the secondary battery 2 and the timepiece control unit 5 and the time motor.

After the process of step S304 is finished, the power consumption control unit 10*f* ends the power consumption control process.

On the other hand, in step S305, the power consumption control unit 10*f* determines whether the secondary battery 2 is in the non-charging state based on the detection result (the charging detection signal) by the charging detection and backflow prevention unit 9*b*. Here, the low-voltage detection signal is in the L state when the secondary battery 2 is in the non-charging state. Moreover, the low-voltage detection signal is in the H state when the secondary battery 2 is not in the non-charging state (to be in the charging state).

Moreover, in step S305, the power consumption control unit 10*f* proceeds to step S306 when the secondary battery 2 is in the non-charging state and proceeds to step S303 when the secondary battery 2 is not in the non-charging state (to be in the charging state).

Since the load resistance 132 is connected to the photovoltaic cell 1 by the photovoltaic cell load unit 13, the charging detection and backflow prevention unit 9*b* does not output the H state to the charging detection signal until the photovoltaic cell 1 generates an electromotive force sufficiently larger than the power consumption by the predetermined load of the photovoltaic cell load unit 13. That is, in step S305, when the power consumption control unit 10*f* determines that the secondary battery 2 is not in the non-charging state (to be in the charging state), it means that the panel of the photovoltaic cell 1 is exposed to light of an intensity sufficiently large for the timepiece 100*f* to perform the clock operation.

Subsequently, in step S306, the power consumption control unit 10*f* puts the load resistance 132 of the photovoltaic cell load unit 13 into the ON state. That is, the power consumption control unit 10*f* outputs the L state to the load control signal and puts the PMOS switch 131 into the conduction state (ON state). In this way, the load resistance 132 is connected to the positive terminal (the power supply line VDD) of the photovoltaic cell 1. That is, the power consumption control unit 10*f* connects the predetermined load (in this example, the load resistance 132) to the photovoltaic cell 1.

Subsequently, the power consumption control unit 10*f* puts the power saving-mode signal into the H state so as to cause the timepiece control unit 5 to transition from the normal operation state to the power saving state (alternately, the timepiece control unit 5 is caused to be kept in the power saving state) (step S307). In step S306, since the photovoltaic cell load unit 13 is connected to the photovoltaic cell 1, when the photovoltaic cell 1 is exposed to light in this state, the electromotive force generated by the photovoltaic cell 1 is consumed by the photovoltaic cell load unit 13.

After the process of step S307 is finished, the power consumption control unit 10*f* ends the power consumption control process.

The power consumption control process of steps S301 to S307 is repeatedly performed on the power consumption control device 20*f*.

As described above, when the timepiece 100*f* and the power consumption control device 20*f* are in the power saving state where the power consumption by the timepiece control unit 5 and the time motor (which are the second load unit), the power consumption control unit 10*f* causes the photovoltaic cell load unit (the first load unit) 13 to connect the predetermined load (the load resistance 132) to the photovoltaic cell (primary power supply unit) 1. Moreover, the power consumption control unit 10*f* releases the power saving state based on the output voltage (output potential) of the photovoltaic cell 1 to which the predetermined load is connected.

With this configuration, the power saving state is not released until the photovoltaic cell 1 generates an electromotive force sufficiently larger than the power consumption by the predetermined load of the photovoltaic cell load unit 13. Thus, the timepiece 100*f* and the power transitioning repeatedly between the power saving state and the normal operation state when the electromotive force of the photovoltaic cell (primary power supply unit) 1 is not sufficient.

In some cases, the photovoltaic cell (primary power supply unit) may output a high voltage even when the solar panel is not sufficiently exposed to light. In the timepiece disclosed in JP-A-60-1587, even if the solar panel of the photovoltaic cell is not sufficiently exposed to light in the power saving state, the timepiece transitions from the power saving state to the normal operation state when a voltage is output from the photovoltaic cell. However, if the solar panel is not sufficiently exposed to light, the photovoltaic cell may not supply electricity sufficient large to operate the timepiece, so that the timepiece may transition to the power saving state again. Thus, in the timepiece disclosed in JP-A-60-1587, there is a problem in that the timepiece repeatedly transitions between the power saving state and the normal operation state.

That is, in the timepiece disclosed in JP-A-60-1587, there is a problem in that when the electromotive force of the primary power supply unit is not sufficient, the timepiece repeatedly transitions between the power saving state and the normal operation state. In contrast, in the timepiece 100*f* and the power consumption control device 20*f* of the present embodiment, it is possible to prevent repeated transition between the power saving state and the normal operation state when the electromotive force of the primary power supply unit is not sufficient as described above.

Moreover, when the power saving state is released, the power consumption control unit 10*f* causes the photovoltaic cell load unit (first load unit) 13 to disconnect the predetermined load (the load resistance 132) from the photovoltaic cell (primary power supply unit) 1.

With this configuration, when the timepiece 100*f* is in the normal operation state, since the predetermined load (the load resistance 132) is not connected to the photovoltaic cell 1, the electromotive force generated by the photovoltaic cell 1 is consumed by the charging of the secondary battery 2 and the timepiece control unit 5 and the time motor. Thus, when the timepiece 100*f* and the power consumption control device 20*f* are in the normal operation state, they can use the electromotive force generated by the photovoltaic cell 1 without being affected by the photovoltaic cell load unit 13.

According to the embodiment of the present invention, the power consumption control device 20*f* includes: the photovoltaic cell (primary power supply unit) 1 that generates an electromotive force; the photovoltaic cell load unit (first load unit) 13 that includes the predetermined load (the load resistance 132); and the power consumption control unit 10*f* that causes the photovoltaic cell load unit 13 to connect the predetermined load (the load resistance 132) to the photovoltaic cell 1 when the timepiece 100*f* is in the power saving state where the power consumption by the timepiece control unit 5 and the time motor (second load unit) is reduced, and releases the power saving state based on the output voltage (output potential) of the photovoltaic cell 1 to which the predetermined load is connected.

With this configuration, the power consumption control device 20*f* can prevent repeated transition between the power saving state and the normal operation state when the electromotive force of the photovoltaic cell (primary power supply unit) 1 is not sufficient.

Moreover, when the power saving state is released, the power consumption control unit 10*f* causes the photovoltaic cell load unit (first load unit) 13 to disconnect the predetermined load (the load resistance 132) from the photovoltaic cell (primary power supply unit) 1.

With this configuration, when the timepiece 100*f* is in the normal operation state, the power consumption control device 20*f* can use the electromotive force generated by the photovoltaic cell 1 without being affected by the photovoltaic cell load unit 13.

Moreover, the photovoltaic cell load unit (first load unit) 13 includes the PMOS switch (switching unit) 131 that connects the predetermined load (the load resistance) 132 to the photovoltaic cell (primary power supply unit) 1.

With this configuration, the photovoltaic cell load unit 13 can selectively connect the load resistance 132 to the photovoltaic cell 1. That is, the power consumption control device 20*f* can connect the load resistance 132 to the photovoltaic cell 1 when the timepiece 100*f* is in the power saving state and disconnect the load resistance 132 from the photovoltaic cell 1 when the timepiece 100*f* is in the normal operation state.

Moreover, the power consumption control device 20*f* includes the secondary battery (secondary power supply unit) 2 that is charged by the electromotive force of the photovoltaic cell 1, and the voltage detection unit (detection unit) 8 that detects whether the output voltage (output potential difference) of the secondary battery (secondary power supply unit) 2 is not greater than the predetermined threshold value. Moreover, the power consumption control unit 10*f* causes the timepiece 100*f* to transition to the power saving state when the detection result by the voltage detection unit 8 is not greater than the predetermined threshold value. Furthermore, the predetermined load is a load of which the power consumption is larger than the power consumption by the timepiece control unit 5 and the time motor (which are the second load unit) when the output voltage (output potential difference) of the secondary battery (secondary power supply unit) 2 is the same as the predetermined threshold value described above, and the power saving state is released.

Therefore, the predetermined load is determined so that the power consumption thereof is larger than the power consumption of the timepiece control unit 5 and the time motor at the minimum voltage of the secondary battery 2 in the normal operation state. Thus, the timepiece 100*f* can reliably transition to the normal operation state by the electromotive force of the photovoltaic cell 1 sufficiently large to prevent the timepiece 100*f* which has transitioned from the power saving state to the normal operation state from returning to the power saving state.

Moreover, the primary power supply unit is the photovoltaic cell 1, and the predetermined load is determined based on the relationship between the electromotive force and the intensity of light illuminated to the panel of the photovoltaic cell 1 that generates the electromotive force.

With this configuration, it is possible to determine the optimal predetermined load based on the capability of the photovoltaic cell 1 generating the electromotive force.

Moreover, the timepiece (timepiece device) 100*f* includes the power consumption control device 20*f* described above.

With this configuration, the timepiece (timepiece device) 100*f* can obtain the same effects as the power consumption control device 20*f*. That is, the timepiece (timepiece device) 100*f* can prevent repeated transition between the power saving state and the normal operation state when the electromotive force of the photovoltaic cell (primary power supply unit) 1 is not sufficient.

The present invention is not limited to the embodiment described above, but can be modified within a range not departing from the spirit of the present invention. In the above embodiment, although an example where the photovoltaic cell 1 is used as the primary power supply unit has been described, another primary power supply unit may be used. For example, an electricity generating element that converts thermal energy into electric energy may be used as the primary power supply unit, and an electricity generating device that converts kinetic into electric energy through electromagnetic induction may be used as the primary power supply unit.

Moreover, in the above embodiment, although an example where the secondary battery 2 is used as the secondary power supply unit has been described, a capacitor element may be used.

Moreover, in the above embodiment, although the power supply line VDD is described to be at the potential of VDD-earth, which represents the reference potential of the timepiece 100*f*, the power supply line VSS may be at the potential of VSS-earth, which represents the reference potential of the timepiece 100*f*.

Moreover, in the above embodiment, although the electronic device has been described to be a timepiece device as an example, the present invention may be applied to other electronic devices. Moreover, although an example in which the power consumption control device 20*f* is applied to a timepiece device has been described, the power consumption control device may be applied to other electronic devices. The other electronic devices may be an electronic desk calculator, an electronic dictionary, and the like, for example.

Moreover, in the above embodiment, although the timepiece 100*f* has been described to be an analog display timepiece, the timepiece 100*f* may be applied to a digital display timepiece and may be applied to a timepiece that has both analog and digital displays. When a digital display is present, the clock operation to be stopped is not limited to the hand movement operation by the time motor but may be an operation of displaying a digital time presentation on a liquid crystal display or the like.

Moreover, in the above embodiment, although the power saving state has been described to be a state where the clock operation is stopped, the power saving state may be another state if the power consumption by the second load unit is reduced. For example, the power saving state may be a state where a part of the functions of the timepiece control unit 5 is stopped, or a state where the clock signal for operating the timepiece control unit 5 is changed to a lower frequency.

Moreover, in the above embodiment, although an example in which the charging detection and backflow prevention unit 9*b* includes the NMOS switch 92 and the diode element 63 has been described, the charging detection and backflow prevention unit 9*b* may not include the diode element 63. Moreover, the charging detection and backflow prevention unit 9*b* may include the NMOS switch 92.

Moreover, in the above embodiment, although an example in which the photovoltaic cell load unit 13 includes the PMOS switch 131 and the load resistance 132 has been described, the present invention is not limited to this. For example, the photovoltaic cell load unit 13 may not include the load resistance 132, and the ON resistance of the PMOS switch 131 may be used as the predetermined load. In this case, it is possible to obtain an effect that the load resistance 132 is not necessary. Moreover, the photovoltaic cell load unit 13 may include a constant current source circuit such as a current mirror circuit instead of the load resistance 132. In this case, it is possible to obtain a stable load regardless of the output voltage of the photovoltaic cell 1.

Moreover, the conditions to transition from the power saving state to the normal operation state and the conditions to transition from the normal operation state to the power saving state are not limited to the above embodiment, but the transition may occur based on other conditions. For example, when the detection result by the voltage detection unit 8 is not greater than the predetermined threshold value, the power consumption control unit 10*f* may cause the transition from the normal operation state to the power saving state. Moreover, when the detection result by the voltage detection unit 8 is greater than the predetermined threshold value, the power consumption control unit 10*f* may cause the transition from the power saving state to the normal operation state. In this case, the voltage detected by the voltage detection unit 8 is the output voltage of the secondary battery 2 when the secondary battery 2 is in the non-charging state and is the voltage supplied from the photovoltaic cell 1 across the power supply line VDD and the power supply line VSS through the charging detection and backflow prevention unit 9*b* when the secondary battery 2 is in the charging state.

Seventh Embodiment

Next, an electronic device (for example, a timepiece device) of a seventh embodiment will be described with reference to the drawings.

Figure 15:
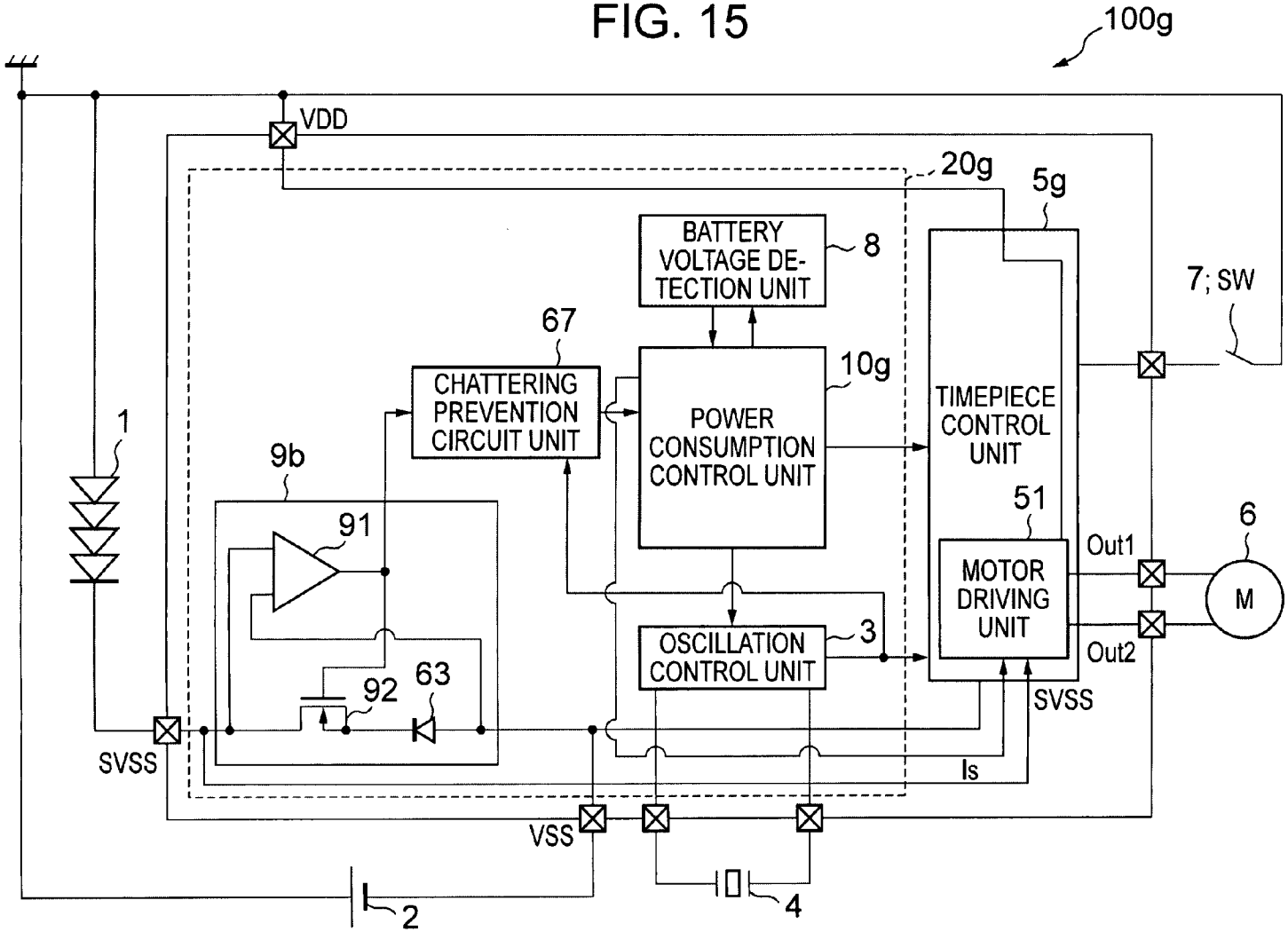
FIG. 15 is a simplified block diagram showing a configuration of a timepiece device according to a seventh embodiment.

FIG. 15 is a simplified block diagram showing a timepiece device 100*g* according to the seventh embodiment. The timepiece device (hereinafter referred to as a timepiece) 100*g* is an analog display timepiece, for example. In FIG. 15, the timepiece 100*g* includes a photovoltaic cell 1, a secondary battery 2, a quartz oscillator 4, a timepiece control unit 5*g*, a time motor 6, a switch 7, and a power consumption control device 20*g*. Moreover, the power consumption control device 20*g* includes an oscillation control unit 3, a battery voltage detection unit 8, a charging detection and backflow prevention unit (charging detection unit) 9*b*, a power consumption control unit 10*g*, and a chattering prevention circuit unit 67. Moreover, the timepiece control unit 5*g* includes a motor driving unit 51.

The timepiece 100*g* (FIG. 15) of the present embodiment is different from the timepiece 100 (FIG. 1) of the first embodiment in that the timepiece control unit 5 (FIG. 1) is changed to the timepiece control unit 5*g* (FIG. 15), the charging detection and backflow prevention unit 9 (FIG. 1) is changed to the charging detection and backflow prevention unit 9*b* (FIG. 15), and the power consumption control unit 10 (FIG. 1) is changed to the power consumption control unit 10*g* (FIG. 15). The other configurations are the same as those of the timepiece 100 shown in FIG. 1. Thus, the same configurations will be denoted by the same reference numerals, and redundant description thereof will not be provided.

Moreover, the charging detection and backflow prevention unit 9*b* is the same as the charging detection and backflow prevention unit 9*b* of the second embodiment, and description thereof will not be provided. In addition, the charging detection and backflow prevention unit 9*b* may be replaced with the charging detection and backflow prevention unit 9 of the first embodiment, the charging detection and backflow prevention unit 9*c* of the third embodiment, the charging detection and backflow prevention unit 9*d* of the fourth embodiment, or the charging detection and backflow prevention unit 9*e* of the fifth embodiment.

Moreover, the chattering prevention circuit unit 67 is the same as the chattering prevention circuit unit 67 of the third embodiment, and description thereof will not be provided.

The power consumption control unit 10*g* has the same function as the function of the power consumption control unit 10 of the first embodiment, and the load control signal of the power consumption control unit 10*f* of the sixth embodiment is added. The load control signal of the power consumption control unit 10*g* functions as a switching signal Is to the motor driving unit 51.

When causing the timepiece 100*g* to transition to the power saving state, the power consumption control unit 10*g* outputs the power saving-mode signal of the H state to the timepiece control unit 5*g* and outputs the switching signal Is of the H state to the motor driving unit 51 described later of the timepiece control unit 5*g*.

In this way, a resistance RS1 of the motor driving circuit 51 is inserted between the power supply line VDD and the power supply line SVSS. Moreover, the charging detection and backflow prevention unit 9*b* does not put the charging detection signal to be output to the chattering prevention circuit unit 67 into the H state until the photovoltaic cell 1 generates an electromotive force larger than the power consumption in the predetermined resistance RS1. In this way, the power consumption control unit 10*g* can cause the timepiece 100*g* to transition to the power saving state.

On the other hand, when the secondary battery 2 is determined to be in the charging state, the power consumption control unit 10*g* outputs the power saving-mode signal of the L state to the timepiece control unit 5*g* and outputs the switching signal Is of the L state to the motor driving unit 51 described later of the timepiece control unit 5*g*.

In this way, the resistance RS1 of the motor driving circuit 51 is removed between the power supply line VDD and the power supply line SVSS, and the power consumption control unit 10*g* can cause the timepiece 100*g* to transition from the power saving state to the normal operation state.

The timepiece control unit 5*g* has the same function as the timepiece control unit 5 of the first embodiment except the following respects. The timepiece control unit 5*g* includes the motor driving circuit 51.

The motor driving circuit 51 is connected to the power supply line VDD and the power supply line SVSS.

Moreover, the motor driving circuit 51 generates seven gate signals GS_j (j is an integer between 1 to 7) based on the switching signal Is input from the power consumption control unit 10*g*. Here, the gate signal GS_j is a voltage signal for selectively switching between a conduction state and an open state of the source and drain terminals of the respective switches.

Moreover, the motor driving circuit 51 selectively inserts or removes the resistance RS1 between the power supply line VDD and the power supply line SVSS based on the generated gate signal GS_j.

Figure 16:
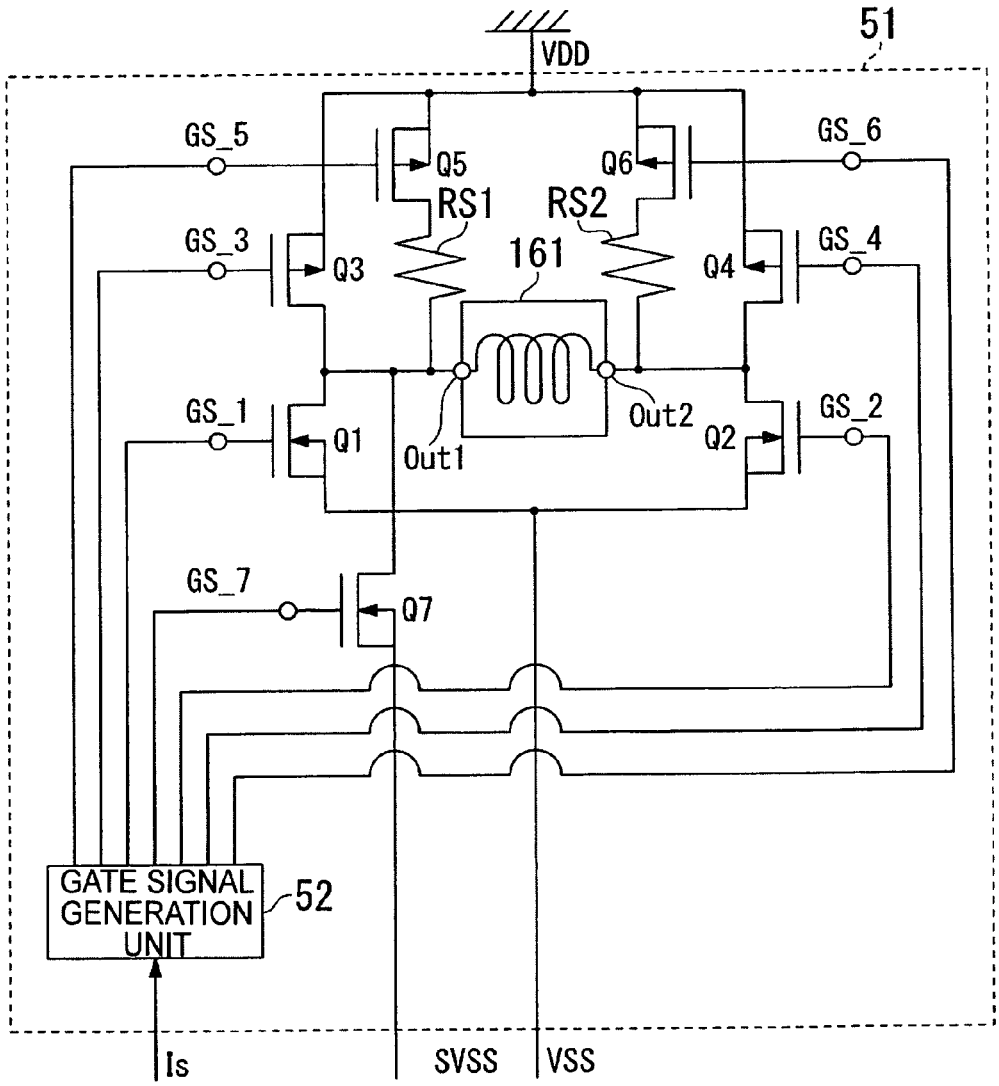
FIG. 16 is an exemplary circuit diagram of a motor driving circuit.

FIG. 16 is an exemplary circuit diagram of the motor driving circuit 51. The motor driving circuit 51 includes a gate signal generation unit 52, NMOS switches Q1, Q2, and Q7, PMOS switches Q3, Q4, Q5, and Q6, and resistances RS1 and RS2. In FIG. 16, both ends of a coil 161 of the time motor 6 are respectively connected to the output terminals Out1 and Out2 of the motor driving circuit 51.

Moreover, a first load unit (not shown) of the motor driving circuit 51 includes the PMOS switch Q5, the NMOS switch Q7, and the resistance RS1. Moreover, an oscillation prevention unit (not shown) includes the first load unit (not shown). The oscillation prevention unit prevents oscillation of the charging detection signal.

When the switching signal Is is in the H state, the gate signal generation unit 52 puts a gate signal GS_5 to be output to the gate terminal of the PMOS switch Q5 into the L state and puts a gate signal GS_7 to be output to the gate terminal of the NMOS switch Q7 into the H state. In this way, the gate signal generation unit 52 can create the ON state (conduction state) between the source and drain terminals.

When the switching signal Is is in the H state, the gate signal generation unit 52 generates the respective gate signals so that the OFF state (open state) is created between the source and drain terminals of the other switches. Specifically, the gate signal generation unit 52 puts the gate signals GS_1 and GS_2 to be output to the NMOS switches Q1 and Q2, respectively, into the L state, and puts the gate signals GS_3, GS_4, and GS_6 to be output to the PMOS switches Q3, Q4, and Q6, respectively, into the H state.

Moreover, the gate signal generation unit 52 outputs the generated gate signals GS_j to the gate terminals of the respective switches Qj.

In this way, the gate signal generation unit 52 puts the source and drain terminals of the PMOS switch Q5 and the NMOS switch Q7 into the ON state (conduction state) and puts the source and drain terminals of the other switches into the OFF state (open state). As a result, the motor driving circuit 51 can insert the resistance RS1 as the load resistance between the power supply line VDD and the power supply line SVSS.

When the switching signal Is is in the L state, the gate signal generation unit 52 puts the source and drain terminals of the respective switches Qj into the OFF state (open state). As a result, the motor driving circuit 51 can remove the resistance RS1 inserted between the power supply line VDD and the power supply line SVSS.

Moreover, the gate signal generation unit 52 generates the respective gate signals GS_j based on predetermined rules (for example, rules determined for the hand movement operation). Moreover, the gate signal generation unit 52 outputs the respective gate signals GS_j to the gate terminals of the switches Qj of the same j. Here, a switch Qj represents the j-th switch of the motor driving circuit 51, and for example, the 1st switch Q1 means the NMOS switch Q1. The predetermined rules will be described later.

In this way, the gate signal generation unit 52 can switch the operation states of the respective switches (for example, a braking state, a first driving state, a first induced voltage detection state, a second driving state, and a second induced voltage detection state).

The NMOS switch Q1 is, for example, a switch such as an NMOS transistor. The NMOS switch Q1 has a source terminal connected to the power supply line VSS, a drain terminal connected to the output terminal Out1, and the gate terminal connected to the gate signal generation unit 52.

The NMOS switch Q1 electrically connects between the power supply line VSS and the output terminal Out1 when the gate signal GS_1 input from the gate signal generation unit 52 is in the H state, that is, the secondary battery 2 is in the non-charging state. In this way, current output from the secondary battery VSS is supplied to the output terminal Out1.

On the other hand, the NMOS switch Q1 cuts the connection between the power supply line VSS and the output terminal Out1 when the gate signal GS_1 input from the gate signal generation unit 52 is in the L state. In this way, current output from the secondary battery VSS is prevented from being supplied to the output terminal Out1.

The NMOS switch Q2 is, for example, a switch such as an NMOS transistor. The NMOS switch Q2 has a source terminal connected to the power supply line VSS, a drain terminal connected to the output terminal Out2, and the gate terminal connected to the gate signal generation unit 52.

The NMOS switch Q2 electrically connects between the power supply line VSS and the output terminal Out2 when the gate signal GS_2 input from the gate signal generation unit 52 is in the H state. In this way, current output from the secondary battery VSS is supplied to the output terminal Out2.

On the other hand, the NMOS switch Q2 cuts the connection between the power supply line VSS and the output terminal Out2 when the gate signal GS_2 input from the gate signal generation unit 52 is in the L state. In this way, current output from the secondary battery VSS is prevented from being supplied to the output terminal Out2.

The PMOS switch Q3 is, for example, a switch such as a PMOS transistor. The PMOS switch Q3 has a source terminal connected to the power supply line VDD, a drain terminal connected to the output terminal Out1, and the gate terminal connected to the gate signal generation unit 52.

The PMOS switch Q3 electrically connects between the power supply line VDD and the output terminal Out1 when the gate signal GS_3 input from the gate signal generation unit 52 is in the L state. In this way, current is supplied from the output terminal Out1 to the power supply line VDD.

On the other hand, the PMOS switch Q3 cuts the connection between the power supply line VDD and the output terminal Out1 when the gate signal GS_3 input from the gate signal generation unit 52 is in the H state. In this way, current is prevented from being supplied from the output terminal Out1 to the power supply line VDD.

The PMOS switch Q4 is, for example, a switch such as a PMOS transistor. The PMOS switch Q4 has a source terminal connected to the power supply line VDD, a drain terminal connected to the output terminal Out2, and the gate terminal connected to the gate signal generation unit 52.

The PMOS switch Q4 electrically connects between the power supply line VDD and the output terminal Out2 when the gate signal GS_4 input from the gate signal generation unit 52 is in the L state. In this way, current is supplied from the output terminal Out2 to the power supply line VDD.

On the other hand, the PMOS switch Q4 cuts the connection between the power supply line VDD and the output terminal Out2 when the gate signal GS_4 input from the gate signal generation unit 52 is in the H state. In this way, current is prevented from being supplied from the output terminal Out2 to the power supply line VDD.

The PMOS switch Q5 is, for example, a switch such as a PMOS transistor. The PMOS switch Q5 has a source terminal connected to the power supply line VDD, a drain terminal connected to one end of the resistance RS1, and the gate terminal connected to the gate signal generation unit 52.

The PMOS switch Q5 electrically connects between the power supply line VDD and the resistance RS1 when the gate signal GS_5 input from the gate signal generation unit 52 is in the L state. In this way, current is supplied from the resistance RS1 to the power supply line VDD.

On the other hand, the PMOS switch Q5 cuts the connection between the power supply line VDD and the resistance RS1 when the gate signal GS_5 input from the gate signal generation unit 52 is in the H state. In this way, current is prevented from being supplied from the resistance RS1 to the power supply line VDD.

The PMOS switch Q6 is, for example, a switch such as a PMOS transistor. The PMOS switch Q6 has a source terminal connected to the power supply line VDD, a drain terminal connected to one end of the resistance RS2, and the gate terminal connected to the gate signal generation unit 52.

The PMOS switch Q6 electrically connects between the power supply line VDD and the resistance RS2 when the gate signal GS_6 input from the gate signal generation unit 52 is in the L state. In this way, current is supplied from the resistance RS2 to the power supply line VDD.

On the other hand, the PMOS switch Q6 cuts the connection between the power supply line VDD and the resistance RS2 when the gate signal GS_6 input from the gate signal generation unit 52 is in the H state. In this way, current is prevented from being supplied from the resistance RS2 to the power supply line VDD.

The NMOS switch Q7 is, for example, a switch such as an NMOS transistor. The NMOS switch Q7 has a source terminal connected to the power supply line SVSS, a drain terminal connected to the output terminal Out1, and the gate terminal connected to the gate signal generation unit 52.

The NMOS switch Q7 electrically connects between the power supply line SVSS and the output terminal Out1 when the gate signal GS_7 input from the gate signal generation unit 52 is in the H state. In this way, current is supplied from the power supply line SVSS to the output terminal Out1.

On the other hand, the NMOS switch Q7 cuts the connection between the power supply line SVSS and the output terminal Out1 when the gate signal GS_7 input from the gate signal generation unit 52 is in the L state. In this way, current is prevented from being supplied from the power supply line SVSS to the output terminal Out1.

Figure 17:
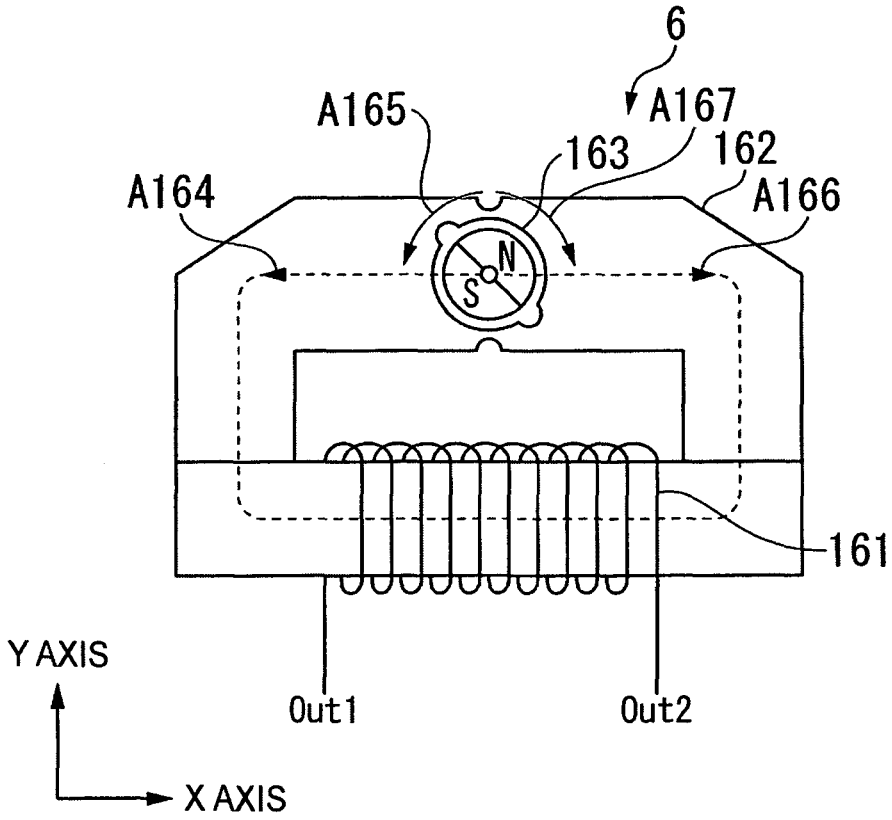
FIG. 17 is a diagram showing a simplified configuration of a motor in the seventh embodiment.

FIG. 17 is a diagram showing a simplified configuration of the time motor 6 of the seventh embodiment. The time motor 6 includes a coil 161, a conductor 162, and a rotor 163. In FIG. 17, it is assumed that the horizontal direction is the X axis, the vertical direction is the Y axis, the direction where the value of the X axis increases is the right side, and the direction where the value of the Y axis increases is the upper side.

The coil 161 has one end connected to the output terminal Out1 of the motor driving circuit and the other end connected to the output terminal Out2 of the motor driving circuit. The coil 161 causes the conductor 162 to generate a magnetic field in accordance with the current input from the motor driving circuit.

The conductor 162 rotates the rotor 163 in accordance with the direction of the magnetic field generated by the coil 161. Specifically, when current flows through the coil 161 in a direction from the output terminal Out1 to the output terminal Out2, a magnetic field is generated in the conductor 162 in the direction indicated by the arrow A164. Since the direction of the magnetic field in the rotor 163 is opposite to the direction of the magnetic field of the conductor 162, a repulsive force is produced in the rotor 163, and the rotor 163 rotates in the direction indicated by the arrow A165.

On the other hand, when current flows through the coil 161 in a direction from the output terminal Out2 to the output terminal Out1, a magnetic field is generated in the conductor 162 in the direction indicated by the arrow A166. Thus, the rotor 163 rotates in the direction indicated by the arrow A167 so that the direction of the magnetic field in the rotor 163 is the same as the direction of the magnetic field of the conductor 162.

Next, an example of the predetermined rules used when the switching signal Is is in the L state, and the gate signal generation unit 52 generates the gate signal GS_j will be described.

Figure 18:
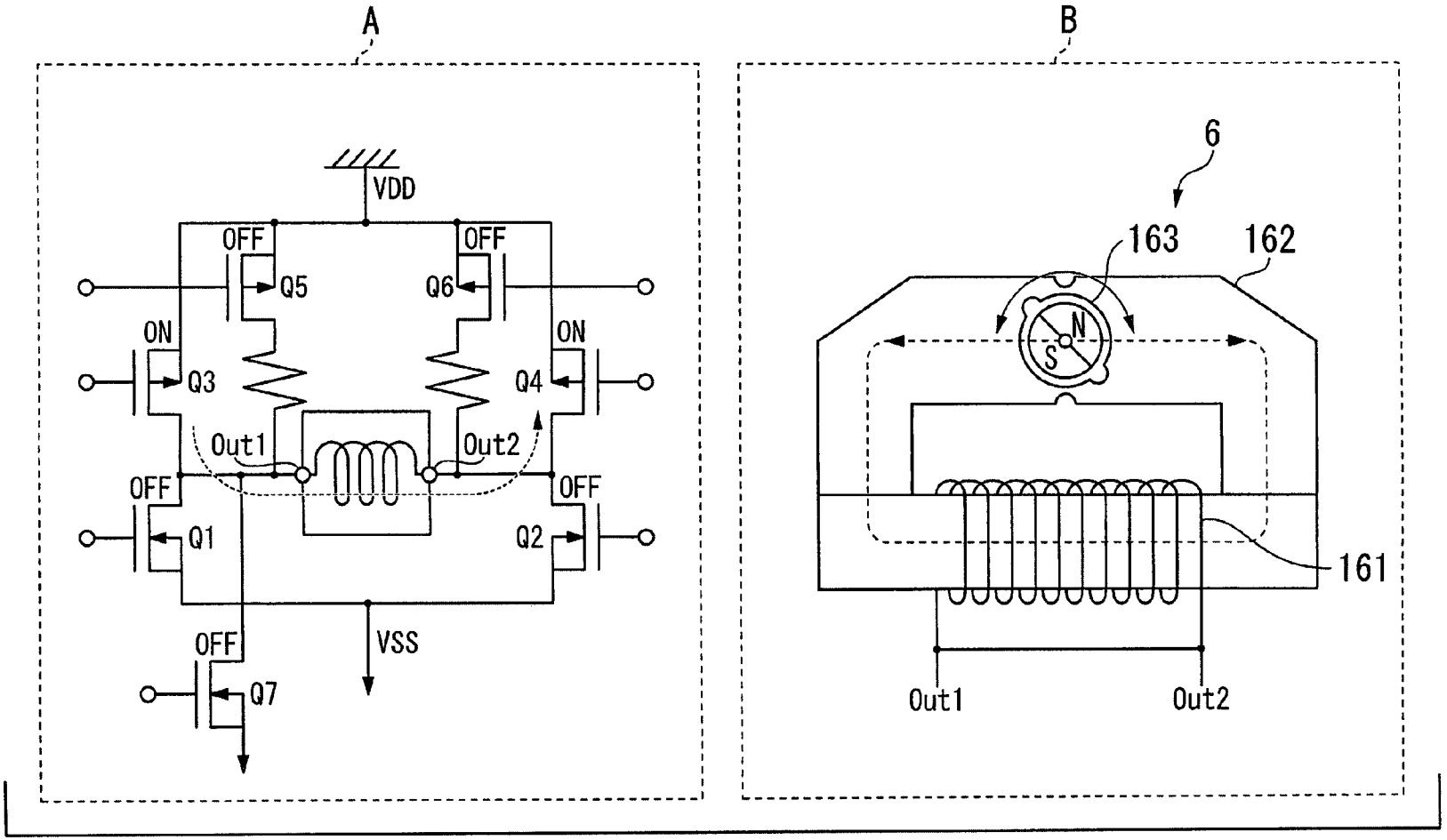
FIG. 18 (A and B) is a diagram illustrating the states of respective switches in a braking state and a rotation direction of a rotor of a motor at that time.

FIG. 18 (A and B) is a diagram illustrating the states of respective switches in a braking state and a rotation direction of the rotor 163 of the time motor 6 at that time. Portion A of FIG. 18 shows the states of the respective switches, and portion B of FIG. 18 shows the rotation direction of the rotor 163 at the states of the switches.

In portion A of FIG. 18, the PMOS switches Q3 and Q4 are in the ON state (conduction state), and the other switches are in the OFF state (open state).

The PMOS switches Q3 and Q4 are in the ON state, whereby both the output terminals Out1 and Out2 are electrically connected to the power supply line VDD, and the output terminals Out1 and Out2 are electrically connected.

In portion B of FIG. 18, similarly to portion A of FIG. 18, the output terminals Out1 and Out2 are electrically connected, whereby current flows through the coil 161 due to the magnetic field when the rotor 163 rotates, and current flows through the coil 161 in a direction to cancel the current. As a result, the current flowing in the canceling direction generates a magnetic field in the opposite direction to the magnetic field of the rotor 163. Moreover, the generated magnetic field causes a rotation force to occur in the rotor 163 in the opposite direction to the rotation direction of the rotor 163, whereby the rotation of the rotor 163 stops. That is, the motor driving unit 51 controls the rotor 163 so as to be kept at the position as it was.

Figure 19:
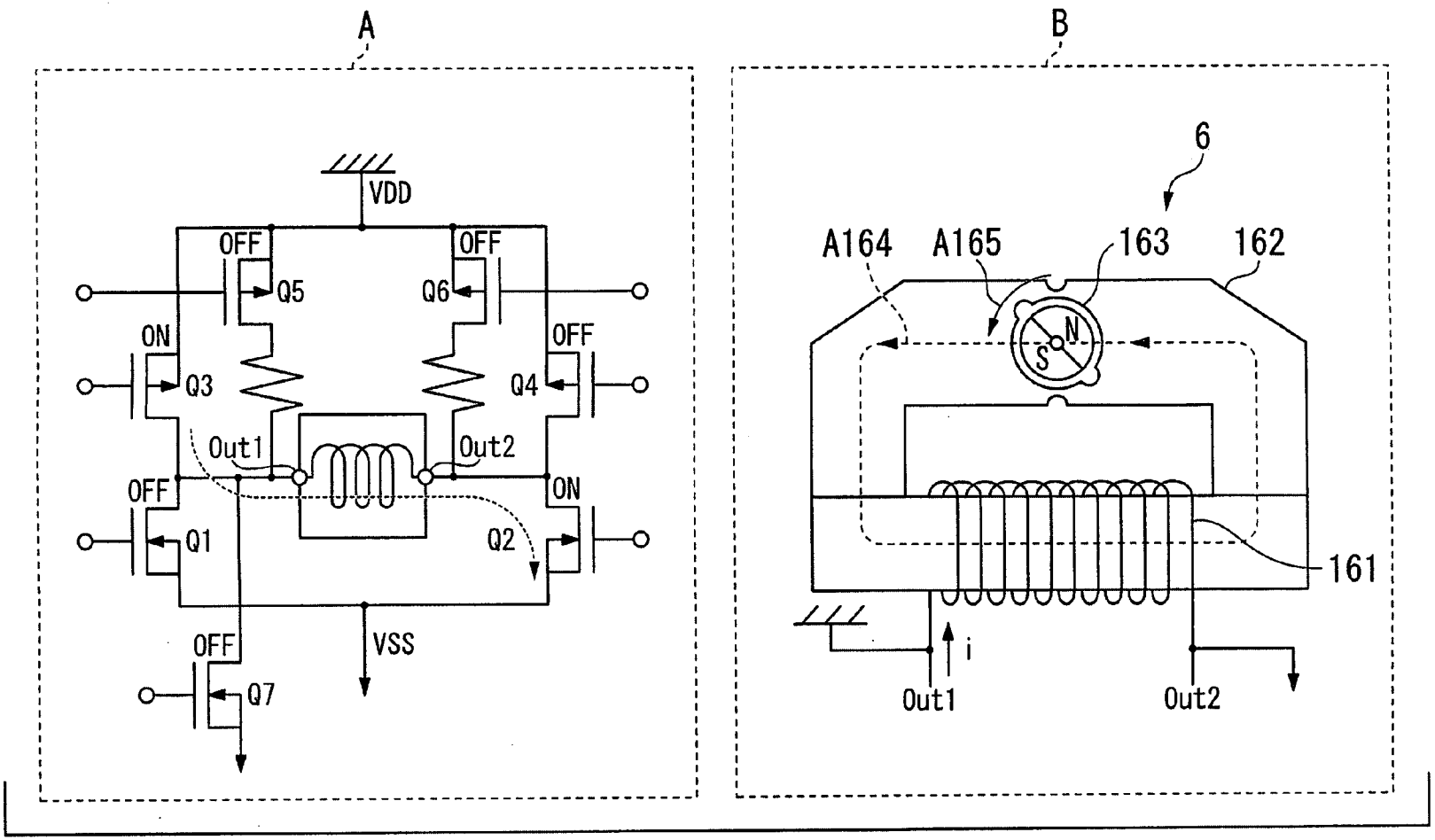
FIG. 19 (A and B) is a diagram illustrating the states of respective switches in a first driving state and a rotation direction of a rotor of a motor at that time.

FIG. 19 (A and B) is a diagram illustrating the states of respective switches in a first driving state and a rotation direction of the rotor 163 of the time motor 6 at that time. Portion A of FIG. 19 shows the states of the respective switches, and portion B of FIG. 19 shows the rotation direction of the rotor 163 at the states of the switches.

In portion A of FIG. 19, the NMOS switch Q2 and the PMOS switch Q3 are in the ON state (conduction state), and the other switches are in the OFF state (open state).

The NMOS switch Q2 and the PMOS switch Q3 are in the ON state, whereby current i flows from the output terminal Out1 to the output terminal Out2.

In portion B of FIG. 19, similarly to portion A of FIG. 19, the current i flows from the output terminal Out1 and the output terminal Out2, whereby the coil 161 causes the conductor 162 to generate a magnetic field in the direction indicated by the arrow A164. Since the direction (indicated by the arrow A164) of the magnetic field generated in the conductor 162 is opposite to the direction of the magnetic field in the rotor 163, a repulsive force is generated in the rotor 163, and the rotor 163 rotates in the direction indicated by the arrow A165.

Figure 20:
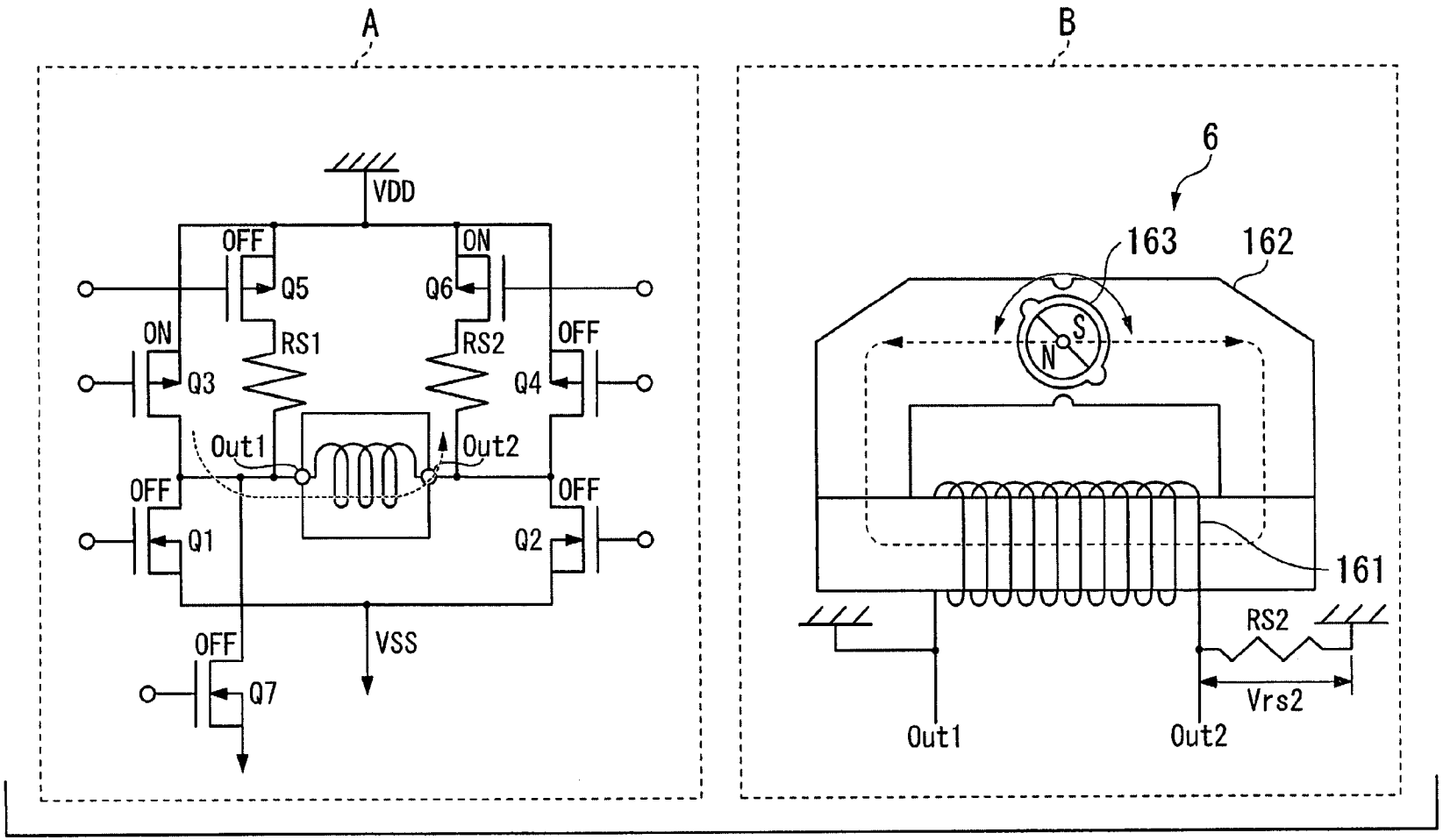
FIG. 20 (A and B) is a diagram illustrating the states of respective switches in a first induced voltage detection state and a rotation direction of a rotor of a motor at that time.

FIG. 20 (A and B) is a diagram illustrating the states of respective switches in a first induced voltage detection state and a rotation direction of the rotor 163 of the time motor 6 at that time. Portion A of FIG. 20 shows the states of the respective switches, and portion B of FIG. 20 shows the rotation direction of the rotor 163 at the states of the switches.

In portion A of FIG. 20, the PMOS switches Q3 and Q6 are in the ON state (conduction state), and the other switches are in the OFF state (open state).

The PMOS switches Q3 and Q6 are in the ON state, whereby the output terminal Out1 is electrically connected to the power supply line VDD, and the output terminal Out2 is electrically connected to the power supply line VDD through the resistance RS2.

In portion B of FIG. 20, when the switches are in the states shown on the left side of the figure, the rotor 163 rotates, whereby a magnetic field is generated in the conductor 162, and current flows through the coil 161 due to the magnetic field. The coil 161 supplies the generated current to the resistance RS2, and an induced voltage Vrs2 is generated in the resistance RS2. When the induced voltage Vrs2 exceeds a predetermined threshold value, the timepiece control unit 5*g* determines that the rotor 163 has rotated. On the other hand, when the induced voltage Vrs2 is not greater than the predetermined threshold value, the timepiece control unit 5*g* determines that the rotor 163 has not rotated.

Figure 21:
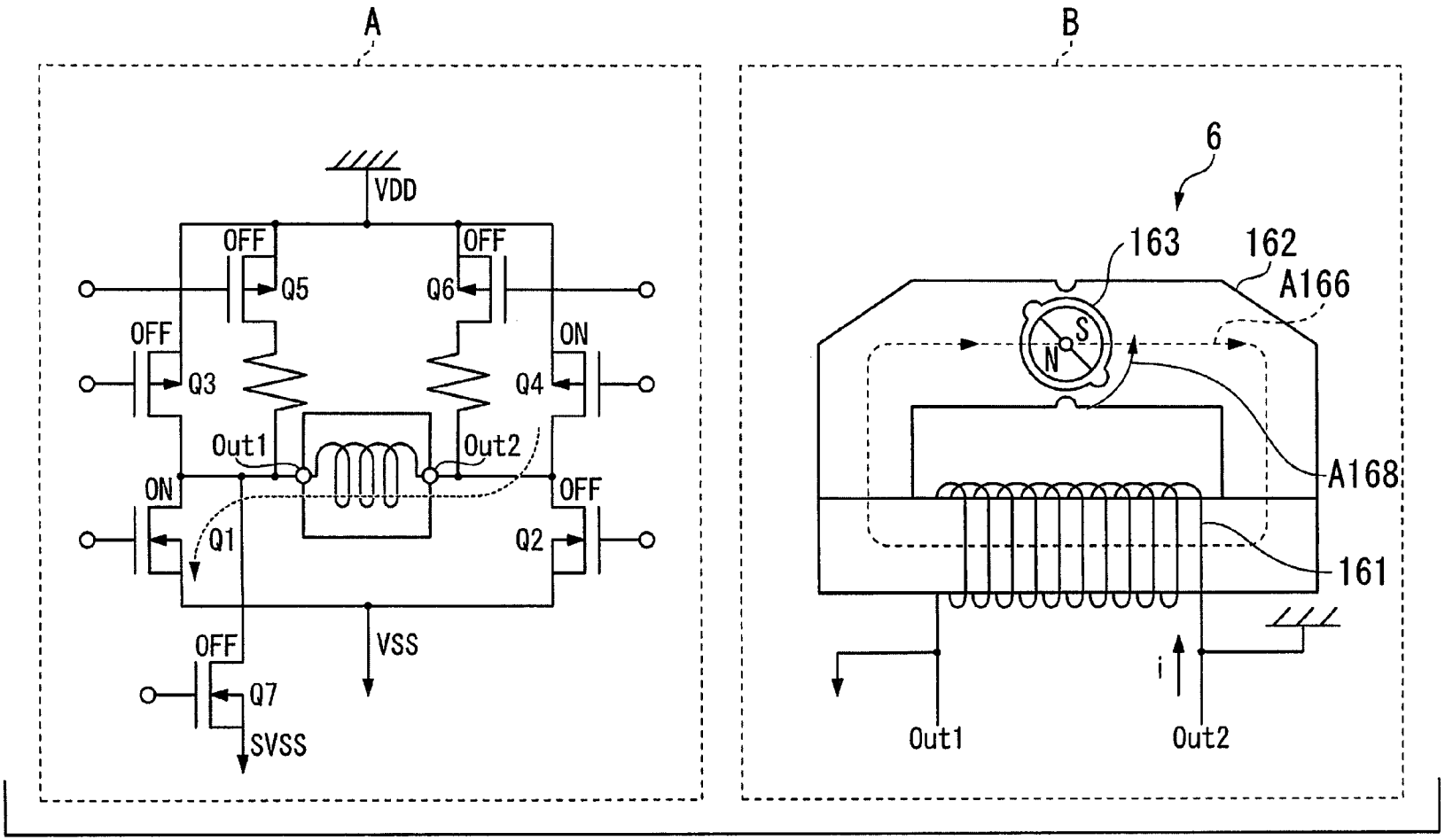
FIG. 21 (A and B) is a diagram illustrating the states of respective switches in a second driving state and a rotation direction of a rotor of a motor at that time.

FIG. 21 (A and B) is a diagram illustrating the states of respective switches in a second driving state and a rotation direction of the rotor 163 of the time motor 6 at that time. Portion A of FIG. 21 shows the states of the respective switches, and portion B of FIG. 21 shows the rotation direction of the rotor 163 at the states of the switches.

In portion A of FIG. 21, the NMOS switch Q1 and the PMOS switch Q4 are in the ON state (conduction state), and the other switches are in the OFF state (open state).

The NMOS switch Q1 and the PMOS switch Q4 are in the ON state, whereby current i flows from the output terminal Out2 to the output terminal Out1.

In portion B of FIG. 21, similarly to portion A of FIG. 21, the current i flows from the output terminal Out2 and the output terminal Out1, whereby the coil 161 causes the conductor 162 to generate a magnetic field in the direction indicated by the arrow A166. Since the direction (indicated by the arrow A166) of the magnetic field generated in the conductor 162 is opposite to the direction of the magnetic field in the rotor 163, a repulsive force is generated in the rotor 163, and the rotor 163 rotates in the direction indicated by the arrow A168.

Figure 22:
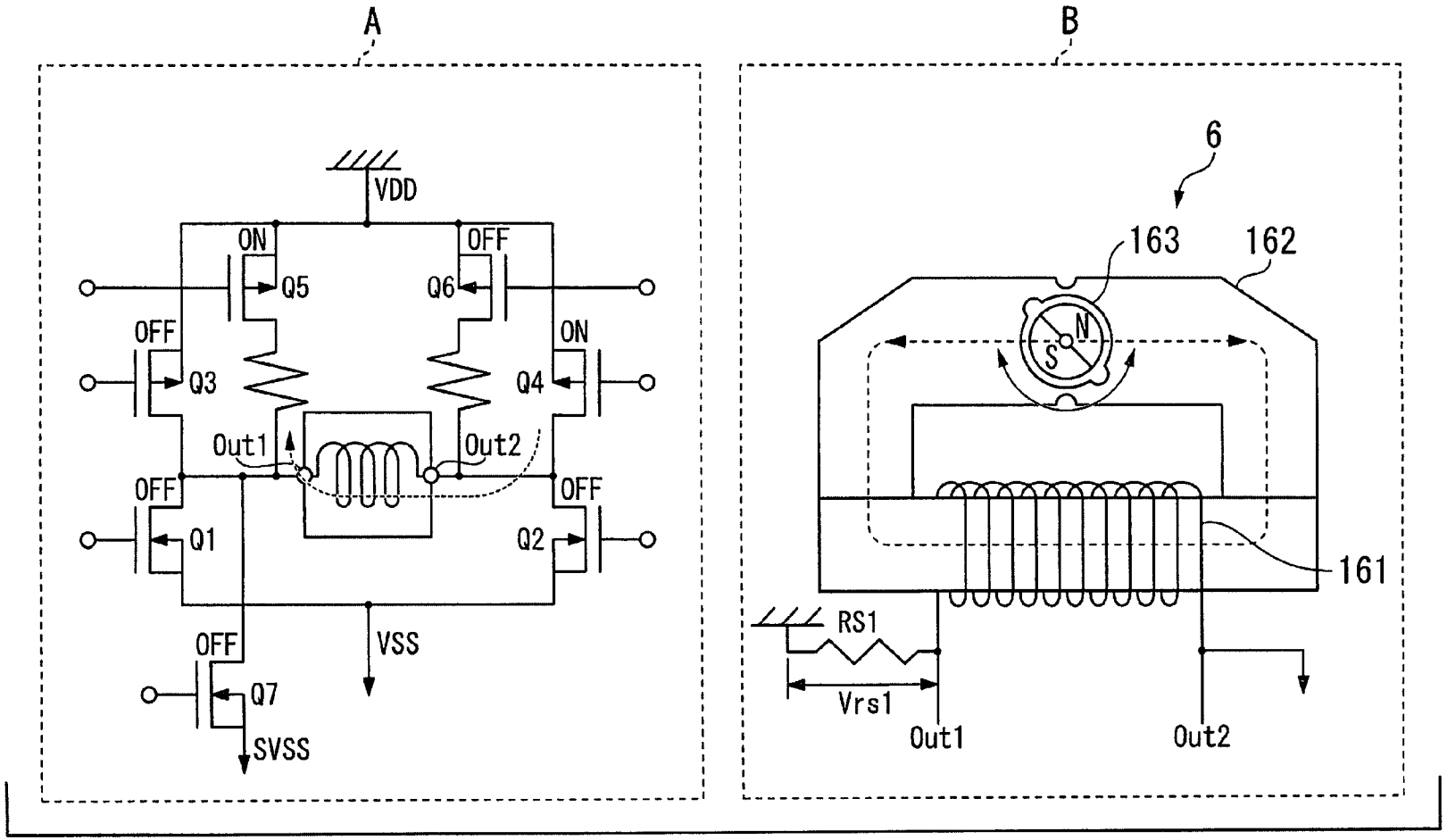
FIG. 22 (A and B) is a diagram illustrating the states of respective switches in a second induced voltage detection state and a rotation direction of a rotor of a motor at that time.

FIG. 22 (A and B) is a diagram illustrating the states of respective switches in a second induced voltage detection state and a rotation direction of the rotor 163 of the time motor 6 at that time. Portion A of FIG. 22 shows the states of the respective switches, and portion B of FIG. 22 shows the rotation direction of the rotor 163 at the states of the switches.

In portion A of FIG. 22, the PMOS switches Q4 and Q5 are in the ON state (conduction state), and the other switches are in the OFF state (open state).

The PMOS switches Q4 and Q5 are in the ON state, whereby the output terminal Out2 is electrically connected to the power supply line VDD, and the output terminal Out1 is electrically connected to the power supply line VDD through the resistance RS1.

In portion B of FIG. 22, when the switches are in the states shown on the left side of the figure, the rotor 163 rotates, whereby a magnetic field is generated in the conductor 162, and current flows through the coil 161 due to the magnetic field. The coil 161 supplies the generated current to the resistance RS1, and an induced voltage Vrs1 is generated in the resistance RS1. When the induced voltage Vrs1 exceeds a predetermined threshold value, the timepiece control unit 5*g* determines that the rotor 163 has rotated. On the other hand, when the induced voltage Vrs1 is not greater than the predetermined threshold value, the timepiece control unit 5*g* determines that the rotor 163 has not rotated.

Figure 23:
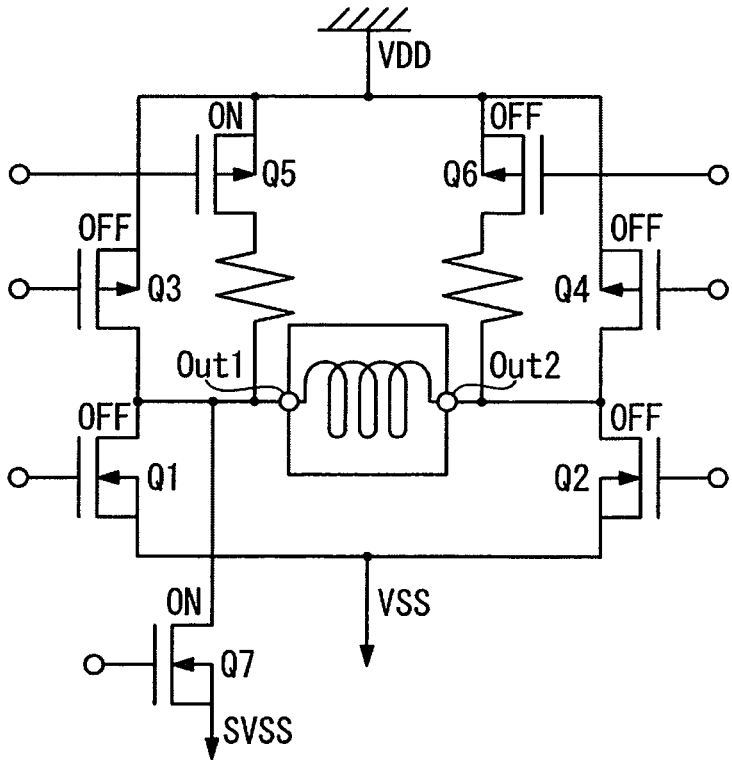
FIG. 23 is a diagram illustrating the states of respective switches when a power saving state is set by a power consumption control unit.

FIG. 23 is a diagram illustrating the states of respective switches when a power saving state is set by the power consumption control unit 10*g*. In FIG. 23, the states of the respective switches are shown.

In FIG. 23, the PMOS switch Q5 and the NMOS switch Q7 are in the ON state (conduction state), and the other switches are in the OFF state (open state).

The PMOS switch Q5 and the NMOS switch Q7 are in the ON state, whereby the output terminal Out1 is electrically connected to the power supply line VDD through the resistance RS1, and the output terminal Out1 is also electrically connected to the power supply line SVSS. That is, the resistance RS1 is inserted between the power supply line VDD and the power supply line SVSS.

In this case, since no current flows from the output terminal Out1 to the output terminal Out2, the rotor 163 does not rotate.

In this way, when the power consumption control unit 10*g* sets the power saving state, the power consumption control unit 10*g* outputs the switching signal Is of the H state to the motor driving circuit 51. When the switching signal Is of the H state is input, the motor driving circuit 51 inserts the resistance RS1 between the power supply line VDD and the power supply line SVSS. In this way, the power consumption control unit 10*g* can cause the timepiece control unit 5*g* to transition from the normal operation state to the power saving state (alternatively, the timepiece control unit 5*g* is caused to be kept in the power saving state).

On the other hand, when the power consumption control unit 10*g* detects the charging state during the power saving state, the power consumption control unit 10*g* outputs the switching signal Is of the L state to the motor driving circuit 51. When the switching signal Is of the L state is input, the motor driving circuit 51 removes the resistance RS1 between the power supply line VDD and the power supply line SVSS. In this way, the power consumption control unit 10*g* can cause the timepiece control unit 5*g* to transition from the power saving state to the normal operation state (alternatively, the timepiece control unit 5*g* is caused to be kept in the normal operation state).

Figure 24:
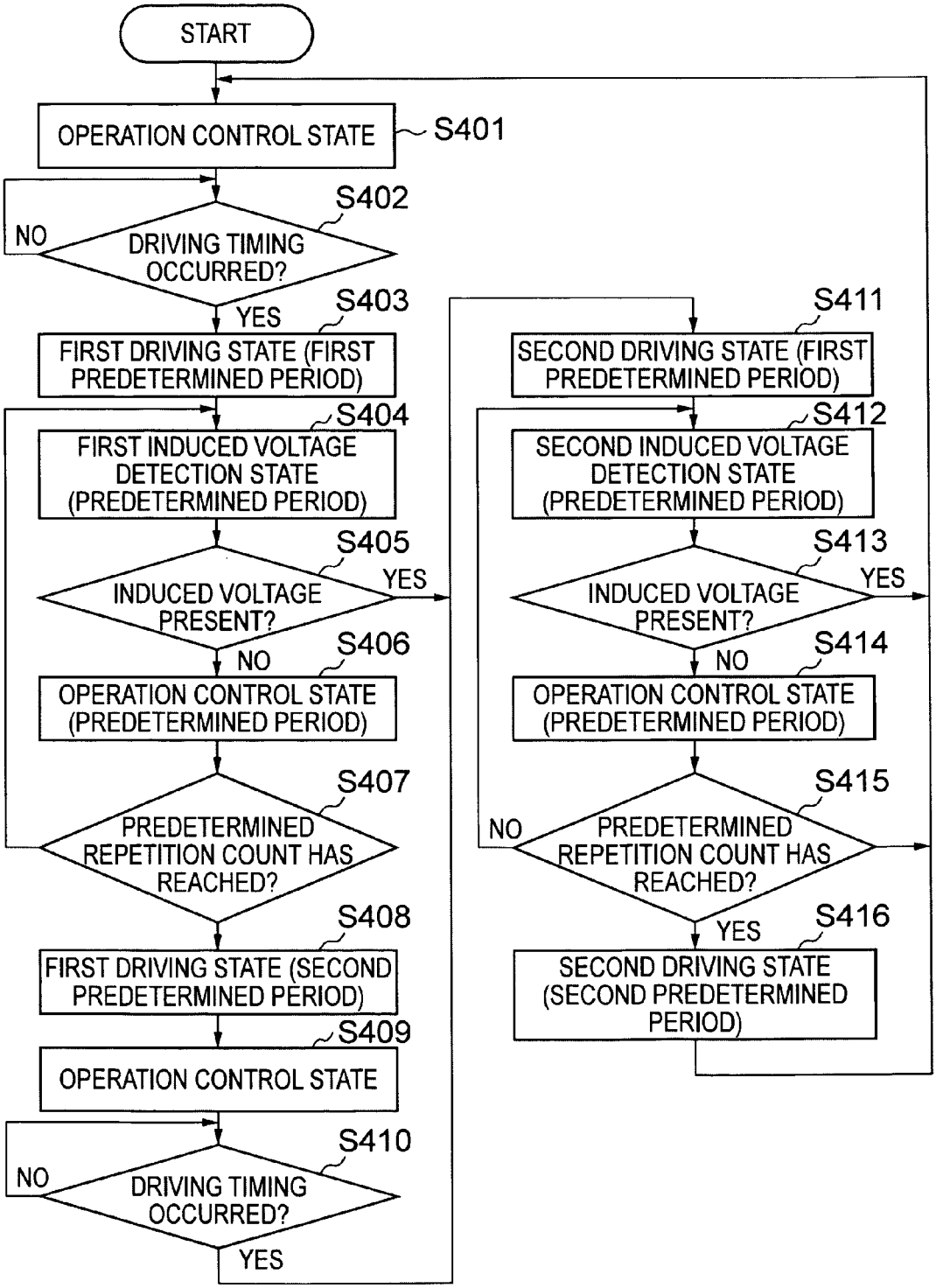
FIG. 24 is a flowchart showing the flow of processes of a timepiece control unit of a timepiece during a normal operation in the seventh embodiment.

FIG. 24 is a flowchart showing the flow of processes of the timepiece control unit 5*g* of the timepiece 100*g* during the normal operation in the seventh embodiment. First, the timepiece control unit 5*g* puts the timepiece 100*g* into the braking state (step S401). The timepiece control unit 5*g* determines whether a driving timing signal which is an internal signal generated every predetermined time intervals (for example, 1 second) has been generated (step S402). When the driving timing signal has not been generated (step S402: NO), the timepiece control unit 5*g* returns to step S402.

On the other hand, when the driving timing signal has been generated (step S402: YES), the timepiece control unit 5*g* causes the timepiece 100*g* to transition to the first driving state for a predetermined first period (step S403). Subsequently, the timepiece control unit 5*g* causes the timepiece 100*g* to transition to the first induced voltage detection state for a predetermined period (step S404). Subsequently, the timepiece control unit 5*g* determines whether there is an induced voltage (step S405).

When the induced voltage is determined to be present (step S405: YES), the timepiece control unit 5*g* returns to step S409. On the other hand, when the induced voltage is determined not to be present (step S405: NO), the timepiece control unit 5*g* causes the timepiece 100*g* to transition to the braking state for a predetermined period (step S406). Subsequently, the timepiece control unit 5*g* determines whether the number of times in which the timepiece 100*g* has transitioned to the first induced voltage detection state has reached a predetermined repetition count (step S407).

When the number of times has not reached the predetermined repetition count (step S407: NO), the timepiece control unit 5*g* returns to step S404. On the other hand, when the number of times has reached the predetermined repetition count (step S407: YES), the timepiece control unit 5*g* causes the timepiece 100*g* to transition to the first driving state for a predetermined second period (step S408). Subsequently, the timepiece control unit 5*g* causes the timepiece 100*g* to transition to the braking state (step S409).

The timepiece control unit 5*g* determines whether a driving timing signal which is generated every predetermined time intervals (for example, 1 second) has been generated (step S410). When the driving timing signal has not been generated (step S410: NO), the timepiece control unit 5*g* returns to step S409. On the other hand, when the driving timing signal has been generated (step S410: YES), the timepiece control unit 5*g* causes the timepiece 100*g* to transition to the second driving state for the predetermined first period (step S411).

Subsequently, the timepiece control unit 5*g* causes the timepiece 100*g* to transition to the second induced voltage detection state for a predetermined period (step S412).

Subsequently, the timepiece control unit 5*g* determines whether there is an induced voltage (step S413). When the induced voltage is determined to be present (step S413: YES), the timepiece control unit 5*g* returns to step S401. On the other hand, when the induced voltage is determined not to be present (step S413: NO), the timepiece control unit 5*g* causes the timepiece 100*g* to transition to the braking state for a predetermined period (step S414).

Subsequently, the timepiece control unit 5*g* determines whether the number of times in which the timepiece 100*g* has transitioned to the second induced voltage detection state has reached a predetermined repetition count (step S415). When the number of times has not reached the predetermined repetition count (step S412: NO), the timepiece control unit 5*g* returns to step S412. On the other hand, when the number of times has reached the predetermined repetition count (step S412: YES), the timepiece control unit 5*g* causes the timepiece 100*g* to transition to the second driving state for the predetermined second period. Subsequently, the timepiece control unit 5*g* returns to step S401.

As described above, the timepiece 100*g* of the present embodiment repeatedly transitions between the braking state, the first driving state, the first induced voltage detection state, (and optionally, the first driving state), the braking state, the second driving state, and the second induced voltage detection state (and optionally, the second driving state), to thereby rotate the rotor 163 of the time motor 6.

Since the operation of the timepiece 100*g* of the present embodiment is the same as that of the flowchart shown in FIG. 14, except for the process of step S306, the flowchart thereof is not provided. In step S306 of FIG. 14, the power consumption control unit 10*g* of the present embodiment puts the PMOS switch Q5 and the NMOS switch Q7 of the motor driving circuit 51 into the ON state (conduction state). In this way, the power consumption control unit 10*g* inserts the resistance RS1 serving as the load resistance in the motor driving circuit 51 between the power supply line VDD and the power supply line SVSS. That is, the power consumption control unit 10*g* connects a predetermined load (in this example, the resistance RS1) to the photovoltaic cell 1.

As described above, in the timepiece 100*g* of the present embodiment, it is possible to prevent repeated transition between the power saving state and the normal operation state when the electromotive force of the primary power supply unit is not sufficient. Moreover, the timepiece 100*g* of the present embodiment can suppress an increase in the circuit size as compared to the timepiece 100*f* of the sixth embodiment by using the load resistance 132 of the photovoltaic cell load unit 13 in the sixth embodiment as the resistance RS1 of the motor driving circuit 51.

In the timepiece 100*g* of the present embodiment, although the oscillation prevention unit that prevents oscillation of the charging detection signal includes the first load unit, the present invention is not limited to this, but the oscillation prevention unit may further include at least one of the diode element 63 and the chattering prevention circuit unit 67. Moreover, the oscillation prevention unit may include at least one of the respective chattering prevention units (11*c* and 11*d*) of the third or fourth embodiment instead of the diode element 63.

In the above embodiment, the oscillation control unit 3, the quartz oscillator 4, the timepiece control unit 5, the battery voltage detection unit 8, the charging detection and backflow prevention unit 9, and the power consumption control unit 10 of the timepiece 100 may be realized by special-purpose hardware, and may be configured by a memory and a CPU (Central Processing Unit) and the respective functions described above may be realized by program. Moreover, the respective units may be realized by an integrated circuit such as IC.

Moreover, in the respective embodiments, the respective units of the timepiece 100*b*, 100*c*, 100*d*, 100*e*, 100*f*, or 100*g* may be realized by special-purpose hardware, and may be configured by a memory and a CPU (Central Processing Unit), and the respective functions described above may be realized by program. Moreover, the respective units may be realized by an integrated circuit such as IC.

The above-described timepiece 100, 100*b*, 100*c*, 100*d*, 100*e*, 100*f*, or 100*g* includes a computer system therein. The processing procedures of the above-described respective units are stored in a computer-readable recording medium in the form of program, and the computer reads and executes the program, whereby the processes described above are performed. Here, the computer-readable recording medium refers to a magnetic disc, an magneto-optical disc, a CD-ROM, a DVD-ROM, a semiconductor memory, and the like. Moreover, the computer program may be transferred to a computer through a communication line, and the computer having received the program may execute the program.

What is claimed is:

1. A power consumption control device comprising a power consumption control unit that causes a timepiece device to transition to a power saving state where a clock operation of measuring time is stopped when an output potential difference of a secondary power supply unit charged by an electromotive force of a primary power supply unit is not greater than a predetermined threshold value, and the secondary power supply unit is in a non-charging state indicating a state where an output potential difference of the primary power supply unit is not greater than the output potential difference of the secondary power supply unit.

2. The power consumption control device according to claim 1, further comprising:

a charging detection unit that compares the output potential difference of the primary power supply unit with the output potential difference of the secondary power supply unit and generates a charging detection signal indicating that the secondary power supply unit is in the non-charging state when the output potential difference of the primary power supply unit is not greater than the output potential difference of the secondary power supply unit; and an oscillation prevention unit that prevents oscillation of the generated charging detection signal, wherein the transition to the power saving state by the power consumption control unit is performed based on the generated charging detection signal.

3. The power consumption control device according to claim 2, wherein the oscillation prevention unit includes a predetermined load, and wherein when the charging detection signal indicates the non-charging state, the power consumption control unit causes the load to be connected to the primary power supply unit.

4. The power consumption control device according to claim 1, wherein the power consumption control unit determines whether the secondary power supply unit is in the non-charging state when the timepiece device is in the power saving state, and wherein the power consumption control unit causes the timepiece device to transition from the power saving state to a clock operation state where the clock operation is performed when the secondary power supply unit is not in the non-charging state.

5. The power consumption control device according to claim 1, wherein the threshold value is a value greater by a predetermined potential difference than a lower-limit potential difference in which the clock operation is possible.

6. The power consumption control device according to claim 1, wherein the timepiece device includes a timepiece control unit, and wherein the power consumption control unit causes the timepiece control unit to stop the clock operation when the timepiece device is caused to transition to the power saving state.

7. The power consumption control device according to claim 6, wherein the timepiece device includes an oscillation control unit that oscillates and generates a fundamental clock signal used for measuring time, and wherein the power consumption control unit causes the oscillation control unit to stop oscillating the fundamental clock signal when the timepiece device is caused to transition to the power saving state.

8. The power consumption control device according to claim 7, wherein the oscillation control unit includes a constant voltage circuit unit and stops the operation of the constant voltage circuit unit when the timepiece device is in the power saving state.

9. The power consumption control device according to claim 7, wherein the power consumption control unit causes the timepiece control unit to stop the clock operation and then causes the oscillation control unit to stop oscillating the fundamental clock signal when causing the timepiece device to transition to the power saving state, and wherein the power consumption control unit causes the oscillation control unit to start oscillating the fundamental clock signal and then causes the timepiece control unit to start the clock operation when causing the timepiece device to transition from the power saving state to the clock operation state.

10. The power consumption control device according to claim 6, wherein the clock operation includes an operation of driving a time motor that moves the hands of the timepiece device displaying time, wherein the threshold value is a value greater by a predetermined potential difference than a lower-limit potential difference in which the time motor can be driven, and wherein the timepiece control unit stops the driving of the time motor when transitioning to the power saving state.

11. The power consumption control device according to claim 1, wherein the power consumption control device includes:

an output detection unit that detects a state where the output potential difference of the secondary power supply unit is not greater than the threshold value; and a charging detection unit that detects the non-charging state, wherein the power consumption control unit determines whether the output potential difference of the secondary power supply unit is not greater than the threshold value based on the detection result by the output detection unit, and wherein the power consumption control unit determines whether the secondary power supply unit is in the non-charging state based on the detection result by the charging detection unit.

12. The power consumption control device according to claim 2, wherein the power consumption control device includes a detection unit that detects whether the output potential difference of the secondary power supply unit is not greater than a predetermined threshold value, and wherein the power consumption control unit causes the timepiece device to transition to the power saving state when the secondary power supply unit is in the non-charging state, and the detection result by the detection unit is not greater than the predetermined threshold value and releases the power saving state when the secondary power supply unit is not in the non-charging state.

13. The power consumption control device according to claim 2, further comprising a switching unit that prevents current from back-flowing from the secondary power supply unit to the primary power supply unit when the output of the charging detection unit indicates the non-charging state, wherein the oscillation prevention unit includes a diode element that is disposed in series to the switching unit so that when the secondary power supply unit is not in the non-charging state, a forward bias is applied between a positive terminal of the secondary power supply unit and a positive terminal of the primary power supply unit, or between a negative terminal of the secondary power supply unit and a negative terminal of the primary power supply unit, and generates a predetermined prescribed potential difference between the two input terminals subjected to the comparison in the charging detection unit.

14. The power consumption control device according to claim 2, wherein the oscillation prevention unit includes a resistor element that is disposed in series to the switching unit between a positive terminal of the secondary power supply unit and a positive terminal of the primary power supply unit, or between a negative terminal of the secondary power supply unit and a negative terminal of the primary power supply unit, and generates a predetermined prescribed potential difference between the two input terminals subjected to the comparison in the charging detection unit.

15. The power consumption control device according to claim 2, wherein the oscillation prevention unit includes a low-pass filter that removes a pulse signal of a predetermined prescribed frequency or higher from the output of the charging detection unit.

16. The power consumption control device according to claim 2, wherein the oscillation prevention unit includes a logic circuit that operates based on a clock signal of a predetermined prescribed cycle and removes a pulse signal of a prescribed pulse width or shorter based on the cycle from the output of the charging detection unit.

17. The power consumption control device according to claim 16, wherein the logic circuit includes a shift register which maintains a reset state when the output of the charging detection unit indicates the non-charging state, and of which the clock terminal is supplied with the clock signal and of which the input terminal is fixed at a logic high state, and wherein the output of the shift register is the output of the oscillation prevention unit.

18. The power consumption control device according to claim 16, wherein the clock signal is generated by the electricity supplied from the primary power supply unit.

19. The power consumption control device according to claim 3, wherein the power consumption control unit disconnects the load from the primary power supply unit when it is determined that the timepiece device being in the power saving state is to be caused to transition to the power saving state.

20. The power consumption control device according to claim 3, wherein the oscillation prevention unit includes a switching unit that connects a predetermined load to the primary power supply unit.

21. The power consumption control device according to claim 3, further comprising:

a secondary power supply unit that is charged by the electromotive force; and a detection unit that detects whether the output potential difference of the secondary power supply unit is not greater than a predetermined threshold value, wherein the power consumption control unit causes the timepiece device to transition to the power saving state when the detection result by the detection unit is not greater than the predetermined threshold value, and wherein the predetermined load is a load of which the power consumption is larger than the power consumption of the second load unit when the output voltage difference of the secondary power supply unit is the same as the predetermined threshold value, and the power saving state is released.

22. The power consumption control device according to claim 3, wherein the primary power supply unit is a photovoltaic cell, wherein the predetermined load is determined based on the relationship between the electromotive force and the intensity of light exposed to a panel of the photovoltaic cell that generates the electromotive force.

23. The power consumption control device according to claim 3, further comprising a timepiece control unit that controls the clock operation, wherein the timepiece control unit includes a load, and wherein the power consumption control unit causes the load of the timepiece control unit to be connected to the primary power supply unit when the charging detection signal indicates the non-charging state.

24. The power consumption control device according to claim 1, wherein the primary power supply unit is a photovoltaic cell that generates an electromotive force upon exposure to light.

25. A timepiece device comprising the power consumption control device according to claim 1.

26. An electronic device comprising the power consumption control device according to claim 1.

27. A power consumption control method comprising a power consumption control procedure of causing a timepiece device to transition to a power saving state where a clock operation of measuring time is stopped when an output potential difference of a secondary power supply unit charged by an electromotive force of a primary power supply unit is not greater than a predetermined threshold value, and the secondary power supply unit is in a non-charging state indicating a state where an output potential difference of the primary power supply unit is not greater than the output potential difference of the secondary power supply unit.

28. A power consumption control program for causing a computer to execute:

a power consumption control step of causing a timepiece device to transition to a power saving state where a clock operation of measuring time is stopped when an output potential difference of a secondary power supply unit charged by an electromotive force of a primary power supply unit is not greater than a predetermined threshold value, and the secondary power supply unit is in a non-charging state indicating a state where an output potential difference of the primary power supply unit is not greater than the output potential difference of the secondary power supply unit.

* * * * *